US006057652A

United States Patent [19]

Chen et al.

[11] Patent Number: 6,057,652

[45] Date of Patent: May 2, 2000

[54] POWER SUPPLY FOR SUPPLYING AC OUTPUT POWER

[75] Inventors: Wei Chen; Fred C. Lee, both of Blacksburg, Va.; Koji Nishiura, Osaka, Japan; Tokushi Yamauchi, Brookline, Mass.; Yoshinobu Murakami; Minoru Maehara, both of Osaka, Japan

[73] Assignees: Matsushita Electric Works, Ltd., Osaka, Japan; Virginia Tech Intellectual Properties, Inc., Blacksburg, Va.

[21] Appl. No.: 08/598,872

[22] Filed: Feb. 9, 1996

[51] Int. Cl.[7] ..... H05B 37/02

[52] U.S. Cl. ..... 315/307; 315/219; 315/224; 315/DIG. 4; 363/37

[58] Field of Search ..... 315/307, 308, 315/209 R, 224, 226, DIG. 4, DIG. 5, DIG. 7, DIG. 2, 219, 220, 221, 223; 363/34, 37

[56] References Cited

U.S. PATENT DOCUMENTS

| | | | |
|---|---|---|---|
| 4,017,785 | 4/1977 | Perper | 321/4 |
| 4,045,711 | 8/1977 | Pitel | 315/209 R |
| 4,075,476 | 2/1978 | Pitel | 315/209 R |
| 4,109,307 | 8/1978 | Knoll | 363/101 |
| 4,463,286 | 7/1984 | Justice | 315/219 |
| 4,511,823 | 4/1985 | Eaton et al. | 315/226 |
| 4,808,887 | 2/1989 | Fähnrich et al. | 315/247 |
| 5,003,231 | 3/1991 | Perper | 315/291 |
| 5,010,277 | 4/1991 | Courier de Mere | 315/200 R |
| 5,134,556 | 7/1992 | Courier de Mere | 363/37 |
| 5,274,540 | 12/1993 | Maehara | 363/37 |
| 5,343,122 | 8/1994 | Sugimori et al. | 315/209 R |
| 5,374,875 | 12/1994 | Shackle et al. | 315/247 |
| 5,387,846 | 2/1995 | So | 315/209 R |
| 5,404,082 | 4/1995 | Hernandez et al. | 315/219 |
| 5,412,287 | 5/1995 | Shackle | 315/247 |
| 5,459,651 | 10/1995 | Maehara | 363/34 |
| 5,502,635 | 3/1996 | Bobel | 363/132 |

*Primary Examiner*—David H. Vu
*Attorney, Agent, or Firm*—Greenblum & Berstein, P.L.C.

[57] ABSTRACT

High voltage stress on the semiconductor devices at light load conditions, high total harmonic distortion (THD) of the line current, and poor crest factor (CF) of lamp current of "charge pump" electronic ballast circuits make them difficult to manufacture cost-effectively. To overcome these deficiencies, the DC bus voltage is reduced at light loads by providing a second resonance. One technique, high-frequency second-stage resonance, provides sufficient pre-heating at low $V_{dc}$. Combined with the instant startup and the proper restart scheme, this technique can greatly reduce the maximum $V_{dc}$ at ignition. Another technique, low-frequency second-stage resonance, can reduce the steady state $V_{dc}$ at light loads, including during start-up. Consequently, high ignition voltage can be continuously impressed on the lamp without increasing $V_{dc}$. Further, a diode clamping technique smooths the envelope of $V_a$, thereby achieving near unity power factor, low THD and low CF without close-loop control.

7 Claims, 57 Drawing Sheets

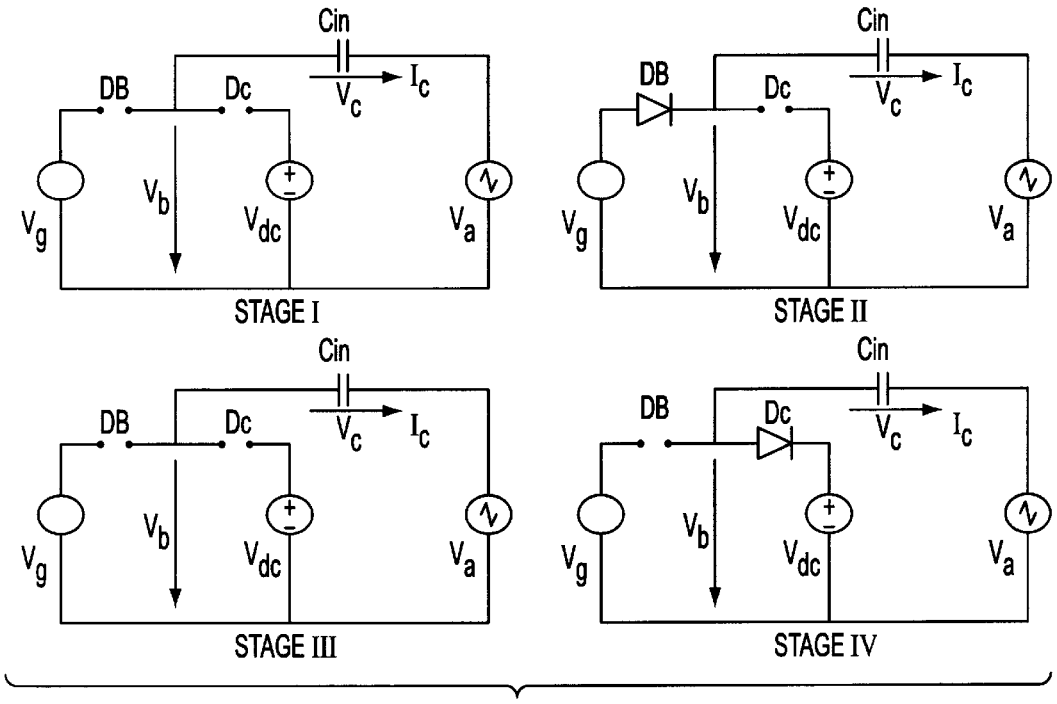
FIG. 30
FIG. 31
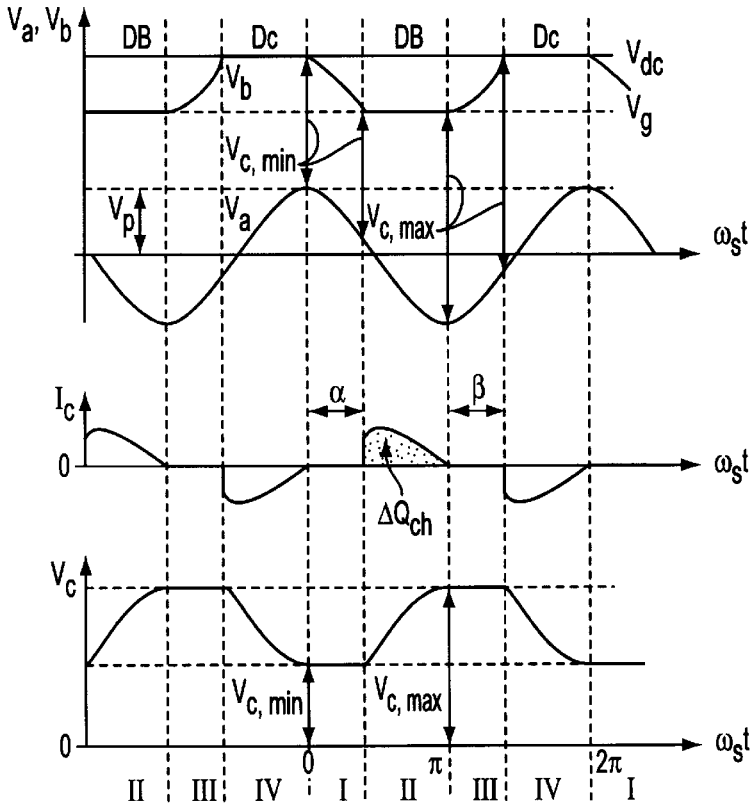

$Cr_1 = Cr_0 + C_{in,eq}$

POWER SUPPLY FOR SUPPLYING AC OUTPUT POWER

BACKGROUND OF THE INVENTION

1. Field of the Invention

The present invention is directed to a power supply that rectifies and smooths an AC voltage and provides a high frequency electric power through an inverter. In particular, the present invention relates to "charge pump" electronic ballast circuits for discharge lamps (e.g., fluorescent lamps). More specifically, the invention relates to the structure and operation of "charge pump" electronic ballast circuits having reduced DC bus voltages and voltage stresses at light loads, and incorporates improvements in input power factor, in reduced total harmonic distortion (THD) of the input current, and in reduced crest factor of the lamp current. Various deficiencies are overcome in a lamp preheat; start-up and normal lighting operations of the discharge lamps.

2. Discussion of Background And Other Information

In a prior power supply utilizing a rectifier for full-wave rectification of an AC voltage and a smoothing capacitor for smoothing the resulting DC voltage to provide a DC voltage, the AC current will not flow into the rectifier during a period in which an output voltage of the rectifier is less than a terminal voltage across the smoothing capacitor, thereby leaving a period of time (e.g. an off period) in which there is no current flow. The presence of the off-period brings about a lag between the input current and the voltage to thereby lower an input power factor and to produce a noise due to the input current distortion.

To overcome this problem, it is necessary to continue supplying the input current irrespective of the output voltage level from the rectifier. To this end, it has been proposed to feed back the high frequency output from an inverter supplied with the smoothed DC voltage which is obtained by rectifying and smoothing the input AC voltage, in order to interrupt the input current from the AC voltage source at a frequency sufficiently higher than the frequency of the AC voltage source, thereby avoiding the appearance of the off-period in the input AC current continuing over about one cycle of the input AC current.

One example for achieving the above proposal is shown in FIG. 17. This example has the configuration disclosed in Japanese Patent Early Publication No. HEI 7-147778. This configuration includes a rectifier RE that provides full-wave rectification of the input AC current from the AC voltage source, such as an AC mains, and a smoothing capacitor C1 for smoothing the output from the rectifier RE to produce a DC voltage. The resulting DC voltage is converted by an inverter 1 into a high frequency electric power, which is then applied to a discharge lamp La, i.e., a load through an output transformer T1. The output transformer T1 includes a pair of pre-heating windings np, each connected across each filament F1 and F2 of the discharge lamp La for supplying a pre-heating current to the filaments F1 and F2. Also included in the output transformer T1 is a feedback winding n13 which is connected in series with a capacitor C2 to form a series circuit of the feedback winding n13 and capacitor C2. This circuit is inserted between the input terminals of the rectifier RE. An inductor L2 is connected between the AC voltage source and the rectifier RE to form a resonant circuit with capacitor C2. Connected between the inductor L2 and the AC voltage source AC is a line filter F. The resonant circuit of inductor L2 and capacitor C2 is designed to have a resonant frequency that is nearly equal to an output frequency of the inverter 1.

An equivalent circuit of the above configuration is shown in FIG. 18, in which the rectifier RE is connected across the AC voltage source through line filter F (only capacitor CF is shown in the figure) and the resonant circuit 2. The smoothing capacitor C1 is connected to smooth the output of the rectifier RE. The inverter 1, deriving its input voltage from the capacitor C1, is shown as a load Z. The resonant circuit 2 comprises capacitor C2 connected in series with a high frequency voltage source VR and inductor L2 connected between the line filter F and the rectifier RE. The series circuit of capacitor C2 and the high frequency voltage source VR is connected across the input terminals of the rectifier RE. The high frequency voltage source VR corresponds to feedback winding n13.

Considering a positive half-cycle of the AC voltage source, a high frequency voltage induced at feedback winding n13 alternates so that two periods alternate with each other; one period in which capacitor C2 is charged by a current flowing through AC voltage source—inductor L2—capacitor C2—high frequency voltage source VR and the other period in which an output voltage of the high frequency voltage source VR is applied across capacitor C2 and then to rectifier RE. That is, within one cycle of the high frequency voltage source VR, there appears a certain period in which AC voltage source flows a charge current to capacitor C2, so that it is possible to flow an input current from the AC voltage source at a frequency sufficiently higher than that of the AC voltage source. With the use of a line filter F (expressed by capacitor CF) provided between the AC voltage source and resonant circuit 2, the waveform of the input current from the AC voltage source becomes an envelop of the waveform of the input current supplied to the resonant circuit 2, so that the input current will flow continuously from the AC voltage source at a level generally proportional to the voltage of the AC voltage source. Thus, a high power factor and a low input current distortion can be achieved. Although only the positive half-cycle is described in the above, a negative half-cycle operates in the same manner.

When the above operation is done, an input voltage to the rectifier RE varies, as shown in FIG. 19, between an upper extreme (E+E0) and a lower extreme (—E—E0), wherein E is the voltage of the AC voltage source and E0 varies with an induced voltage across the feedback winding n13 to be nearly twice as large as the induced voltage. Thus, there appears a period in which the voltage exceeds the peak voltage of the AC voltage source.

As shown in FIG. 20, a scheme was proposed in Japanese Patent Early Publication No. HEI 5-38161 to avoid the off-period of the input current by feeding back a portion of the high frequency output from the inverter 1 to the input side. This configuration does not include the resonant circuit 2 between the filter F and rectifier RE, but includes means to feed back a portion of the high frequency output from the inverter 1 to the input side of the inverter after making full rectification through the rectifier RE. A parallel circuit of a feedback capacitor C4 and a diode D3 is inserted between the rectifier RE and a smoothing capacitor C1. The polarity of diode D3 is selected in order to flow a charging current from the rectifier RE to the smoothing capacitor C1.

The inverter 1 comprises a series connected pair of switching elements Q1 and Q2 connected in parallel with the smoothing capacitor C1. A series circuit of a DC blocking capacitor C0, a load, e.g., discharge lamp La, and the inductor L3 is inserted between the positive output terminal of the rectifier RE and the connection point of the switching elements Q1 and Q2. The switching elements Q1 and Q2 are MOSFET transfers which are controlled by a switching controller CN to alternately turn on and off without being caused to turn on simultaneously. It is noted that the switching elements Q1 and Q2 include internal parasitic diodes D1 and D2. The discharge lamp La includes filaments F1 and F2 between which a pre-heating capacitor Cp is connected.

The inverter 1 operates as follows: it is noted that a current flows through filaments F1 and F2 and capacitor Cp to preheat the filaments F1 and F2 before the discharge lamp La is turned on, and that the capacitor Cp is disconnected from the circuit upon turn-on of the discharge lamp La. In the following explanation, the discharge lamp La and the capacitor Cp are regarded as the load circuit.

The inverter 1 operates differently depending upon the relation between the output voltage of the rectifier RE and the voltage developed across the smoothing capacitor C1. Considering a period in which the output voltage of the rectifier RE which exceeds the voltage of the smoothing capacitor C1, the diode D3 is made conductive to flow the charging current from the rectifier RE to the smoothing capacitor C1. When the switching element Q2 is made conductive in this period, a current flows from the rectifier RE through capacitor C0—load circuit—inductor L3—switching element Q2. Subsequently, when the switching element Q2 is turned off, energy stored in the inductor L3 is released through a path of parasitic diode D1—smoothing capacitor C1—rectifier RE—capacitor C0—load circuit. Thereafter, when the switching element Q1 is made conductive, capacitor C0 is discharged to flow a current though a path of diode D3—switching element Q1—inductor L3—load circuit. Upon subsequent turn-off of the switching element Q1, energy stored in inductor L3 is released through a path of the load circuit—capacitor C0—diode D3—smoothing capacitor C1—parasitic diode D2. That is, during this period, in which rectifier RE provides an output voltage higher than the voltage of the smoothing capacitor C1, the diode D3 becomes conductive to provide no current flow through capacitor C4 and the load circuit receives a high frequency alternate current in accordance with the above operations.

On the other hand, during a period in which the output voltage of the rectifier RE is less than the voltage of the smoothing capacitor C1, diode D3 is made not conductive and capacitor C4 becomes operative. This condition is expressed by V1$^3$Vin and V1+V4=Vin, wherein V1 is the voltage across smoothing capacitor C1, V4 is the voltage across capacitor C4, and Vin is the output voltage of rectifier RE. V4 £ 0 means that capacitor C4 acts to absorb the difference between the voltage across the smoothing capacitor C1 and the output voltage of the rectifier RE. With this result, it is possible to flow the current from the rectifier RE to the inverter 1 even during the period in which the output voltage of the rectifier RE is less than the voltage across the smoothing capacitor C1, thereby elongating the period of flowing current from the AC voltage source than without the capacitor C4, and therefore reducing the off-period of flowing no current as well as reducing input current distortion.

The operation of the circuit shown in FIG. 20 will be explained in more detail. When the switching element Q2 is made conductive, current flows from smoothing capacitor C1 through a path of capacitor C4—capacitor C0—load circuit—inductor L3—switching element Q2. At the same time, current flows from rectifier RE through a path of capacitor C0—load circuit—inductor L3—switching element Q2. Upon turn-off of the switching element Q2, energy stored in inductor L3 is released through a path of parasitic diode D1—capacitor C4—capacitor C0—load circuit. When the switching element Q1 is turned on, current flows from capacitor C4 through switching element Q1—inductor L3—load circuit—capacitor C0. Upon subsequent turn-off of switching element Q1, energy stored in inductor L3 is released through a path of load circuit—capacitor C0—capacitor C4—smoothing capacitor C1—parasitic diode D2.

As apparent from the above explained operations, during the period in which the output voltage of the rectifier RE is less than the voltage across the smoothing capacitor C1, the capacitor C4 repeats being charged and discharged in response to the turn-on and turn-off of the switching elements Q1 and Q2. Since the charging and discharging are accompanied with a condition where capacitor C4 is charged by the energy from the inverter 1 and a condition where capacitor C4 is discharged to charge smoothing capacitor C1, capacitor C4 can be said to have a feedback function of delivering a portion of the output from the inverter 1 to charge smoothing capacitor C1.

FIG. 21 shows a configuration which is disclosed in Japanese Patent Early Publication (KOKAI) No. HEI 4-193067 to feed back a portion of the high frequency output of the inverter 1 to the input side thereof. Like in the above described configuration, this configuration utilizes no resonant circuit 2 and is arranged to feed back a portion of the high frequency output of the inverter 1 to the input side of the inverter after fill-wave rectification by the rectifier RE. As compared with the circuit of FIG. 20, a difference is seen in that capacitor C4 for feeding back a portion of the high frequency output of the inverter 1 is inserted between a positive terminal of the rectifier RE and a DC blocking capacitor C0, rather than being connected in parallel with the diode D3, and that a load circuit is connected in series with the capacitor C4 across the rectifier RE.

Inverter 1 is generally of the similar configuration as shown in FIG. 20, and comprises a pair of switching elements Q1 and Q2 connected across a smoothing capacitor C1. The DC blocking capacitor C0 is connected in series with an inductor L3 and feedback capacitor C4 between a positive terminal of rectifier RE and a connection point of the switching elements Q1 and Q2. The switching elements Q1 and Q2 are MOSFETs and are controlled by a switching control circuit (not shown) to alternately turn on and off without being caused to turn on simultaneously. The switching elements Q1 and Q2 include internal parasitic diodes D1 and D2. The discharge lamp La includes filaments F1 and F2 between which a pre-heating capacitor Cp is connected.

The inverter 1 operates as follows: when the switching element Q1 is made conductive, current flows from smoothing capacitor C1 through a path of switching element Q1, inductor—inductor L3—capacitor C0—load circuit Upon turn-off of the switching element Q1, energy stored in inductor L3 is released through a path of parasitic capacitor C0—load circuit—parasitic diode D2. Thereafter, when the switching element Q2 is turned on, current flows from capacitor C4 through a path of inductor L3—switching element Q2—load circuit. Upon subsequent turn-off of switching element Q2, energy stored in the inductor L3 is released through a path of parasitic diode D1—smoothing capacitor C1—load circuit—capacitor C0.

Since current will flow from capacitor C4 to inductor L3 when the switching element Q2 is conductive, as explained above, a current will also flow from rectifier RE through a path of capacitor C4—capacitor C0—inductor L3—switching element Q2. Capacitor C4 forms a resonant circuit with inductor L3 and switching elements Q1 and Q2 are turned on and off at a timing when nearly zero voltage is applied to the elements. Consequently, switching element Q1 is turned on at a polarity reversal of the current in the resonant circuit to flow current to the resonant circuit through a path of capacitor C4—diode D3—switching element Q1—inductor L3—capacitor C0, and through a path of capacitor C4—diode D3—smoothing capacitor C1—parasitic diode D2—inductor L3—capacitor C0.

That is, within one cycle in which the switching elements Q1 and Q2 are turned on and off, there appear two periods, one period in which current flows from the rectifier RE through the capacitor C4, and another period in which a portion of the high frequency output from the inverter 1 is fed back through the diode D3 to the smoothing capacitor C1 (the input side of the inverter 1), which enables the high frequency input current to continuously flow from the AC voltage source, thereby reducing the input current distortion. Also, since an envelop of the input current from the AC voltage source is made to be generally proportional to the input voltage, a high power factor is obtained.

The above described prior art configurations are designed to use the discharge lamp La as a load. Consequently, a control is made to pre-heat the filaments F1 and F2 for a predetermined period at the start of lamp lighting and subsequently to apply a starting voltage equal to about 3 or 4 times a normal lamp voltage required for keeping the lamp turned on, to start lighting the lamp, and thereafter to lower the voltage applied to the lamp for a stable lighting of the lamp. For example, with the circuit of FIG. 20, in the pre-heating period lasting over the predetermined period from the connection to the power source, the switching elements Q1 and Q2 are turned on and off at a frequency higher than a resonant frequency of a resonant circuit (including the inductor L3 and the load circuit) so as to flow current through the pre-heating capacitor Cp for pre-heating the filaments F1 and F2. Thereafter, the switching frequency approximates the resonant frequency to apply the resulting starting voltage to the discharge lamp La. Thus, the voltage is 3 or 4 times greater than the normal lighting voltage applied between the filaments F1 and F2, to start lighting the discharge lamp La.

In addition, lighting currently consumes up to approximately 25% of the total electrical energy used today. In the U.S. and throughout the world, government regulatory agencies have required the use of electronic ballast devices to save energy and to improve power quality. As demand for high frequency electronic ballast has grown rapidly in recent years, a number of innovative topographies have emerged. Among them, the "charge pump" electronic ballasts have gained popularity for use with discharge lamps due to their simplicity and low cost.

Since the electronic ballast is an ac/ac power processor converts the line frequency ac power into high frequency ac power to light the lamp, the ballast circuit consists of two stages: ac/dc rectification with a power factor correction (PFC) 100 and dc/ac inversion 101 (as shown in FIG. 22). FIG. 23 shows an example of a conventional electronic ballast: a PFC boost converter 102 followed by a parallel resonant inverter 103. Since there are two controls available in this circuit, good performance, such as good unity power factor and low crest factor of the lamp current, and good dimming of the light, etc., can be easily obtained. However, the two-stage approach requires two sets of power stages and control circuits. The cost of this electronic ballast is high. It is noted that a crest factor of the lamp current is defined as $CF=I_{1a,pk}/I_{1a,rms}$, and the peak value $I_{1a,pk}$ and the rms value $I_{1a,rms}$ of the lamp current are measured on the basis of one line cycle.

If the boost converter 102 is operated in a discontinuous current mode (DCM), some extent of PFC is naturally obtained. Therefore, two stages can be integrated into one stage. One example is shown in FIG. 24A. Two switches S1 and S2 are complementarily switched to drive the resonant inverter tank. At the same time, lower switch S1 implements the boost switch function, and anti-parallel diode $D_{s2}$ of upper switch S2 functions as a diode in the boost converter. Fast diode D1 in series with boost inductor $L_{in}$ ensures the DCM operation of the boost inductor $L_{in}$. In this topology, ripple across a dc bus is usually very small. Consequently, the crest factor of the lamp current can be low. Duty cycle control or frequency control can be adopted. With duty cycle control, the resonant tank current is sensed in order to turn on the MOSFET switch only when its body diode conducts. Otherwise, the reserve recovery current of the body diode may kill the MOSFET device. Under frequency control, the de bus voltage can increase significantly at light load operating conditions. An additional protection circuit is needed to prevent the switches from suffering the over voltage. The lower switch S1 in this circuit usually has a much larger current stress than the upper switch S2 because it has to take the sum of the boost inductor current and the resonant inverter tank current. Consequently, the size of the lower switch S1 must be larger than that of the upper switch S2. In order to reduce the THD of the input current, the dc bus voltage should be high enough. The voltage stress of the semiconductor devices can be high.

Another type of electronic ballast circuit, employing a charging capacitor and the high frequency source (either voltage source or current source) to implement PFC, was recently proposed. This type of ballast circuit is sometimes called "charge pump" circuit. FIG. 25A shows the principle diagram which employs the charging capacitor Cin and the high frequency ac voltage source (HFVS). By designing the dc bus voltage $V_{dc}$ to be higher than the input line voltage $V_g$, the diodes D and DB will not conduct at the same time. The input current would then equal the positive charging current of Cin, which is regulated by $V_a$, $V_g$ and $V_{dc}$. If the charge variation of Cin (which is proportional to the variation of $V_c$, as shown in FIG. 25B) follows the input voltage, the input average current will follow the input voltage, and a good input power factor can be obtained. One example of the "charge pump" circuit is shown in FIG. 6. Compared to the boost integrated circuit shown in FIG. 24A, this circuit replaces the boost inductor by a charging capacitor. It should be noted that the current stresses of the two switches in this circuit are then the same. Therefore, this type of circuit is potentially low-cost. However, the switches still suffer high voltage stress under light load conditions. Furthermore, due to an injection of line ripple through Cin, the crest factor of the lamp current and the THD of the line current can be high.

Due to the fact that the smoothing capacitor C1 becomes bulky with an increase in capacity, capacitor C1 is selected to have a capacity only sufficient to provide an adequate voltage input to the inverter 1 required to keep a stable operation of the inverter 1 (stable lighting of the discharge lamp La). That is, the smoothing capacitor C1 is selected to have a capacitance which provides a voltage less than when the smoothing capacitor C1 is charged directly from the output of the rectifier RE.

When the load of the inverter 1 becomes less, the input current to the inverter 1 is reduced, to thereby increase the voltage developed across the smoothing capacitor C1. This means that less electric power is consumed at the pre-heating and lamp starting, to thereby increase the voltage across the smoothing capacitor C1. Thus, the voltage across the smoothing capacitor C1 increases with a decrease in the load requirement. Particularly, at the time of starting the lamp which is a transition from the pre-heating to the lighting, switching frequency shifting is required to increase the voltage applied to the discharge lamp La, such that the voltage across smoothing capacitor C1 will increase largely with the circuit configuration of feeding back the output voltage of the inverter 1 to the input side.

When designing the circuit in due consideration of the increase in the voltage developed across the smoothing capacitor C1, a high dielectric strength is required to the smoothing capacitor C1 and also to the associated components of the inverter 1 supplied with its input voltage from the smoothing capacitor 1, which incurs a problem of increasing component costs.

SUMMARY OF THE INVENTION

The present invention has been accomplished in view of the above and has an object to provide a power source which is capable of preventing an excessive increase in the voltage of the smoothing capacitor due to a load variation and permitting the use of a smoothing capacitor of less dielectric strength than used in prior circuit configurations.

Further, in order to overcome various deficiencies in the lamp preheat, start-up and normal lighting operations of discharge lamps, the present invention is directed to the general principle of reducing the dc bus voltage at light loads, by employing a second-stage resonance to reduce either the ac amplitude of $V_a$ (see FIGS. 25–29), $V_p$, or the equivalent Cin. One technique, known as high-frequency second-stage resonance, can provide sufficient preheating at low $V_{dc}$. Combined with the instant startup and the proper restart scheme, this technique can greatly reduce the maximum $V_{dc}$ at the ignition instant.

Another technique, known as low-frequency second-stage resonance can reduce the steady state $V_{dc}$ at light loads, including the start-up mode. Consequently, a high ignition voltage can be continuously impressed on the lamp without increasing $V_{dc}$.

The diode clamping technique of the present invention is designed to lower THD and CF. A near unity power factor, and low THD and CF can be obtained with open-loop control.

BRIEF DESCRIPTION OF THE DRAWINGS

The invention is better understood by reading the following Detailed Description of the Preferred Embodiments with reference to the accompanying drawings, in which like reference numerals refer to like elements throughout, and in which:

FIG. 30 shows four power stages (I–IV) of the PFC circuit;

FIG. 31 shows theoretical waveforms of the four power stages;

FIGS. 39A and 29B show a second example circuit for changing Cin by using a resonant tank circuit;

DETAILED DESCRIPTION OF THE PREFERRED EMBODIMENTS

Figure 1:
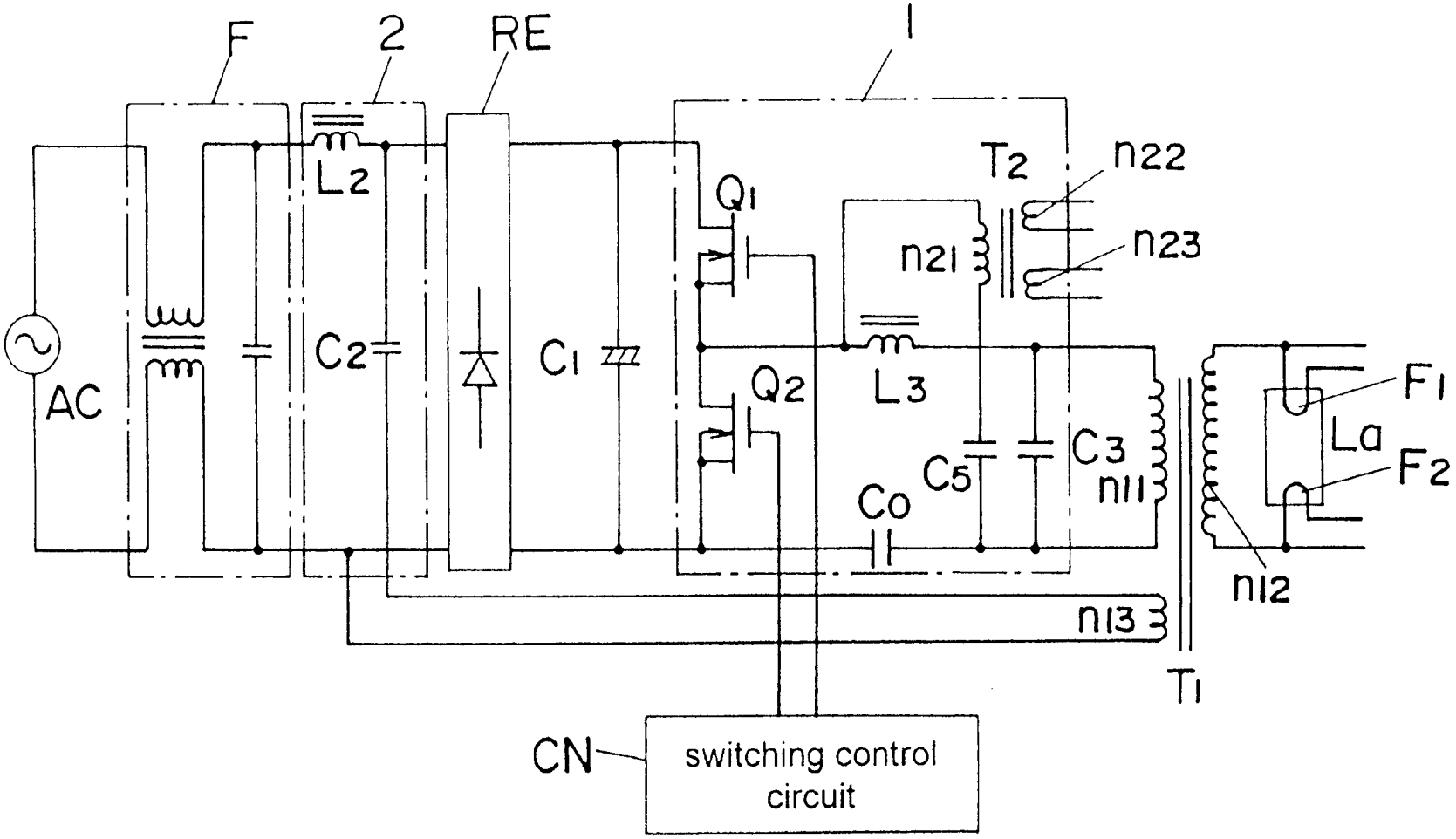
FIG. 1 is a circuit diagram of a first embodiment.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

FIG. 1 illustrates a power supply for operating a discharge lamp La as a load in accordance with an embodiment of the present invention. The power supply utilizes an output transformer T1 for connection to the load, i.e., discharge lamp La, as shown in the prior circuit configuration illustrated in FIG. 17. However, in contrast to the prior configuration of FIG. 17, in which output transformer T1 has pre-heating windings np, the power supply of this embodiment employs a pre-heating transformer T2 having preheat windings n22 and n23 connected to filaments F1 and F2, respectively, of discharge lamp La.

The power supply comprises a rectifier RE in the form of a diode bridge for full-wave rectification of the AC voltage from an AC voltage source, such as an AC mains, and a smoothing capacitor C1 for smoothing the output voltage of rectifier RE. A line filter F is inserted between AC voltage source and rectifier RE for blocking a high frequency component. Connected between line filter F and rectifier RE is an inductor L2, which forms a resonant circuit 2 with a capacitor C2. Capacitor C2 is connected in series with a feedback winding n13 of output transformer T1, with the series circuit of capacitor C2 and feedback winding n13 connected between the input terminals of rectifier RE. That is, feedback winding n13 defines itself as a feedback power source for feeding back the high frequency output voltage to the input side of rectifier RE. The above configurations are similar to those of the prior art illustrated in FIG. 17.

Smoothing capacitor C1 provides power to inverter 1. Inverter 1 comprises a series-connected pair of switching elements Q1 and Q2 in the form of MOSFET transistors, which are connected across smoothing capacitor C1 and controlled by a switching control circuit CN to alternately turn on and off without being caused to turn on simultaneously. A series resonant circuit of an inductor L3 and capacitor C3 is connected, through a DC blocking capacitor C0, between the source-drain path of switching element Q2 on the negative side of smoothing capacitor C1. That is, one end of inductor L3 is connected to the drain of switching element Q2, and one end of DC blocking capacitor C0 is connected to the source of switching element Q2, while capacitor C3 is connected between the other ends of inductor L3 and DC blocking capacitor C0. Output transformer T1 has a first winding n11 connected across capacitor C3 and has a second winding n12 connected to discharge lamp La. As described in the above, output transformer T1 includes feedback winding n13 which is connected in series with capacitor C2 between the input terminals of rectifier RE.

Connected in parallel with the above series resonant circuit of inductor L3 and capacitor C3 is another series resonant circuit of first winding n21 of pre-heating transformer T2 and capacitor C5, which resonant circuit has a resonant frequency higher than the resonant circuit of inductor L3 and capacitor C3. As described above, pre-heating transformer T2 has a pair of preheat windings n22 and n23 connected to filaments F1 and F2, respectively, of discharge lamp La An explanation will now be made to the operations of the embodiment Switching elements Q1 and Q2 are controlled by switching control circuit CN to alternately turn on and off. When switching element Q1 is on, current flows through a path of inductor L3—output transformer T1 and capacitor C3—capacitor C0 and a path of first winding n21 of pre-heating transformer T2—capacitor CS—capacitor C0. When switching element Q2 is on, current flows through a path of capacitor C0 —output transformer T1 and capacitor C3—inductor L3 and a path of capacitor C0—capacitor C5—first winding n21 of pre-heating transformer T2. In this manner, alternating current flows through the first winding n11 of output transformer T1 and through the first winding n21 of pre-heating transformer T2 in response to the turning on and off of switching elements Q1 and Q2. Immediately after turn-off of switching elements Q1 and Q2, a current flows to release energy stored in inductor L3, output transformer T1, and pre-heating transformer T2 in a known manner. No further explanation is deemed necessary.

Figure 2:
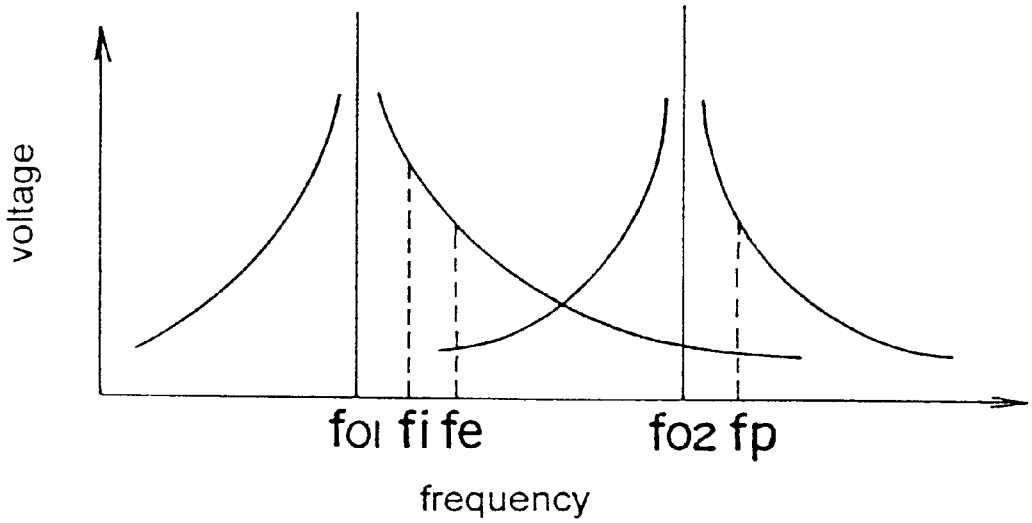
FIG. 2 is an explanatory view illustrating the relation between switching frequency and resonant frequency of a resonant circuit at lamp-preheating, lamp-starting, and stable lamp-lighting of the circuit of the first embodiment.

Since the resonant frequency of the path including first winding n11 of output transformer T1 differs from that of the path including first winding n21 of pre-heating transformer T2, it is enabled to selectively provide a main electric power to output transformer T1 or pre-heating transformer T2 by varying a frequency (switching frequency) at which switching elements Q1 and Q2 are turned on and off. As illustrated in FIG. 2, the relation $f01<f02$ is established as described hereinbefore, wherein $f01$ is a resonant frequency of the path including first winding n11 of output transformer T1 and $f02$ is a resonant frequency of the path including first winding n21 of pre-heating transformer T2. Therefore, by selecting the switching frequency to be $fp$ higher than resonant frequency $f02$, it is enabled to supply electric power mainly to pre-heating transformer T2. When the switching frequency is selected to be $fe$, which is closer to resonant frequency $f01$ than to the center between the resonant frequencies $f01$ and $f02$, output transformer T1 is mainly supplied with the power. When switching elements Q1 and Q2 are turned on and off at a frequency $fI$, which is closer to resonant frequency $f01$ than resonant frequency $fe$, a higher voltage is developed across capacitor C3 to correspondingly increase the voltage applied to first winding n11 of output transformer T1, thereby enabling to apply a starting voltage to discharge lamp La.

That is, the resonant frequency $f02$ of the series resonant circuit including the first winding n21 of the pre-heating transformer T2 and capacitor C5 is set to be higher than the resonant frequency $f01$ of the series resonant circuit including inductor L3 and capacitor C3. Output transformer T1 has a first winding n11 connected in parallel with capacitor C3 and has a second winding n12 connected to discharge lamp La. The pre-heating transformer T2 includes secondary windings n22 and n23 connected to filaments F1 and F2, respectively, of the discharge lamp La.

Thus, by changing the switching frequency of switching elements Q1 and Q2, it can be made to provide a condition in which the inverter 1 selectively provides electric power mainly to the output transformer T1 and to provide another condition in which the inverter 1 provides electric power mainly to the pre-heating transformer T2.

Figure 3:
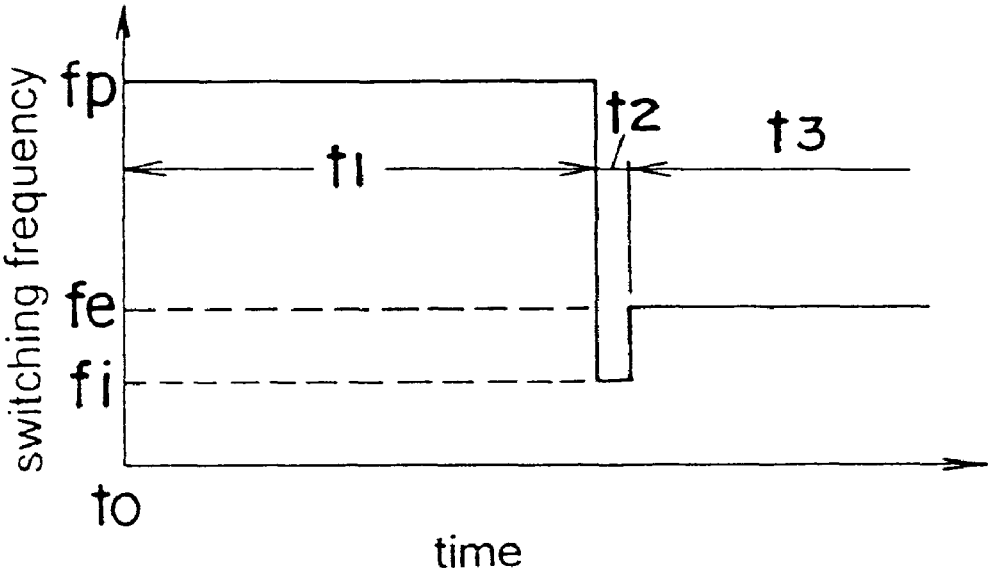
FIG. 3 is an explanatory view illustrating the switching frequency varying with time.

As shown in FIG. 3, the switching frequency is selected to be higher than the resonant frequency $f02$ during the pre-heating operation, so as to supply power to filaments F1 and F2 through pre-heating transformer T2. The switching frequency is selected to be around (approximately equal to) resonant frequency $f01$ at the luminous output so as to supply power to the discharge lamp through output transformer T1. By selecting the switching frequency to be $fp$ after an elapse of time t1 from the initial power connection at time t0, filaments F1 and F2 can be pre-heated. Thereafter, the switching frequency is lowered to $fI$ to apply the high voltage to discharge lamp La for starting lamp La. A duration t2, in which the switching frequency is maintained at $fI$, is relatively short. In the following time period t3, the switching frequency is moved to $fe$ to keep the discharge lamp La lit.

The voltage across the feedback winding n13 of output transformer T1 is applied through capacitor C2 to the input terminals of rectifier RE. Since feedback winding n13 generates a high frequency voltage of a frequency much higher than the frequency of the AC voltage source, four states appear in accordance with combinations of the polarity of the AC voltage source and the polarity of the voltage generated at feedback winding n13. That is, during each of a positive half-cycle and a negative half-cycle, feedback winding n13 induces a voltage in which the polarity is alternately reversed to provide two states, thereby providing the four states in total.

Figure 17:
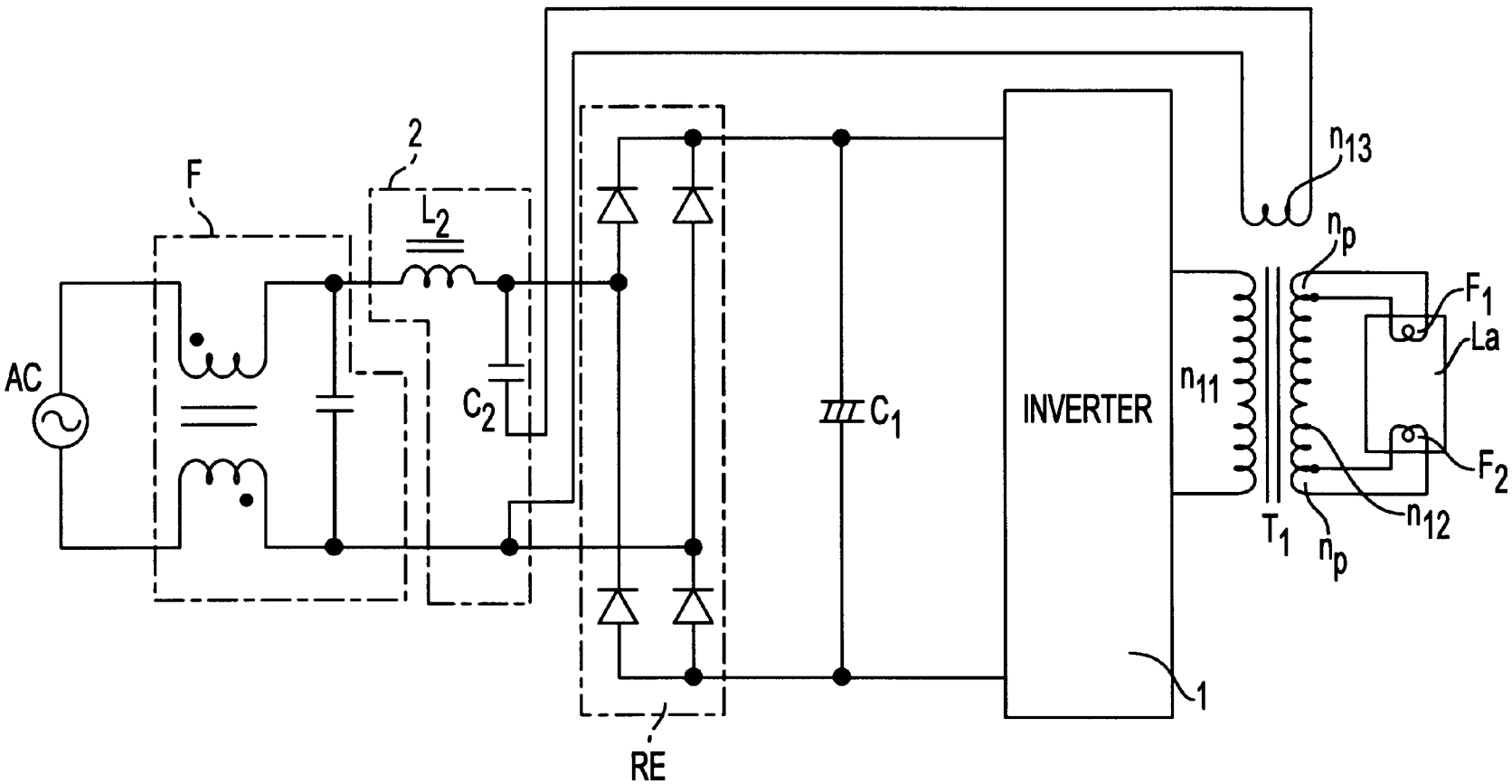
FIG. 17 PRIOR ART
FIG. 17 is a circuit diagram of a prior art power supply.
Figure 18:
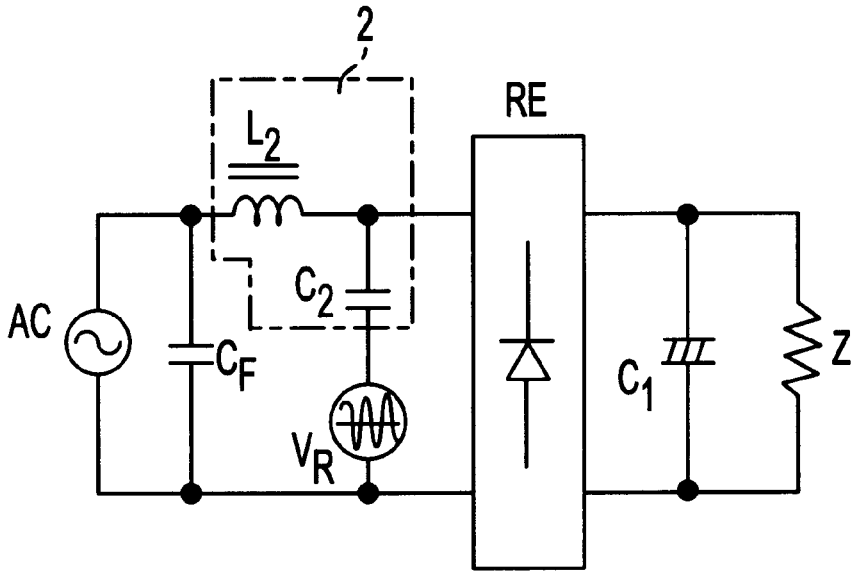
FIG. 18 illustrates an equivalent circuit of FIG. 17.
Figure 19:
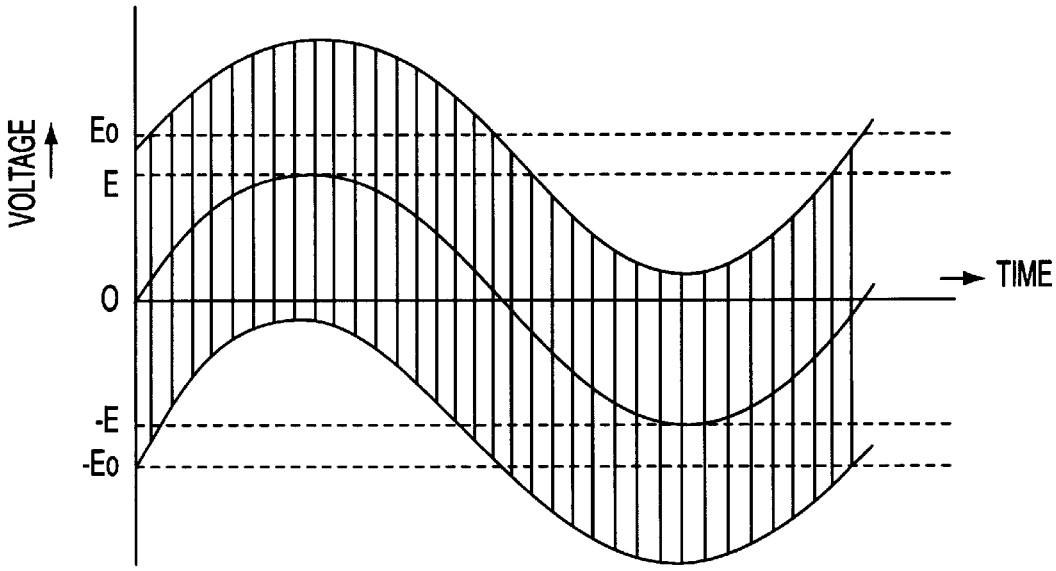
FIG. 19 PRIOR ART
FIG. 19 illustrates an operation of the prior art power supply.

Although the operations made by feedback winding n13 and resonant circuit 2 are discussed with reference to the prior art of FIG. 17, it is herein repeated that capacitor C2 repeats being charged and discharged in response to the polarity of the induced voltage of feedback winding n13, so that when capacitor C2 is being charged current will flow through inductor L2 from the AC voltage source. When capacitor C2 is being discharged, the voltages across feedback winding n13 and capacitor C2 are added to be applied to rectifier RE for charging smoothing capacitor C1. It is noted that when charging capacitor C2, inductor L2 sees a current, and when discharging capacitor C2, inductor L2 releases its energy to rectifier RE. Thus, inductor L2 is cooperative with capacitor C2 and feedback winding n13 to provide an action equivalent with that made in a step-up chopper circuit. With this action, the input current can be caused to flow at a high frequency over the entire waveform period of the voltage of the AC voltage source. That is, the input current can flow continuously through line filter F from the AC voltage source.

As discussed above, discharge lamp La goes into a stable lighting condition through steps of pre-heating, starting, and lighting. Rectifier RE and smoothing capacitor C1 are designed such that smoothing capacitor C1 keeps its voltage at a suitable level in relation to the power consumed by inverter 1 at the stable lighting condition. On the other hand, since the preheating and starting operations require less power consumption at inverter 1 than at the lighting of the discharge lamp, extra energy from rectifier RE will flow into smoothing capacitor C1, resulting in an unduly high voltage being developed across smoothing capacitor C1.

In the present embodiment, however, pre-heating transformer T2 is provided separately from output transformer T1 in order to substantially eliminate the feedback of the voltage to the input of inverter while inverter 1 consumes less power. That is, during the pre-heating period in which less load is present to require less power consumption, the feedback amount is reduced to lessen the increase of the voltage across smoothing capacitor C1 and during the lighting period in which more power consumption is required the portion of the high frequency output of the inverter is fed back to the input side thereof to improve the input power factor.

The resonant frequency is made different for the path including output transformer T1 from the path including pre-heating transformer T2. Further, the switching frequency is controlled to vary in the manner described above, such that less power is supplied to output transformer T1 at the pre-heating operation, to considerably reduce the voltage induced across feedback winding n13 at the pre-heating operation than at the lighting operation, resulting in less feedback at the pre-heating operation than at the lighting operation. Consequently, it is possible to avoid the undue increase in the voltage developed across smoothing capacitor C1. With the above configuration, however, since the feedback amount will increase at the starting of the lamp with no substantial current flowing through discharge lamp La, the starting can be made in a short time period to proceed into the lighting before the voltage across smoothing capacitor C1 increases excessively.

During the pre-heating period in which inverter 1 consumes less power, the output transformer T1 is not supplied with power, so that no feedback of the high frequency output of inverter 1 is made to prevent the voltage increase of smoothing capacitor C1.

During luminous output, in which inverter 1 consumes much power, output transformer T1 is supplied with power so that no feedback of the high frequency output of inverter 1 is made to prevent the voltage increase of smoothing capacitor C1. During luminous output, in which inverter 1 consumes much power, the output transformer T1 is supplied with the power so that the feedback of the high frequency output of inverter 1 is made. With this result, a condition in which current flows from the AC voltage source to capacitor C2, and a condition in which voltages of feedback winding n13 and capacitor C2 to rectifier RE are added, repeat at a high frequency, thus flowing the input current at high frequency to achieve high input power factor.

Figure 4:
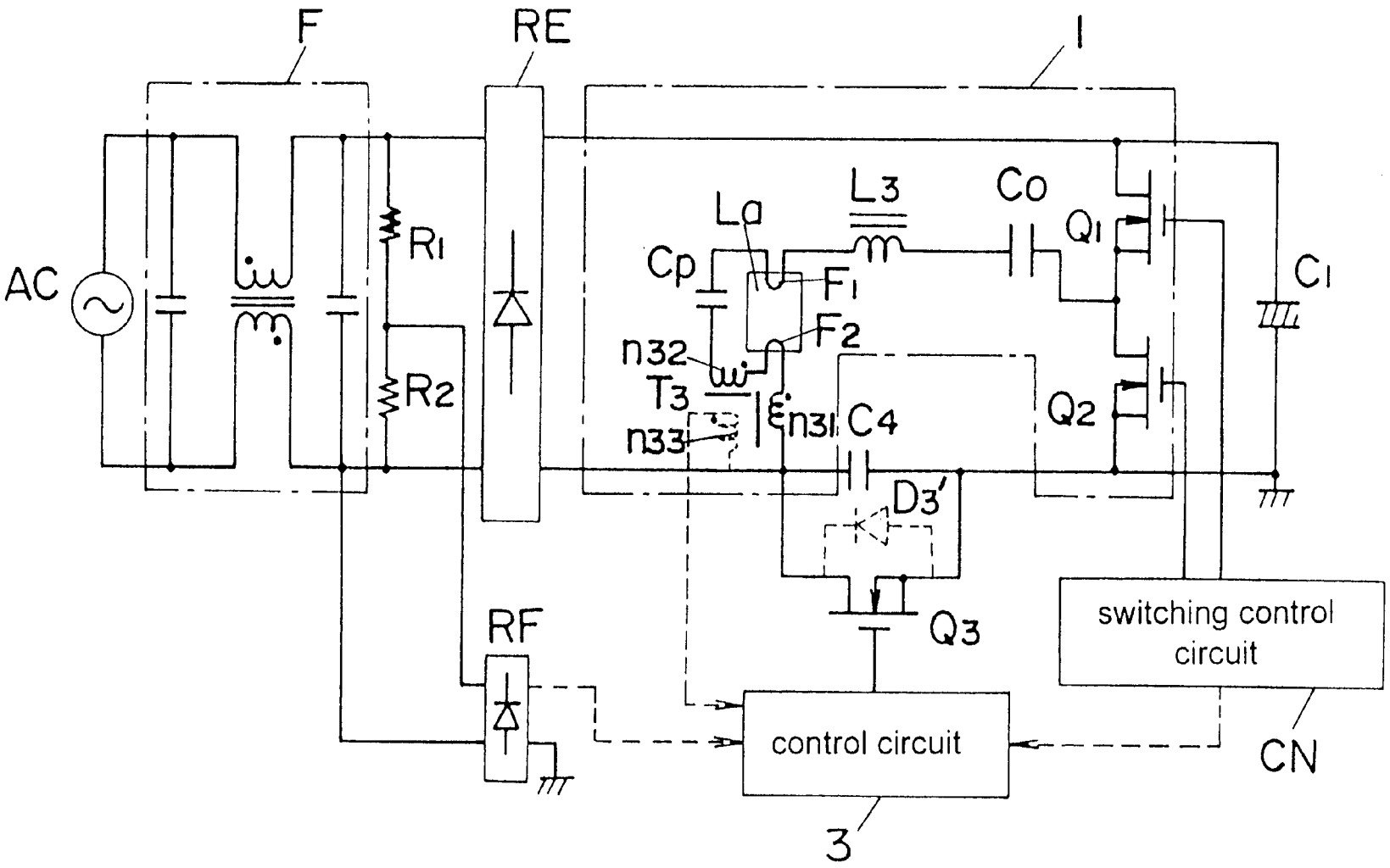
FIG. 4 is a circuit diagram of a second embodiment.
Figure 20:
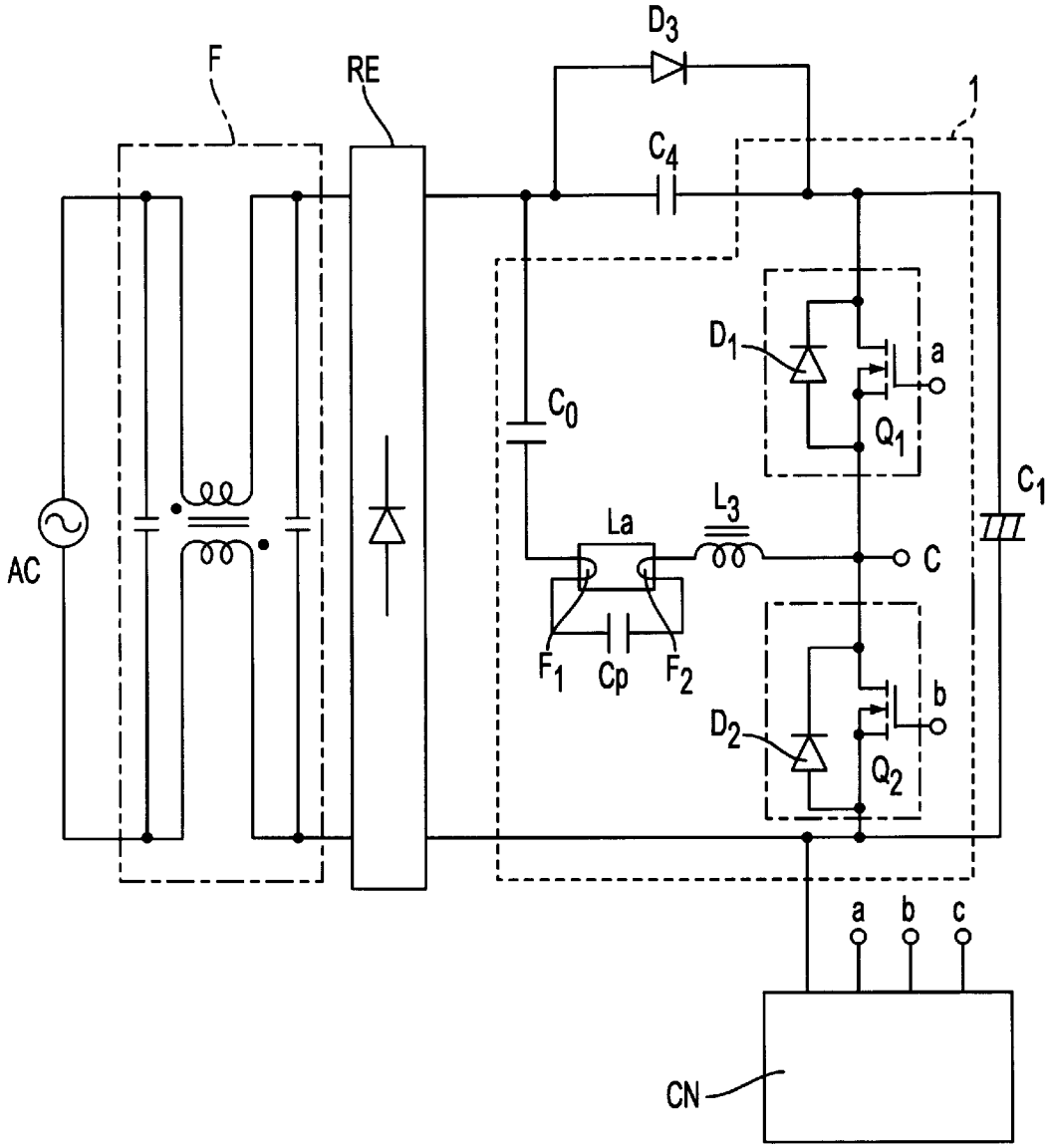
FIG. 20 PRIOR ART
FIG. 20 is a circuit diagram of another prior art power supply.

A second embodiment of the invention will now be described with reference to FIG. 4. The power supply in accordance with the second embodiment of the present invention has a basic configuration similar to the prior art configuration of FIG. 20 and comprises, as shown in FIG. 4, a high frequency blocking filter F, through which an AC voltage source provides a voltage to a rectifier RE for full-wave rectification. Connected across the output terminals of rectifier RE, through a feedback capacitor C4, is a smoothing capacitor C1 which provides power to operate an inverter 1.

Inverter 1 comprises a series connected pair of switching elements Q1 and Q2, in the form of MOSFET transistors, connected across smoothing capacitor C1. Connected between the source-drain path of switching element Q2 on the negative side of smoothing capacitor C1 is a series circuit composed of a DC blocking capacitor C0, an inductor L3, a discharge lamp La, first winding n31 of a detection transformer T3 which is a current transformer, and capacitor C4. Second winding n32 of the detection transformer T3 is connected in series with a pre-heating capacitor Cp in such a manner that the series circuit of n32 and Cp is connected between the one ends of filaments F1 and F2. Detection transformer T3 further includes a third winding n33 of which voltage is applied to a control circuit 3 as will be discussed later. A voltage obtained by dividing the input voltage by resistors R1 and R2 followed by rectifying the resulting divided voltage with rectifier RE is also applied to control circuit 3.

Connected across feedback capacitor C4 is a switching element Q3 in the form of a MOSFET transistor which has a drain connected to the negative side of rectifier RE and has a source connected to the negative side of smoothing capacitor C1. With this connection, a parasitic diode D3' associated with switching element Q3 is inserted in a manner as in diode D3 of the prior configuration of FIG. 20 to allow a charging current to flow from rectifier RE to smoothing capacitor C1. Switching element Q3 turns on and off under the control of control circuit 3. During the turn-on period of switching element Q3, capacitor C4 is bypassed or shorted.

The operation of the above configuration will be now explained. When switching element Q3 is off, the basic operation is identical to those of the prior art configuration shown in FIG. 21. That is, during a period in which the output voltage of rectifier RE is higher than the voltage across smoothing capacitor C1 (neglecting the voltage drop due to parasitic diode D3'), parasitic diode D3' is conductive to charge smoothing capacitor C1 by the output of rectifier RE. In this condition, when switching element Q1 is turned on, current will flow from rectifier RE through a path of switching element Q1—capacitor C0—inductor L3—load circuit—first winding n31 of detection transformer T3. When switching element Q2 is on, current will flow from capacitor C0 through a path of switching element Q2—parasitic diode D3'—first winding n31 of detection transformer T3—load circuit—inductor L3.

On the other hand, during a period in which output voltage of rectifier RE is less than the voltage across smoothing capacitor C1, parasitic diode D3' is off so that, when switching element Q1 is on, current will flow from smoothing capacitor C1 through a path of switching element Q1—capacitor C0—inductor L3—load circuit—first winding n31 of detection transformer T3—capacitor C4, and when switching element Q2 is on, current will flow through a path of capacitor C0—switching element Q2—capacitor C4—first winding n31 of detection transformer T3—load circuit—inductor L3. That is, a high frequency voltage of capacitor C4 is applied to smoothing capacity C1 to feed back the high frequency output of inverter 1 to the input side thereof.

Irrespective of the relation between the output voltage of rectifier RE and the voltage across smoothing capacitor C1, inductor L3 releases its stored energy immediately after switching elements Q1 and Q2 are turned off, which is similar to the prior configuration and no additional explanation is made herein.

As explained above, while switching element Q3 is turned off, capacitor C4 repeats charging and discharging when the output voltage from rectifier RE is low to thereby feed back the high frequency output of inverter 1 to the input side of inverter 1. That is, since the voltage across capacitor C4 is fed back to the input side of inverter 1, capacitor C4 functions as a feedback power source. While switching element Q3 is turned on, capacitor C4 is shorted, such that the high frequency output of inverter 1 cannot be fed back to the input side of inverter 1 to make the output of rectifier RE coupled directly to smoothing capacitor C1, whereby smoothing capacitor C1 will not increase its voltage excessively even when the load of inverter 1 becomes less. That is, switching element Q3 might be turned on under the light load condition. However, it is not possible to improve the input power factor if switching element Q3 would be constantly turned on.

In the present embodiment, however, control circuit 3 is configured to turn on switching element Q3 over a longer period as the load becomes less at the pre-heating and dimming of the discharge lamp and to turn off switching element Q3 when the load is increased in the full lighting of the discharge lamp. In addition, switching element Q3 is turned on and off in synchronism with the frequency of the AC voltage source. The amount of the load is detected in terms of a voltage level Vi which is obtained in control circuit 3 by rectifying and smoothing the voltage induced at third winding n33 of detection transformer T3. Since voltage level Vi corresponds to a lamp current of discharge lamp La, it is possible to discriminate the pre-heating, starting, lighting, and dim lighting based upon the voltage level Vi which becomes high as the load increase. The voltage level Vi is compared with a voltage Vg obtained by dividing and rectifying the input voltage to rectifier RE to give a signal synchronized with the frequency of the AC voltage source.

Figure 5A:
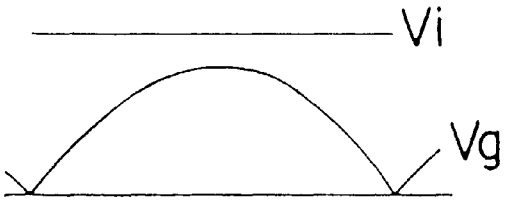
FIGS. 5(*a*)–5(*c*) is an explanatory view illustrating a control scheme of varying a feedback amount in the circuit of the second embodiment.
Figure 5B:
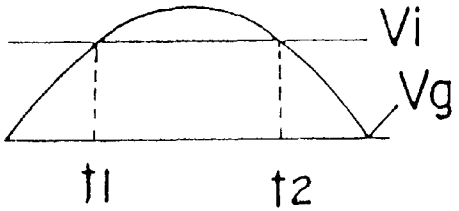
Figure 5C:
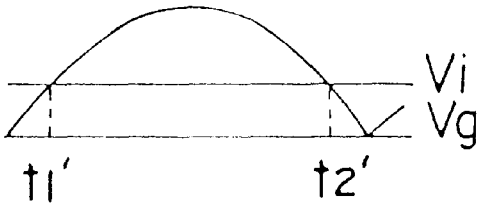

When the load of inverter 1 is high, as seen in the fill lighting of the lamp, a setting is made to give a relation that voltage level Vi is greater than the peak of voltage Vg, as shown in FIG. 5(*a*), at which condition switching element Q3 is kept always turned off to give the above-mentioned operation. When the lighting is dimmed, the lamp current decreases as compared to the full lighting, so that the voltage level Vi becomes lower than the peak of the voltage Vg, as shown in FIG. 5(*b*). It is within the period t1 to t2 in which voltage Vg exceeds voltage level Vi that switching element Q3 is turned on. With this operation, the feedback from capacitor C4 is disabled around the peak voltage of the input voltage from the AC voltage source and the feedback from capacitor C4 is enabled to continuously flow the input current around the zero-cross of the input voltage from the AC voltage source, thereby improving the input power factor. When the dimming for further lowering the light output or the pre-heating is made, the voltage Vi will decrease further, as shown in FIG. 5(*c*), to extend the on-period t1' to t2', thereby restricting the increase of smoothing capacitor C1. Even in this condition, the feedback from capacitor C4 can be made around the zero-cross of the input voltage, assuring to improve the input power factor.

In this instance, voltage Vg fed to the control circuit 3 increases with the voltage increase in the AC voltage source, so that on-period t1 to t2 of switching element Q3 is further elongated to lower the voltage across smoothing capacitor C1. On the other hand, as voltage Vg decreases, the on-period of switching element Q3 is shortened in the direction of increasing the voltage across smoothing capacitor C1. Thus, the voltage across smoothing capacitor C1 can be made stable against possible voltage fluctuation of the AC voltage source.

Although switching element Q3 is disclosed to be controlled in synchronism with the AC voltage source, it may be controlled in synchronism with the turn on and off of switching elements Q1 and Q2, as indicated by dotted lines in FIG. 4. The dimming of discharge lamp La is made by controlling the switching frequency of switching elements Q1 and Q2. Therefore, it is readily made to derive a drive signal for turning on and off switching element Q3 in synchronism with switching elements Q1 and Q2 by using a signal for turning on and off switching elements Q1 and Q2 and dividing this signal in proportion to the level of the load applied.

Control circuit 3 detects lamp current based upon a voltage induced at a third winding n33 of detection transformer T3. The control circuit 3 increases the frequency (by reducing the dividing ratio) at which switching element Q3 is turned on and off, as the detected voltage level falls. Control circuit 3 keeps switching element Q3 turned off when the detected lamp current is large and extends an ON period of switching element Q3 as the lamp current decreases. During the ON period of switching element Q3, no high frequency voltage develops across capacitor C4, so that no voltage feedback of the high frequency output of inverter 1 is made to avoid a voltage increase of smoothing capacitor C1, even when the load increases. When the voltage level induced in the third winding n33 exceeds a threshold, control circuit 3 determines that the lamp is fully lit and keeps switching element turned off. Accordingly, it assures restrained voltage increases across smoothing capacitor C1 during preheating and dimming, by elongating the ON period of switching element Q3.

As shown in FIG. 5, voltage level Vi included at third winding n33 of detection transformer T3 is compared with voltage Vg (input voltage of rectifier RE divided by resistors R1 and R2) of the AC voltage source so that the circuit is controlled to turn on switching element Q3 in a period where $Vg \geqq Vi$ for turning on and off switching element Q3 in synchronism with the frequency of the AC voltage source. In this instance, as voltage Vg of AC voltage source Vs increases, ON-period t1 to t2 of switching element Q3 is further elongated to lower the voltage across smoothing capacitor C1. On the other hand, as voltage $V_g$ decreased, the ON-period of switching element Q3 is reduced. Thus, the voltage across smoothing capacitor C1 can be made stable against possible voltage fluctuation of the AC voltage source.

Figure 6A:
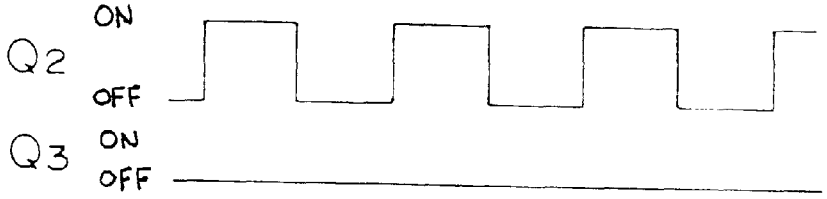
FIGS. 6(*a*)–6(*c*) is an explanatory view illustrating another control scheme of varying a feedback amount in the circuit of the second embodiment.
Figure 6B:
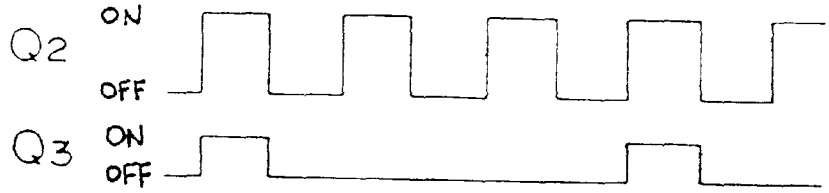
Figure 6C:
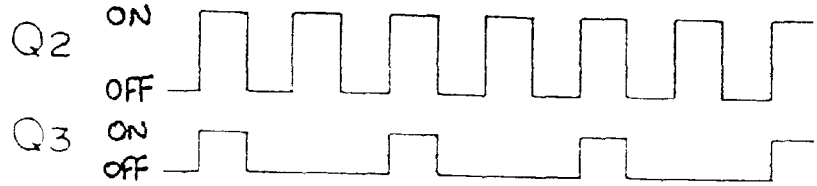
Figure 7C:
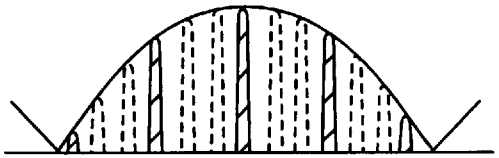
FIGS. 7(*a*)–7(*c*) is an explanatory view illustrating an example when operating the circuit of the second embodiment with the control scheme of FIG. 6.
Figure 7B:
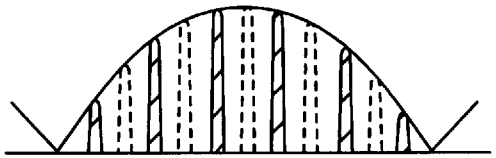
Figure 7A:
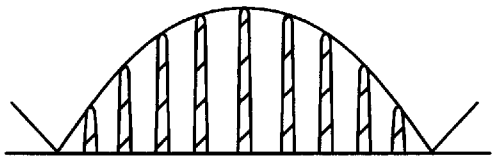

FIGS. 6(*a*) to 6(*c*) illustrate a relation between the turn on and off of switching elements Q2 and Q3, in which the load decreases in the order of FIGS. 6(*a*) to 6(*c*). That is, the switching frequency of switching element Q2 becomes higher as the load decreases and the on-period per unit time of switching element Q3 is elongated as the load decreases, thereby reducing the feedback amount. With the control of FIGS. 6(*a*) to 6(*c*), the feedback amount is varied as shown in hatched lines in FIGS. 7(*a*) to 7(*c*).

It is not essential to correspond the on-period of switching element Q3 to the on-period of switching element Q2 when controlling switching element Q3 in synchronism with switching elements Q1 and Q2 as described in the above. Any control may be made to turn on switching element Q3 over a period overlapping the on-period of diode D3' for stable operation.

Another control may be made to provide the pulsating output voltage from full-wave rectifier RE to control circuit 3 and to vary, in proportion to the pulsating output voltage, a dividing ratio at which the signal for switching elements Q1 and Q2 is divided to obtain the drive signal for switching element Q3. With this control, it is possible to make the input current waveform approximate a sinusoidal waveform even under reduced a load condition for reducing the input current distortion.

In order to achieve the like effect, a further control may be made to turn on and off switching element Q3 in synchronism with switching elements Q1 and Q2, as well as to elongate the on-period of switching element Q3 as the load is reduced, rather than providing the drive signal for switching element Q3 by dividing the signal for switching elements Q1 and Q2.

Figure 8:
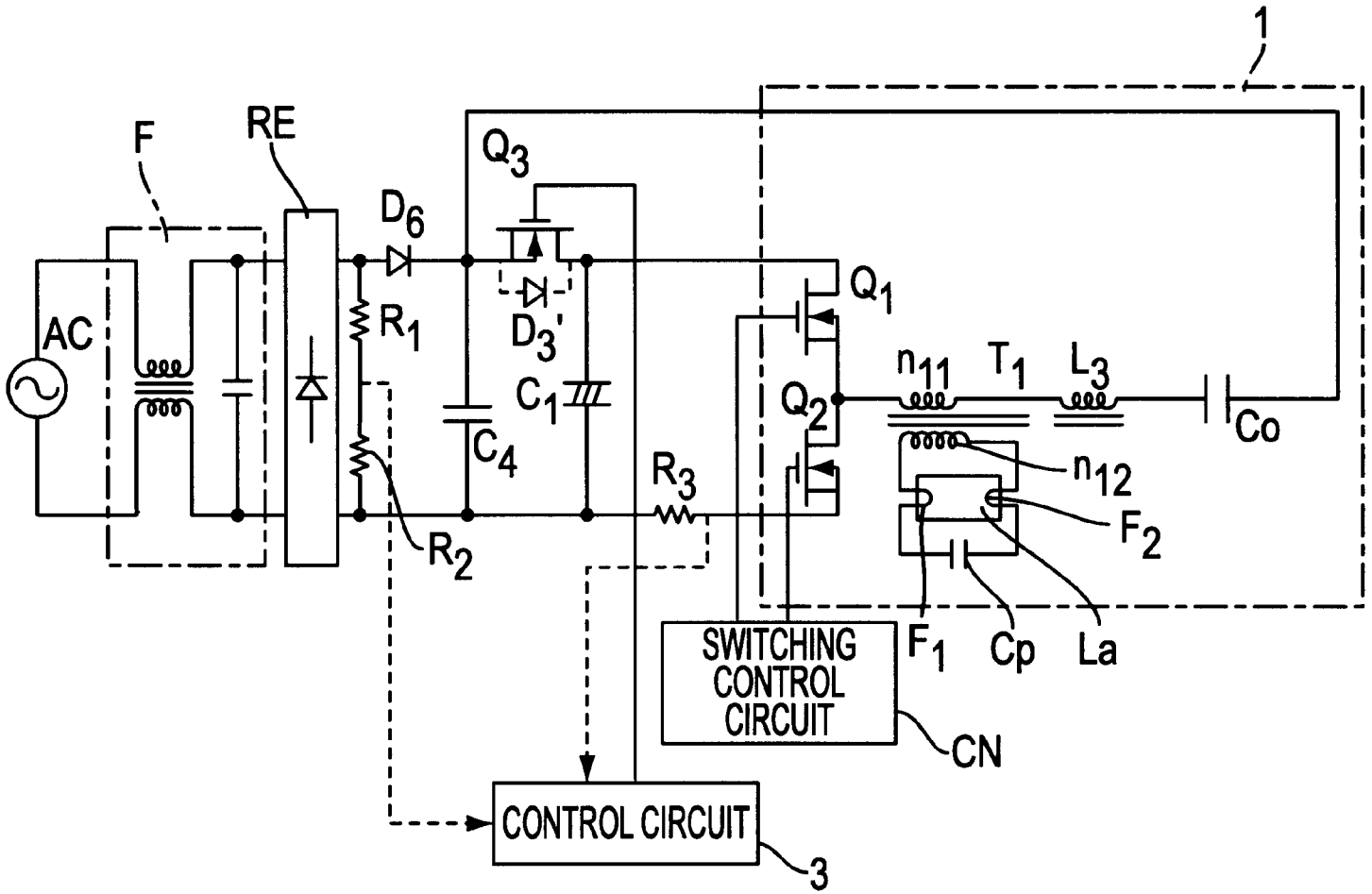
FIG. 8 is a circuit diagram of a third embodiment.

A third embodiment of the invention will now be described with respect to FIG. 8. This embodiment basically applies the technical concept of the present invention to the power supply configuration shown in Japanese Patent Early Publication No. HEI 7-73988, and includes a switching element Q3 in the form of a MOSFET transistor that replaces a diode utilized in the circuit of the above publication. As shown in FIG. 8, a smoothing capacitor C1 is connected across the output terminals of rectifier RE through a series circuit of diode D6 and the MOSFET, i.e., switching element, Q3. Diode D6 and a parasitic diode D3' are inserted to allow a charging current to flow into smoothing capacitor C1. Also, diode D6 is connected in series with a feedback capacitor C4 across output terminals of rectifier RE.

Inverter 1 comprises a series-connected pair of switching elements Q1 and Q2 (such as, but not limited to MOSFET transistors), which are connected in series with a detection resistor R3 across smoothing capacitor C1, and an output transformer T1 having a first winding n11 which is connected in series with an inductor L3 and a DC blocking capacitor C0 between a connection point of switching elements Q1 and Q2 and a connection point of diode D6 and switching element Q3.

Switching elements Q1 and Q2 are controlled to alternately turn on and off. Output transformer T1 has a second winding n12 connected to one end of filaments F1 and F2 of a discharge lamp La. A pre-heating capacitor Cp is connected across the other ends of filaments F1 and F2.

Switching element Q3 is controlled to turn on and off by a control circuit 3 in the same manner as in the second embodiment. Control circuit 3 determines an on-period of switching element Q3 based upon the output voltage of rectifier RE divided resistors R1 and R2 and the voltage developed across detection resistor R3.

During a period in which the output voltage of rectifier RE is less than the voltage across smoothing capacitor C1, the switching element Q2 is conductive. Thus, switching element Q2 turns on, causing current to flow through a path of diode D6—capacitor C0—inductor L3—first winding nil of output transformer T1, switching element Q2—detection resistor R3. When switching element Q1 becomes conductive, it turns on. Thus, current flows from smoothing capacitor C1 through a path of switching element Q1—first winding n11 of output transformer—inductor L3—capacitor C0—capacitor C4. Thus, it is made to apply a high frequency voltage to capacitor C4 for achieving voltage feedback, while causing the input current to flow at a high frequency to improve input power factor.

During one switching cycle of switching elements Q1 and Q2 of inverter 1, there exists a period in which a current flows from the AC voltage source into rectifier RE, so that an input current can be continuously supplied as a high frequency current to rectifier RE for improving the input current distortion as well as the input power factor.

Further, during the period in which an output voltage of rectifier RE (e.g., the voltage across capacitor C4) is less than the voltage across smoothing capacitor C1, parasitic diode D3' is made non-conductive, so that, if switching element Q3 is off, the voltage of capacitor C4 is added to the voltages of inductor L3 and the output transformer T1 and is applied through a parasitic diode associated with the switching element Q1 to smoothing capacitor C1, in response to the turn off of the switching element Q2, thereby increasing the voltage across smoothing capacitor C1. However, when switching element Q3 is turned on, the voltage of smoothing capacitor C1 becomes nearly equal to the voltage of capacitor C4, to thereby avoid the voltage increase.

Control circuit 3 detects a load current flowing through a load circuit (e.g., lamp current, discharge lamp La) in terms of a voltage detected across detection resistor R3, so as to keep switching element Q3 turned off when the detected lamp current is large (e.g., large load), and to extend an ON period of switching element Q3 as the lamp current (load) decreases. During ON periods of switching element Q3, no high frequency voltage develops across capacitor C4, so that no voltage feedback of the high frequency output of inverter 1 is made, to avoid a voltage increase of smoothing capacitor C1 even when the load decreases. Accordingly, it assures restrained voltage increases across smoothing capacitor C1 during preheating and dimming, by elongating the ON period of switching element Q3.

It is noted that the switching element Q3 may be driven by a signal obtained in the same manner as in the second embodiment. It is also noted that although the second embodiment is arranged to detect the level of the load based upon the voltage induced across the third winding n33 of detection transformer T3, the present embodiment is arranged to detect the level of the load based upon the voltage across the detection resistor R3. The other operations of the present embodiment are identical to those of the second embodiment.

A fourth embodiment of the invention will now be described with reference to FIG. 9. This embodiment adds a high frequency feedback transformer T4 to a prior art configuration of FIG. 21 and has an inverter 1 of which operation is basically identical to that in the prior art.

Figure 9:
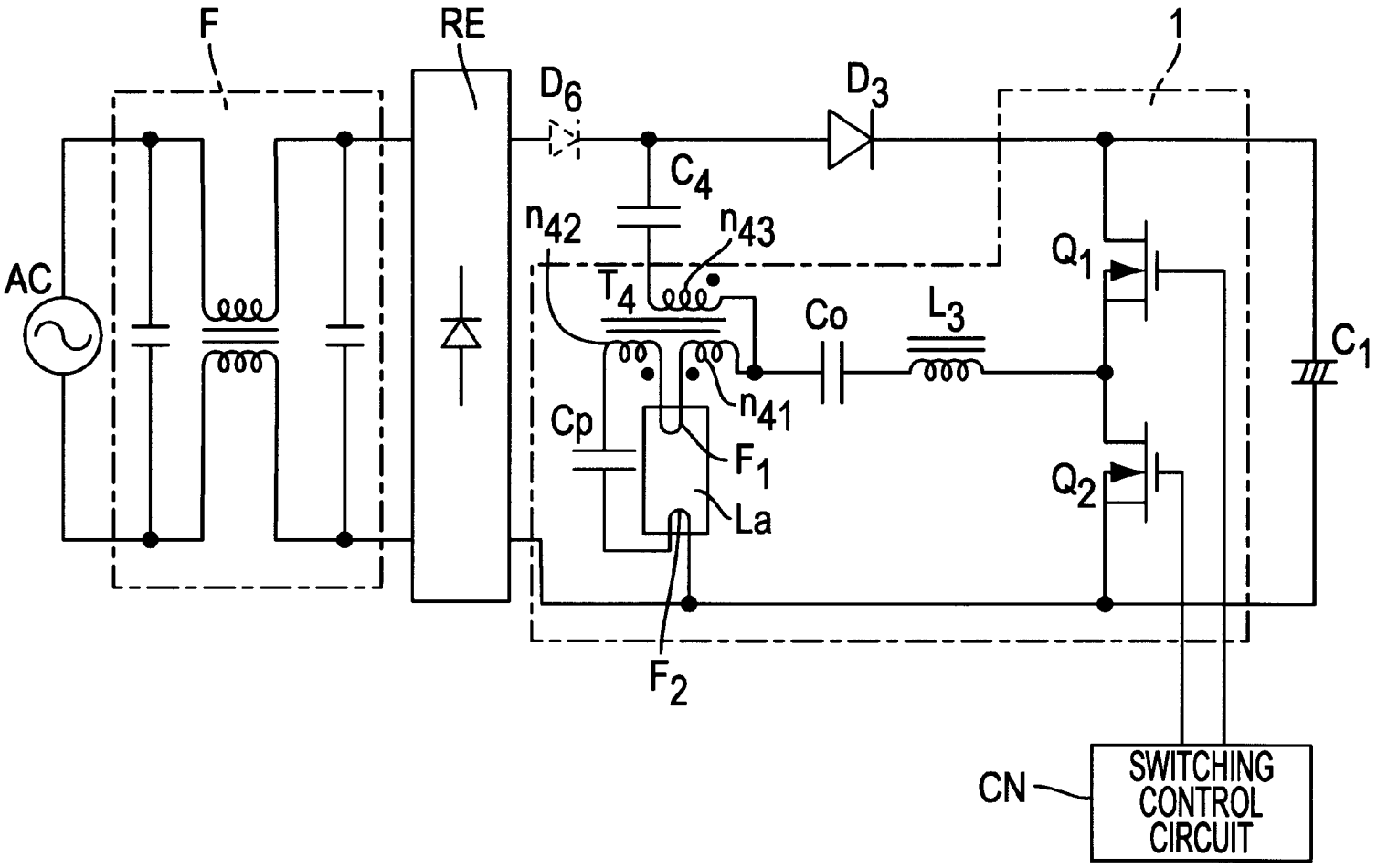
FIG. 9 is a circuit diagram of a fourth embodiment.

Referring to FIG. 9, a smoothing capacitor C1 is connected across output terminals of a rectifier RE through a diode D3. An inverter 1 comprises a series-connected pair of switching elements (such as, but not limited to MOSFET transistors) Q1 and Q2, which are controlled to alternately turn on or off. Connected across switching element Q2 is a series circuit formed by an inductor L3, a DC blocking capacitor C0, a first winding n41 of a high frequency feedback transformer T4, and a discharge lamp La.

Feedback transformer T4 has a second winding n42 which is connected in series with a pre-heating capacitor Cp between filaments F1 and F2 of discharge lamp La. First winding n41 is connected in series with second winding n42 through filament F1 with their polarity opposed to each other.

Further, the high frequency feedback transformer T4 has a third winding n43 which has its one end connected through a capacitor C4 to a positive terminal of rectifier RE and has the other end connected to a point between first winding n41 and capacitor C0.

Figure 21:
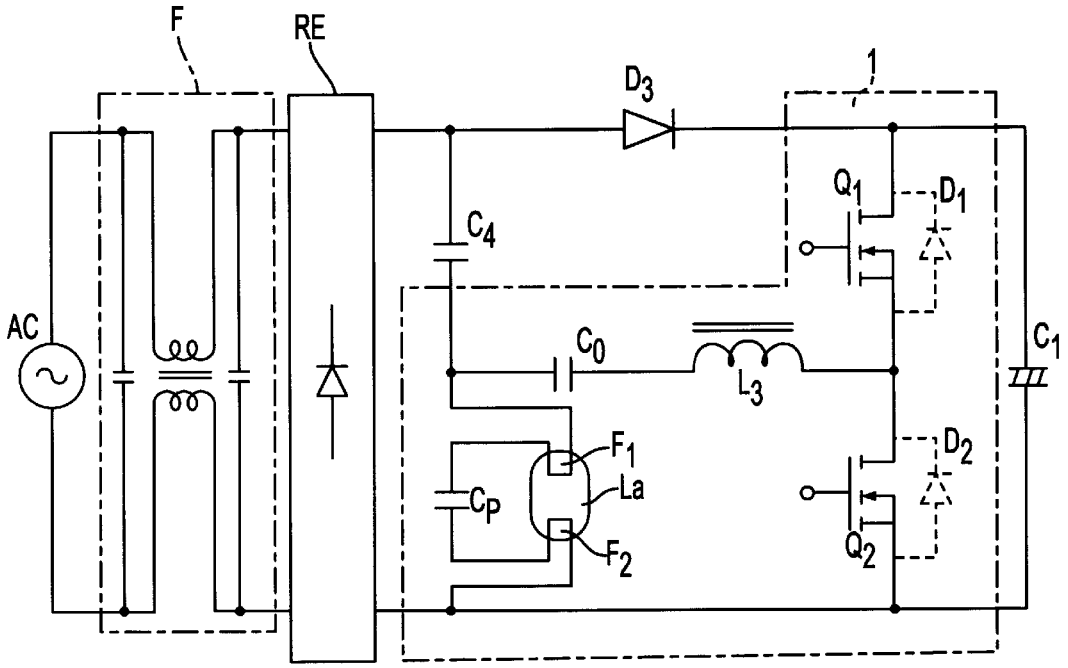
FIG. 21 PRIOR ART
FIG. 21 is a circuit diagram of a further prior art power supply.
Figure 22:
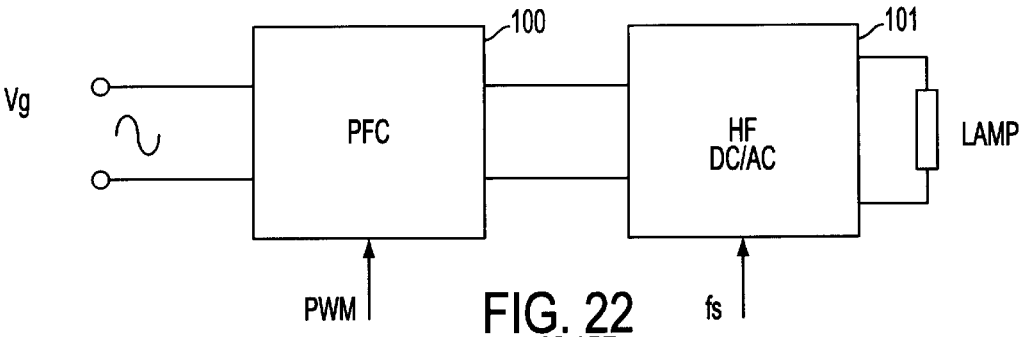
FIG. 22 PRIOR ART
FIG. 22 shows a conventional two-state configuration of electronic ballast.
Figure 23:
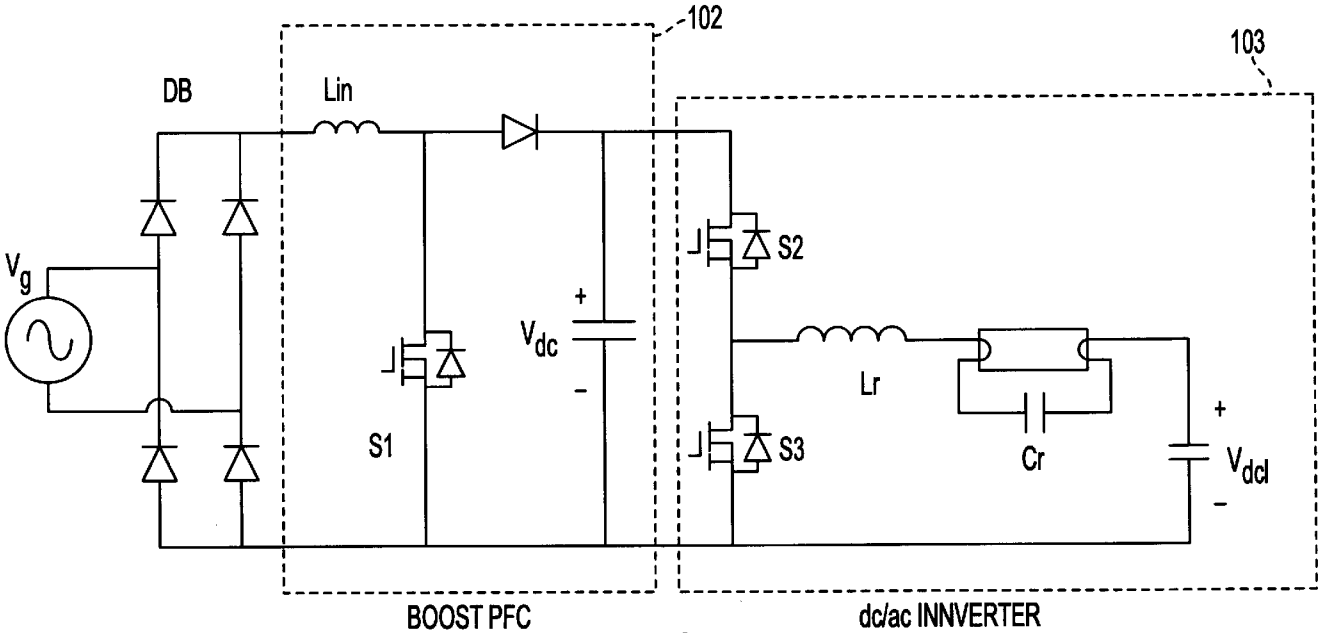
FIG. 23 shows an example of two-stage electronic ballast.
Figure 24A:
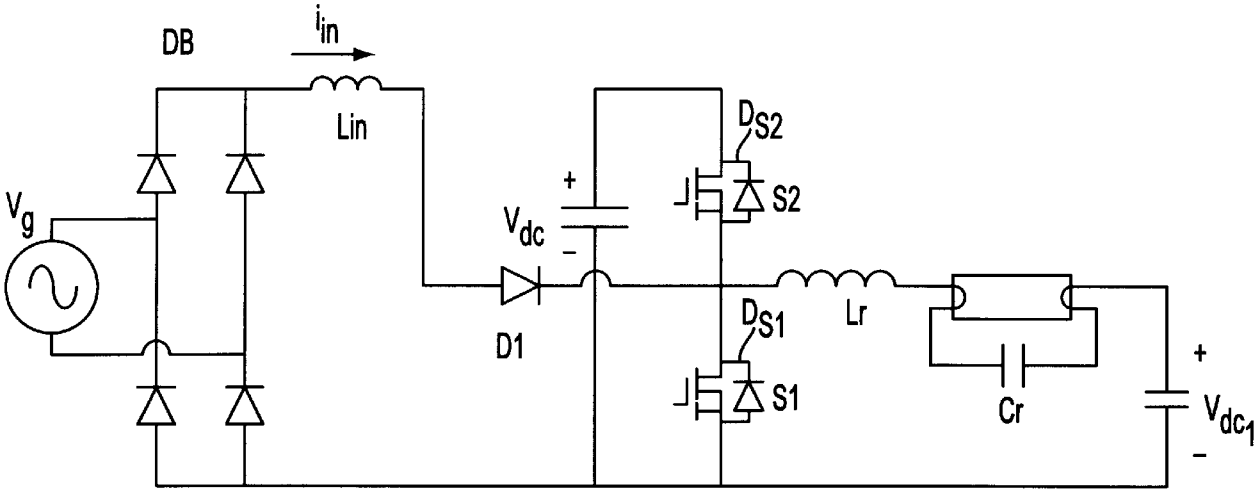
FIGS. 24A and 24B show a boost integrated electronic ballast.
Figure 24B:
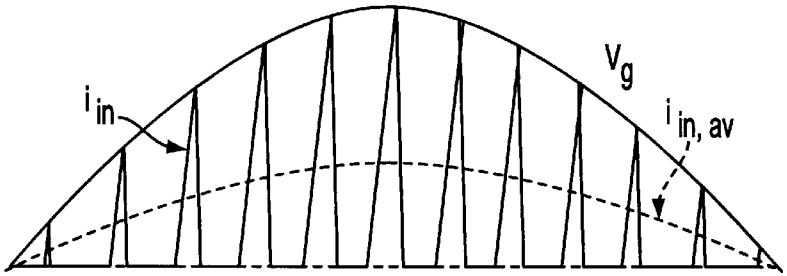
Figure 25A:
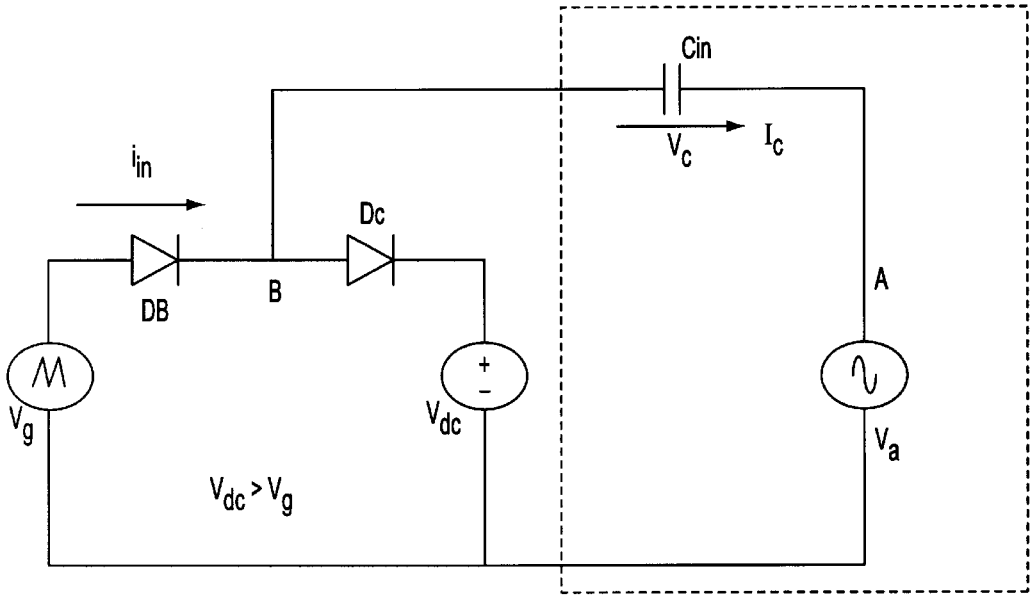
FIGS. 25A and 25B show a "charge pump" circuit employing HFVS.
Figure 25B:
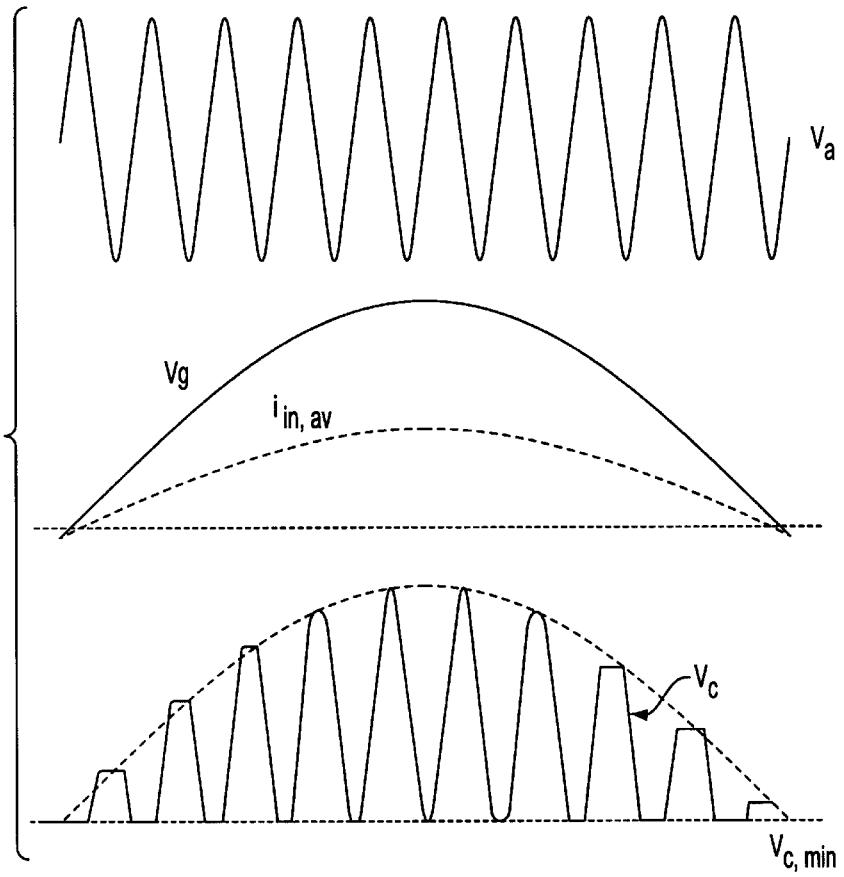
Figure 26:
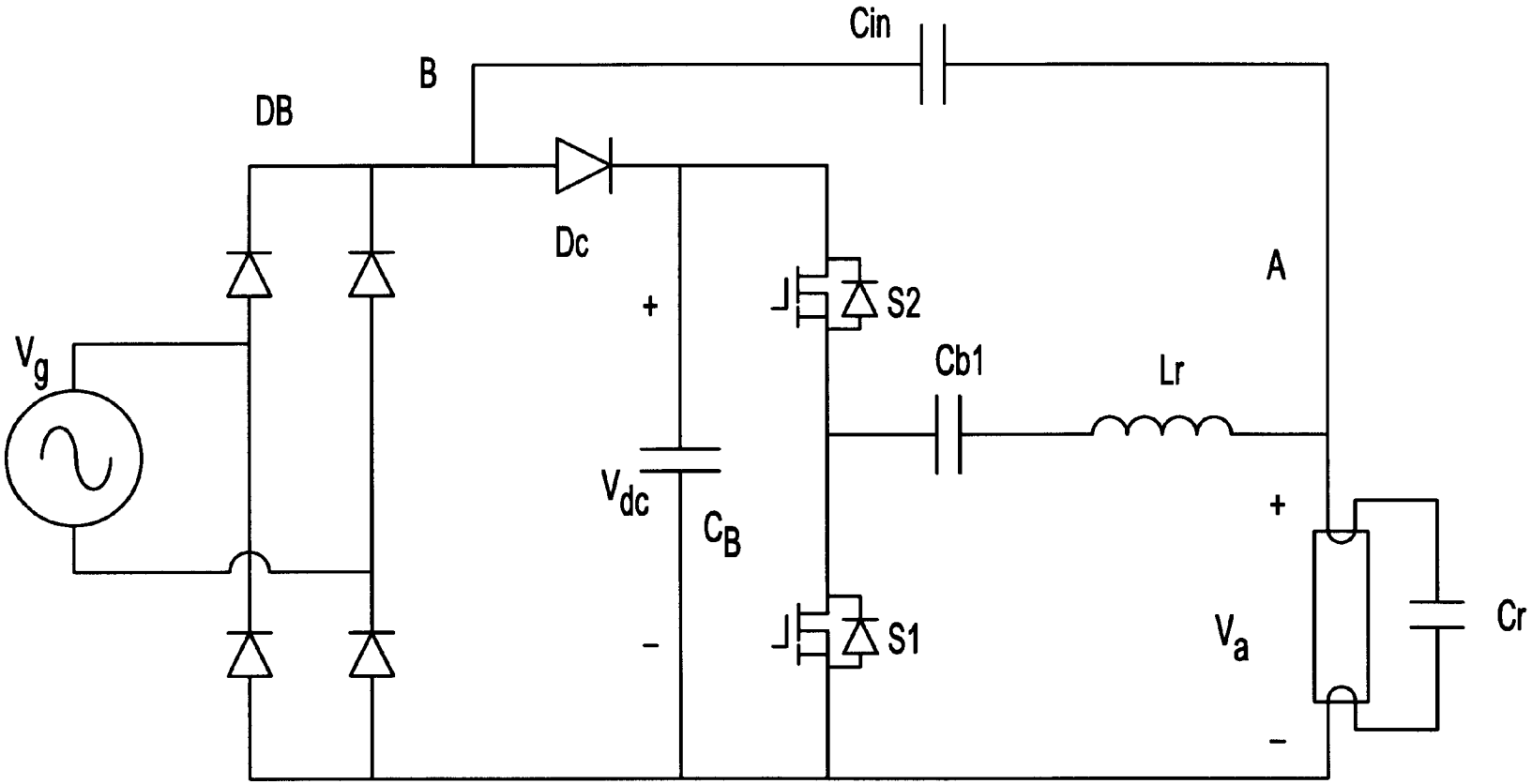
FIG. 26 shows an example of "charge pump" ballast employing HFVS.

The operation of this embodiment is similar (but not identical) to the operation of the prior art configuration shown in FIG. 21. During a period in which the output voltage of rectifier RE is less than the voltage across smoothing capacitor C1, diode D3 is kept turned off, so that, when switching element Q1 is turned on, a current flows from smoothing capacitor C1 through a path of switching element Q1—inductor L3—capacitor C0—first winding n41 of high frequency feedback transformer T4—discharge lamp La. When switching element Q2 is turned on, capacitor C0 acts as a source to flow a current therefrom through a path of inductor L3—switching element Q2—discharge lamp La—high frequency feedback transformer T4. Also, during the on-period of switching element Q2, current flows from rectifier RE through a path of capacitor C4—third winding n43 of high frequency feedback transformer T4—capacitor C0—inductor L3—switching element Q2, thereby enabling the input current to continuously flow as a high frequency current from the AC voltage source into rectifier RE. Therefore, the input current distortion as well as the input power factor are improved.

When switching element Q1 is turned off, the voltage of inductor L3 is added to the voltages of capacitor C0, third winding n43 of high frequency feedback transformer T4, and capacitor C4, such that the resulting added voltage is applied to smoothing capacitor C1 through a path of diode D3 and a parasitic diode associated with the switching element Q2. Since first winding n41 and second winding n42 of feedback transformer T4 are connected in series, with their polarity opposed to each other, third winding n43 induces a voltage which is proportional to the difference between the voltages of the first winding n41 and second winding n42. Therefore, less voltage develops at third winding n43 during pre-heating. When the discharge lamp La is dimmed, less current flows through the first winding n41, so that the induced voltage of the third winding n43 is less than that induced at the rated luminous output. As a result, the feedback amount is reduced at the light load condition to limit the voltage increase across the smoothing capacitor C1.

Figure 10:
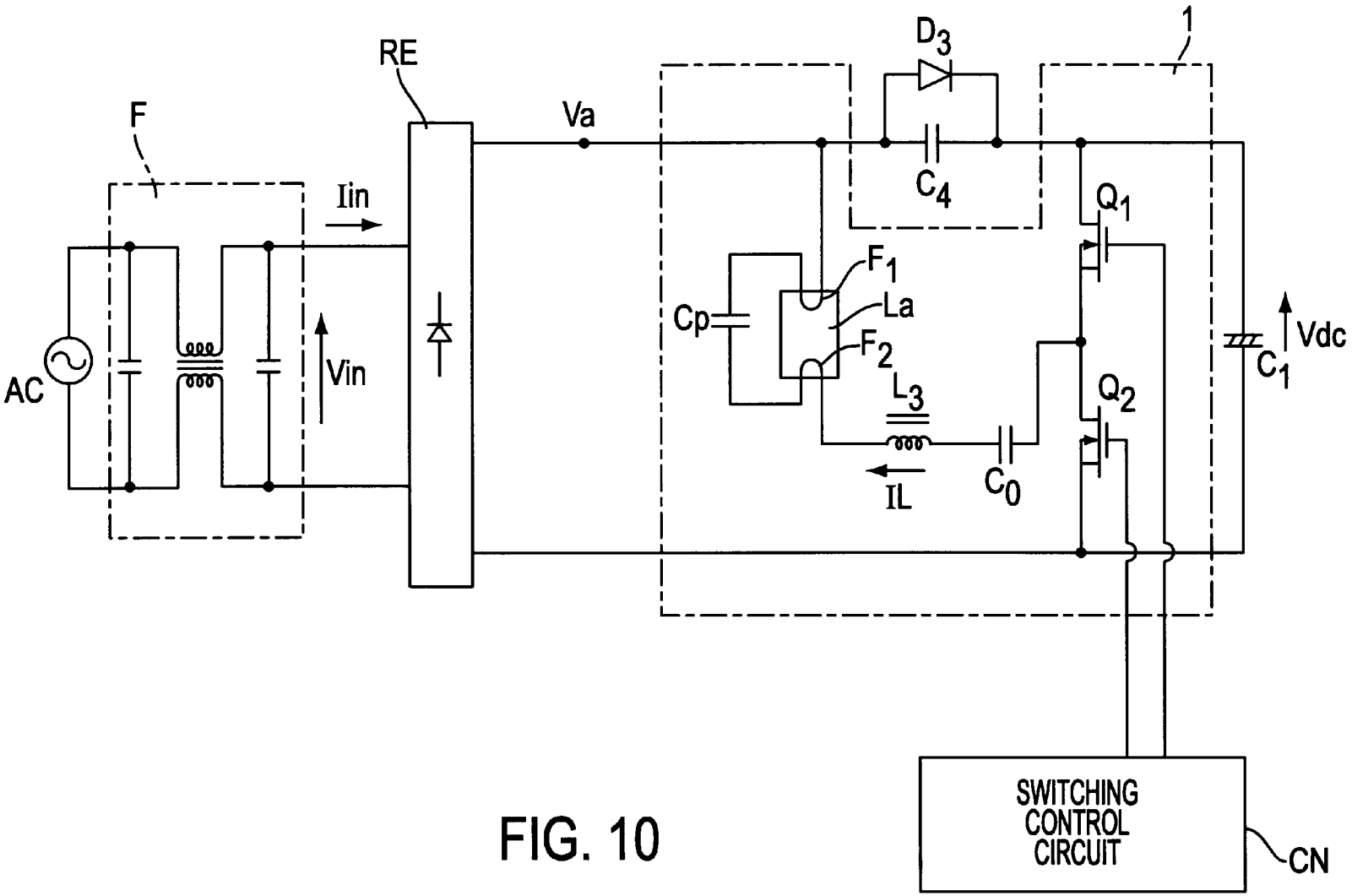
FIG. 10 is a circuit diagram of a fifth embodiment.

A fifth embodiment of the invention will now be described with reference to FIG. 10 of the drawings. This embodiment represents a modification of the prior art configuration of FIG. 20.

In the fifth embodiment, a smoothing capacitor C1 is connected across the output terminals of a rectifier RE through a diode D3. A feedback capacitor C4 is connected across diode D3. An inverter 1 comprises a series-connected pair of switching elements (e.g., MOSFET transistors) Q1 and Q2 which are controlled by a switching control circuit CN to alternately turn on and off. Switching control circuit CN controls the duty of the on-period of switching elements Q1 and Q2 to vary electric power supplied to a discharge lamp La. A series circuit, comprising a discharge lamp La, an inductor L3, and a DC blocking capacitor C0, is connected between the positive terminal of rectifier RE and a connection point of switching elements Q1 and Q2. Inductor L3 is connected between the discharge lamp La and the capacitor C0, with one end being connected to a point between the switching elements Q1 and Q2. A pre-heating capacitor Cp is connected between filaments F1 and F2 of discharge lamp La.

The operation of this embodiment will now be explained. When the output voltage of rectifier RE is less than the voltage across smoothing capacitor C1, diode D3 is non-conductive and feedback capacitor C4 receives a voltage representing the difference between the voltage of smoothing capacitor C1 and the voltage from rectifier RE. When switching element Q2 is on, current flows from rectifier RE through a path of discharge lamp La—inductor L3—capacitor C0—switching element Q2. When switching element Q1 is on, capacitor C0 acts as a current source. As a result, current flows from capacitor C0 through a path of inductor L3—discharge lamp La—capacitor C4—switching element Q1. In this manner, capacitor C4 is repeatedly charged and discharged in response to the turning on and off of switching elements Q1 and Q2, thereby making a feedback of the high frequency output from inverter 1 to the input side thereof. Thus, the input current to rectifier RE can be interrupted at a high frequency to improve the input power factor. When the output voltage of rectifier RE is greater than the voltage across the smoothing capacitor C1, diode D3 becomes conductive, so that no current path through capacitor C4 is made to enable the charging of the smoothing capacitor C1.

Figures 11A, 11B, 11C, 11D, 11E:
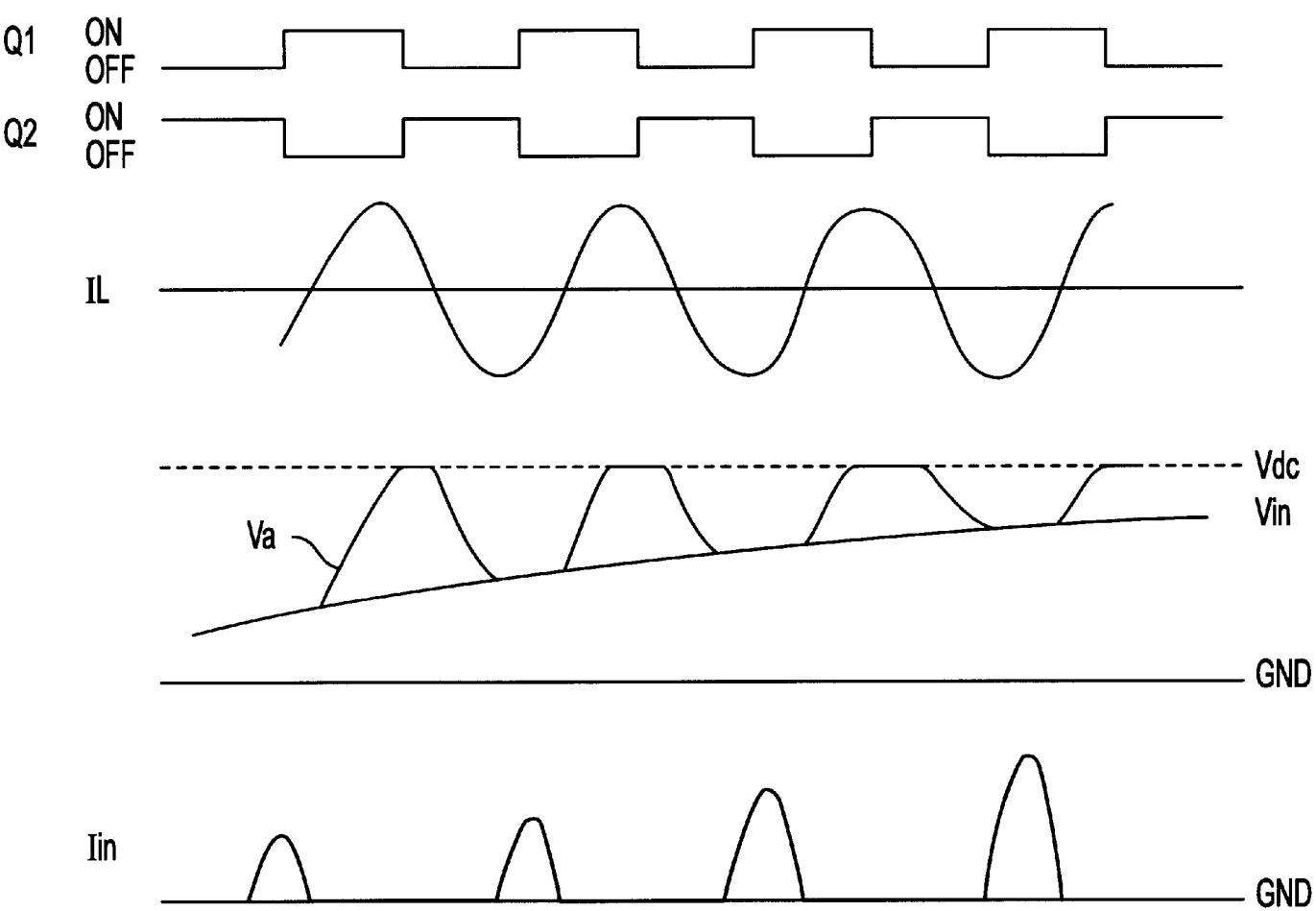
FIGS. 11(*a*) to 11(*e*) are explanatory views illustrating waveforms at various points in the circuit of FIG. 10.

For a rated luminous output, the ON-duty of switching elements Q1 and Q2 is set to be about 50%, as shown in FIGS. 11A and 11B. In this condition, inductor L3 sees a current IL, as shown in FIG. 11C. Since voltage Vdc across smoothing capacitor C1 is higher than the absolute value of the input voltage Vin of rectifier RE, as shown in FIG. 11D, a potential Va (shown in FIG. 10) varies between Vdc and the absolute value of the input voltage Vin, in accordance with the polarity reversal of a voltage across capacitor C4. As described above, when switching element Q2 is on, the potential Va is lowered to the input voltage Vin. As a result, the input current Iin flows as shown in FIG. 11E.

Figures 12A, 12B, 12C, 12D, 12E:
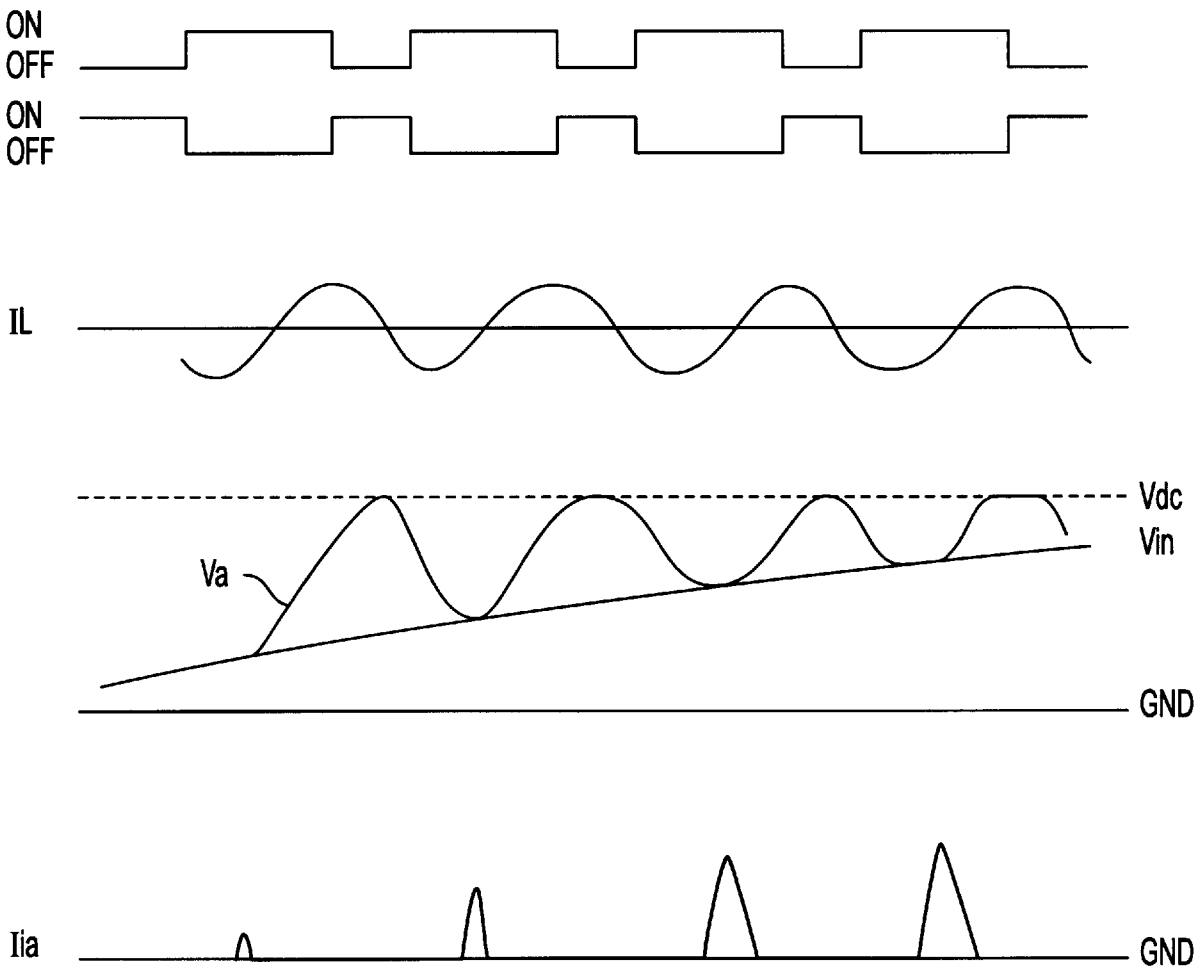
FIGS. 12(*a*) to 12(*e*) are explanatory views illustrating waveforms at various points in the circuit of FIG. 10.

For dimming the lamp, it is required that the ON-period of switching element Q2 be reduced and the ON-period of switching element Q1 be elongated. That is, as shown in FIG. 12A and 12B, switching elements Q1 and Q2 are controlled to vary their ON-duties in opposite directions. With this control, current IL flowing through inductor L3 is made smaller than at the rated luminous output, as shown in FIG. 12C. Thus, capacitor C4 is charged to a lesser extent, so that the voltage amplitude of capacitor C4 is smaller than at the rated luminous output (that is, capacitor C4 becomes saturated in a shorter time), as shown in FIG. 12D. Consequently, input current Ii flows in a shorter period than at the rated luminous output, thereby restraining the voltage increase of smoothing capacitor C1. In this manner, lamp dimming can be achieved by controlling the ON-duty of switching elements Q1 and Q2, while smoothing capacitor C1 can be prevented from increasing its voltage by varying the feedback amount in proportion to the variation in the degree of lamp dimming (variation in light output).

A sixth embodiment of the present invention will now be described. Several different circuit configurations referred to immediately below utilize a common arrangement, in which a series pair of diodes D4 and D5 is connected as a clamping circuit across a smoothing capacitor C1. A connection point between diodes D4 and D5 is made to have a voltage not exceeding the voltage across smoothing capacitor C1. In addition, the connection point between diodes D4 and D5 is connected to such a location as to enable the control of the output voltage of a feedback power source (e.g., inverter 1).

Figure 13:
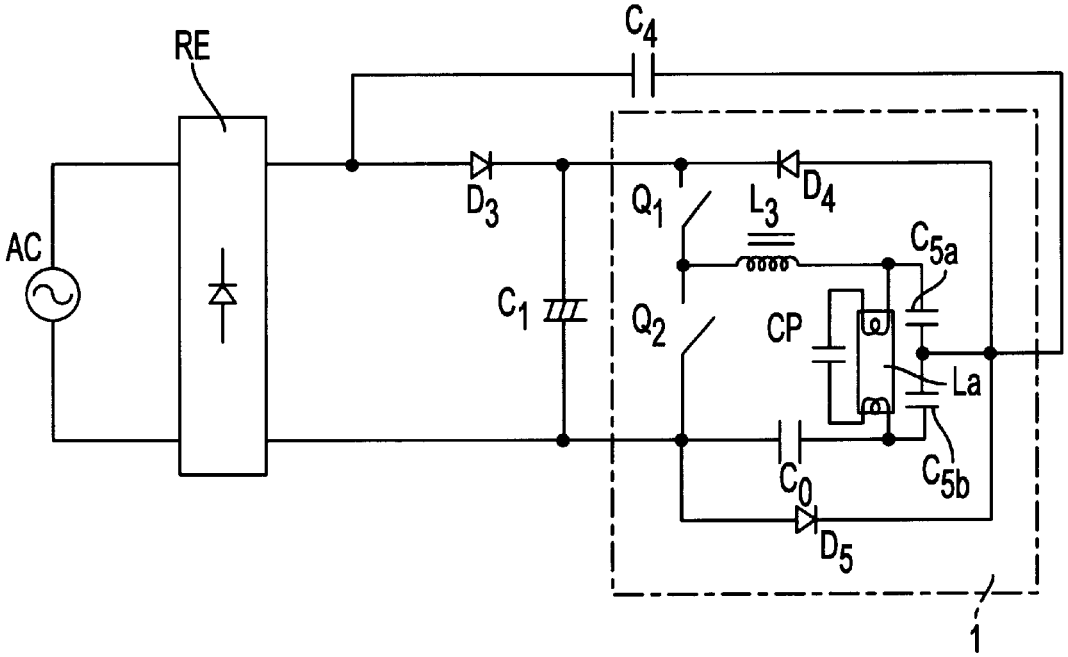
FIG. 13 is a circuit diagram of a sixth embodiment.

Referring to FIG. 13, discharge lamp La is inserted between inductor L3 and capacitor C0. This differs from the prior art of FIG. 21, in which DC blocking capacitor C0 is inserted between inductor L3 and discharge lamp La. In the circuit of FIG. 13, smoothing capacitor C1 is connected across a rectifier RE through diode D3. Inverter 1 includes a series-connected pair of switching elements Q1 and Q2 (although shown in the form of a switch in the figure, each may comprise, for example, a MOSFET or other switching device, as in the other embodiments) which are connected across smoothing capacitor C1 and controlled to alternately turn on and off. Connected across switching element Q2 is a series circuit comprising the inductor L3, the discharge lamp La, and the DC blocking capacitor C0. A pre-heating capacitor Cp is connected to discharge lamp La. A pair of series connected capacitors C5*a* and C5*b* is connected across discharge lamp La. A connection point of the capacitors C5*a* and C5*b* is common to a connection point of diodes D4 and D5. A feedback capacitor C4 is connected at its one end to the connection point and is connected at the other end to a positive output terminal of rectifier RE. The remaining configuration is the same as those of FIG. 21.

In this circuit, inverter 1 operates as a half-bridge type when capacitors C5*a* and C5*b*, diodes D4 and D5, and capacitor C4 are not connected. That is, when switching element Q1 is on, current flows from smoothing capacitor C1 through a path of switching element Q1—inductor L3—discharge lamp L1—capacitor C0. When switching element Q2 is on, capacitor C0 serves as a source to flow current from capacitor C0 through a path of discharge lamp La—inductor L3—switching element Q2. In this manner, a high frequency alternating voltage is applied to discharge lamp La as well as to the series combination of capacitors C5*a* and C5*b* so that, during a period in which the sum of the divided voltage by capacitors C5*a* and C5*b* and the voltage of capacitor C4 is higher than voltage across smoothing capacitor C1, capacitor C1 is charged through diode D3. That is, as the voltage at the connection between capacitors C5*a* and C5*b* becomes higher, smoothing capacitor C1 is charged to a higher voltage level.

Conversely, when the sum of the voltage of capacitor C5*b* and the voltage of capacitor C4 is lowered to the absolute value of the input voltage of rectifier RE, input current flows through rectifier RE into capacitor C4. Therefore, it is possible to cause the input current to flow at a high frequency even during the period in which the output voltage of rectifier RE is less than the voltage across smoothing capacitor C1, thereby improving the input current distortion as well as the input power factor.

Since the voltage at the connection point between capacitors C5*a* and C5*b* is clamped by diodes D4 and D5 to the voltage across smoothing capacitor C1, smoothing capacitor C1 is prevented from developing an increased voltage, even when the lamp voltage of the discharge lamp La increases. Discharge lamp La has negative characteristic of resistivity, so that when reducing the lamp power for dimming, the lamp voltage tends to increase. However, due to the above clamping action, the smoothing capacitor C1 is prevented from increasing its voltage when dimming the lamp.

Figure 14:
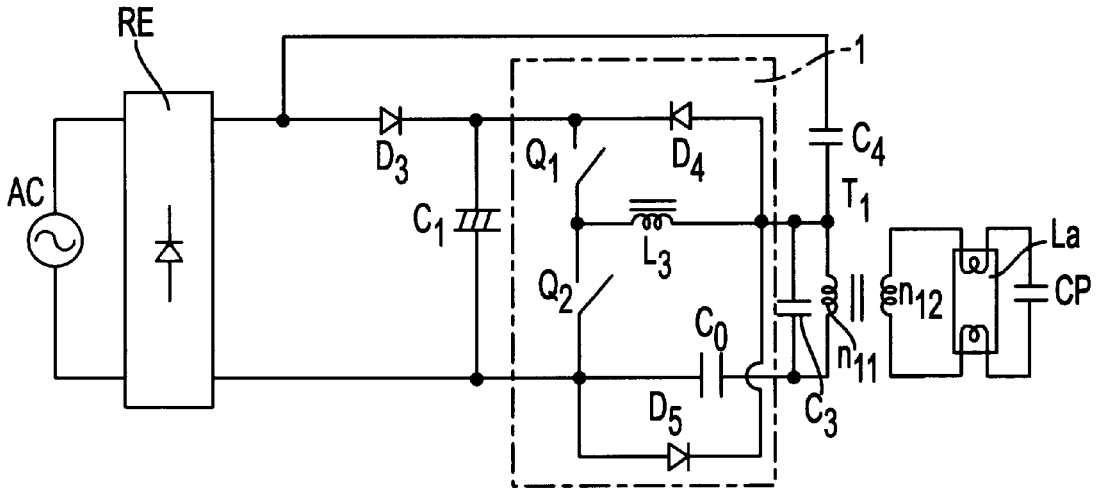
FIG. 14 is a circuit diagram of a seventh embodiment.

FIG. 14 shows a seventh embodiment, in which a circuit is similar to the circuit of FIG. 13, except that a parallel circuit, formed by first winding n11 of an output transformer T1 and a resonant capacitor C3, is connected instead of the discharge lamp La and the capacitors C5*a* and C5*b* employed in the circuit of FIG. 13. The connection point of diodes D4 and D5 is connected together with one end of capacitor C4 to a connection point between the first winding n11 of output transformer T1 and inductor L3. Discharge lamp La is connected to a second winding n12 of output transformer T1 and a per-heating capacitor Cp is connected to discharge lamp La.

With this configuration, first winding n11 of output transformer T1 develops a high frequency voltage in response to the turning on and off of switching elements Q1 and Q2 so that, when the sum of the high frequency voltage and the voltage across capacitor C4 becomes higher than the voltage across the smoothing capacitor C1, the voltage across smoothing capacitor C1 increases. In view of this, the high frequency voltage is clamped to the voltage across the smoothing capacitor C1 by diodes D4 and D5. Due to the above clamping action, smoothing capacitor C1 is prevented from increasing its voltage when dimming the lamp.

Figure 15:
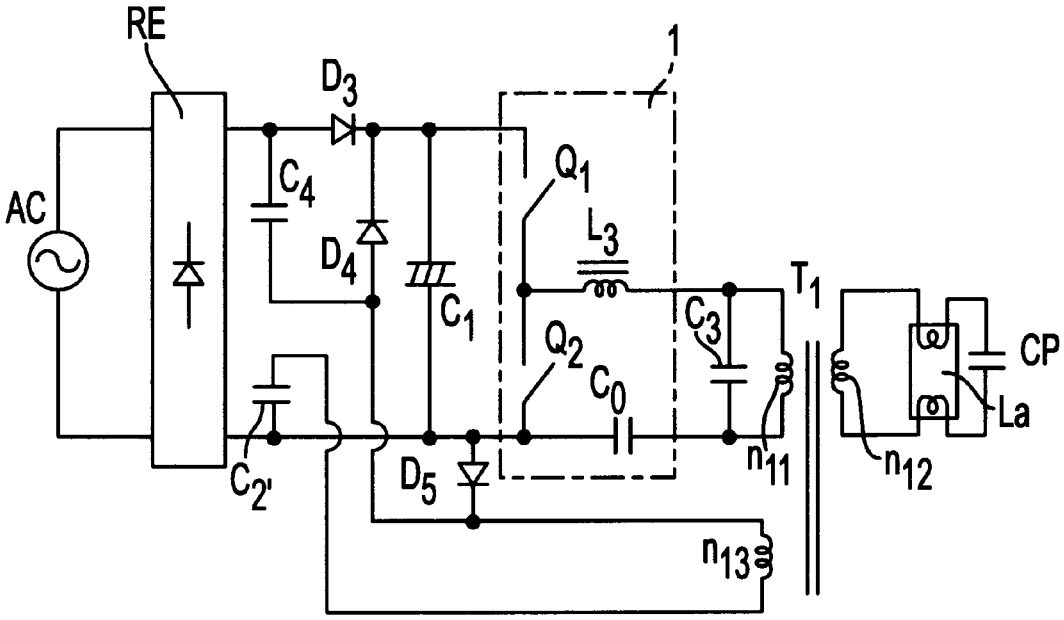
FIG. 15 is a circuit diagram of an eighth embodiment.

FIG. 15 shows a modified circuit (e.g. eighth embodiment), in which a feedback winding n13 is connected to the output transformer T1 utilized in the circuit of FIG. 14. Feedback winding n13 is connected in series with feedback capacitor C4 and capacitor C2' across output terminals of rectifier RE. The connection point of diodes D4 and D5 is coupled to a connection point of feedback winding n13 and capacitor C4.

In the absence of diodes D4 and D5, smoothing capacitor C1 would develop increasing voltage when the sum of the voltage of capacitor C2', the induced voltage of feedback winding n13, and the voltage across capacitor C4 becomes higher than the voltage across the smoothing capacitor C1, due to the increase in the induced voltage at the feedback winding n13 which occurs at the time of dimming the lamp with an attendant increase in the lamp voltage.

However, when diodes D4 and D5 are added, the sum of the voltage of capacitor C2' and the induced voltage at the feedback winding n13 is clamped to the voltage of the smoothing capacitor C1, so that abnormal voltage increases across smoothing capacitor C1 are avoided.

Figure 16:
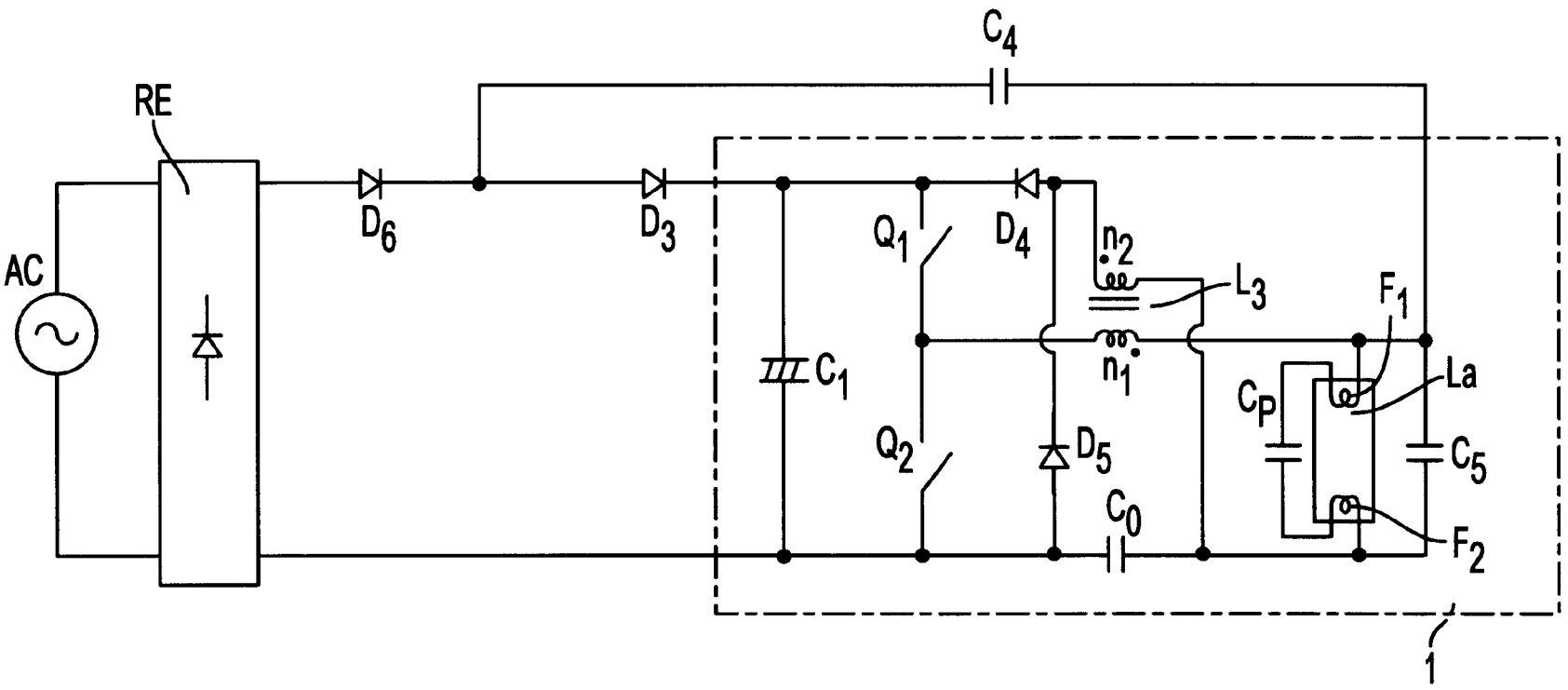
FIG. 16 is a circuit diagram of a ninth embodiment.

A ninth embodiment of the invention will now be described with respect to FIG. 16. FIG. 16 differs from the embodiment illustrated in FIG. 13 in that inductor L3 is used with second winding n2, and capacitor C5 is employed instead of the series combination of capacitors C5*a* and C5*b*. Feedback capacitor C4 has one end connected to a connection point between the first winding n1 of inductor L3 and capacitor C5. Second winding n2 of inductor L3 has one end connected to a connection point between diodes D4 and D5 and has its other end connected to a connection point between capacitors C0 and C5.

This embodiment utilizes the same clamping action as explained with respect to the embodiment of FIG. 13, and operates as follows: the high frequency output applied to discharge lamp La is fed back to the input of inverter 1 by way of capacitor C4, such that smoothing capacitor C1 would suffer from an abnormally increased voltage as the lamp voltage (voltage across capacitor C5) increases. In view of the fact that, when the voltage across capacitor C5 is added to the voltage across capacitor C4, first winding n11 of inductor L3 sees a current flowing in a direction from right to left in the figure, first winding n1 and second winding n2 of inductor L3 are connected in such a polarity relation that a voltage corresponding to the voltage across capacitor C5 appears at the end of second winding n2 of inductor L3 at which it is connected to the connection point of diodes D4 and D5. With this configuration, the voltage induced at the second winding n2 can be clamped to the voltage across the smoothing capacitor C1, so as to avoid an increase in the lamp voltage, and therefore avoid the voltage increase across smoothing capacitor C1.

Although embodiments 6–9 disclose the inclusion of an element or elements between capacitor C0 and inductor L3, capacitor C0 and inductor L3 may be coupled directly.

Figure 27A:
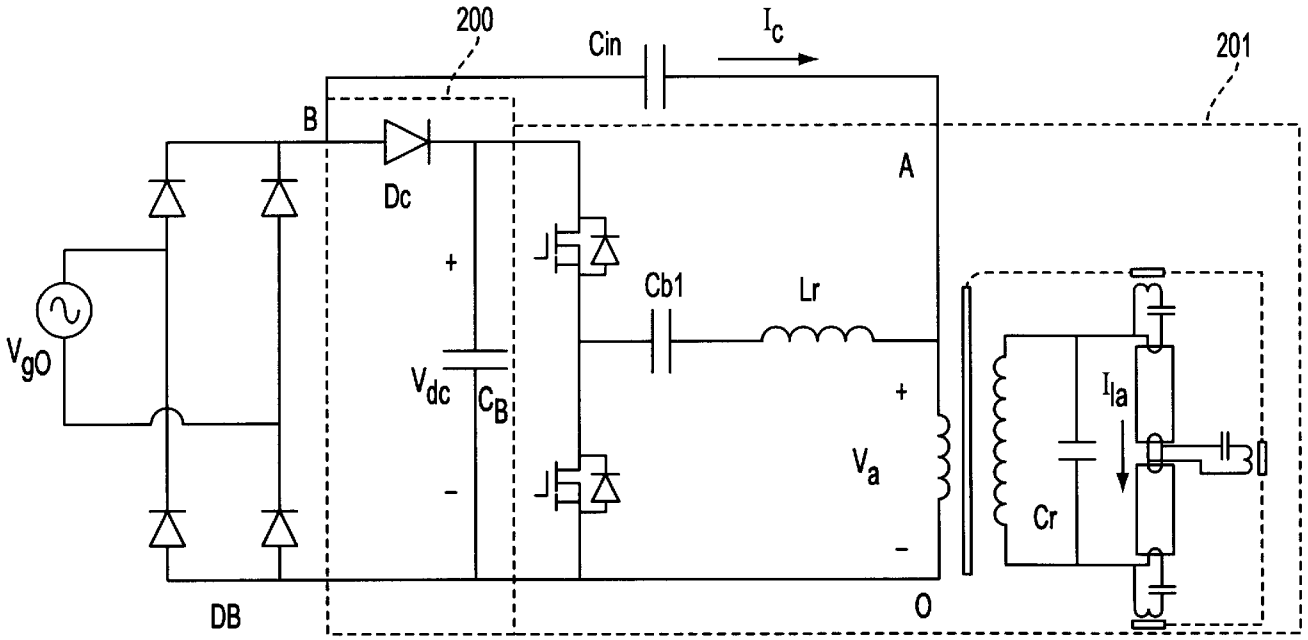
FIG. 27A shows a basic electronic ballast circuit for the discharge lamp.
Figure 27B:
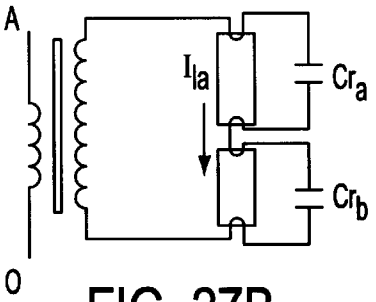
FIG. 27B shows a means for preheating the filaments.

FIG. 27A shows a "charge pump" electronic ballast for a discharge lamp. The circuit can be separated into two parts: a PFC circuit 200 and a dc/ac inverter 201. A charge capacitor Cin is used to regulate input current $I_c$ instead of a boost inductor. By using a charge capacitor, the cost of the circuit as a whole can be lowered. A lamp 202 is connected between nodes A and O. A parallel capacitor Cr is used to boost the voltage at start-up of the discharge lamp. The isolation transformer serves two purposes: providing the required lamp voltage and preheating the lamp filaments. FIGS. 27A and 27B illustrate two prevailing schemes for preheating the filaments of lamp 202. Since the magnitude of $V_a$ is typically not suitable to drive the lamps, the power transformer is required to provide the necessary voltage gain.

Figure 28:
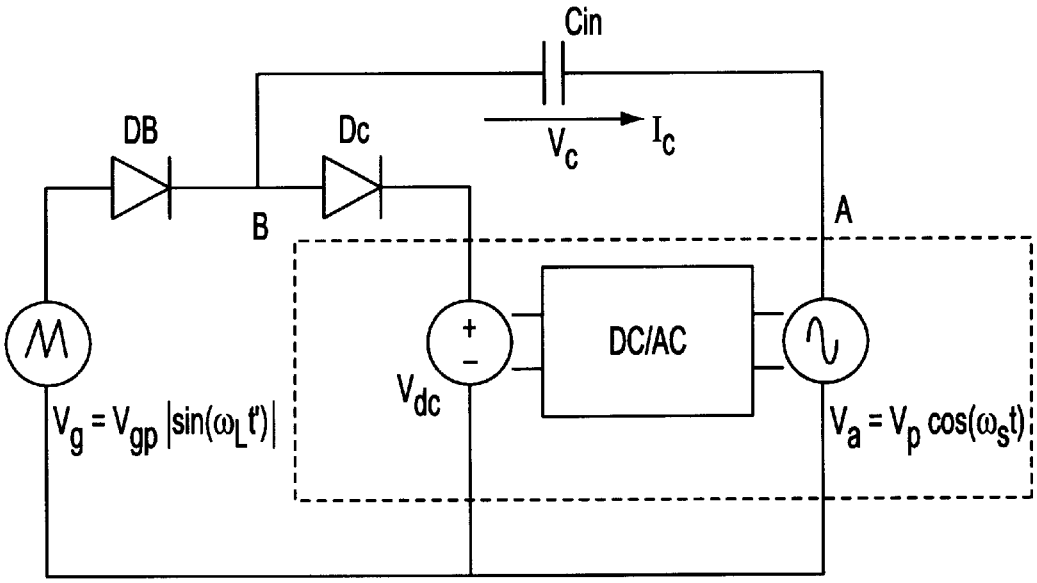
FIG. 28 shows an equivalent circuit including a PFC circuit and a dc/ac inverter.

The equivalent circuit of the circuit shown in FIG. 27A is shown in FIG. 28: DB stands for the rectifier diodes, Dc is the input diode, and $V_g$ is the rectified input voltage.

Through proper design, the lamp voltage amplitude can be roughly constant during the line cycle. Consequently, $V_a$ is regarded as a constant amplitude high frequency ac source. In order to regulate the input current, input diode Dc and rectifier diodes DB should not be on at the same time. This implies that $V_{dc}$, the dc bus voltage, should always be higher than the line voltage. Therefore, $V_{dc}$ should be larger than a line peak voltage, $V_{gp}$. Since the line frequency is usually much lower than the switching frequency, the line voltage $V_g$ is regarded to be constant for one switching cycle.

Principles of Power Factor Correction (PFC)

Figure 29:
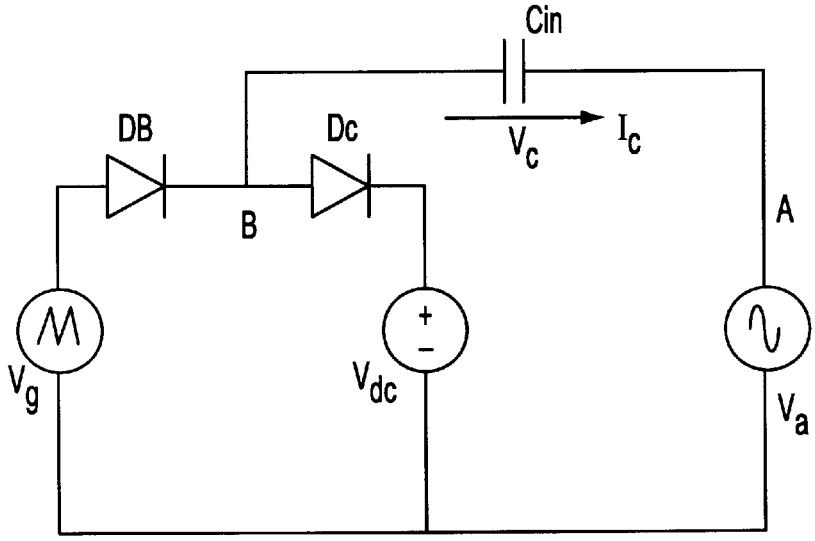
FIG. 29 shows an equivalent circuit of the PFC circuit.

To facilitate the understanding of the PFC principle in a "charge pump" circuit, an equivalent circuit for PFC is introduced as shown in FIG. 29: $V_a$ is regarded as a constant ac voltage source in one switching cycle. Four power stages in one switching period are shown in FIG. 30, and the waveforms are shown in FIG. 31. Based on the assumption of zero on-voltage-drop of diodes and switches, the steady state operation in one switching cycle is analyzed as follows:

Stage I [0,αa] of FIG. 30

During this stage, since the voltage at node B, $V_b$ is lower than $V_{dc}$, and higher than $V_g$, both Dc and DB are off. Thus, no current flows through input capacitor, CIN. As a result, $V_c$, the voltage across Cin, is unchanged. $V_a$ keeps decreasing, pulling down $V_b$. This stage ends at $\omega=\alpha$ when $V_b$ becomes equal to $V_g$.

Stage II [απ] of FIG. 30

DB starts to conduct at $\omega t=\alpha$. $V_b$ is clamped to $V_g$. To make $V_b$ constant, $V_c$ has to increase when $V_a$ continues decreasing. Cin is thus charged by the rectified line current. At $\omega t=\pi$, $V_a$ decreases to the negative peak value, and $V_c$ reaches its maximum point:

$$V_{c,max}=V_p+V_g \tag{1}$$

where $V_p$ is the ac amplitude of $V_a$.

Stage III [π, π+β] of FIG. 30

After $\omega t=\pi$, $V_a$ increases from its negative peak value, $-V_p$, $V_b$ becomes higher than $V_g$, forcing DB to be reversely biased. Since $V_b$ is lower than $V_{dc}$, Dc still blocks. Similar to Stage I, there is no current flowing through the input capacitor, Cin. $V_c$ remains unchanged. $V_a$ keeps increasing, boosting $V_b$ up. This stage ends at $\omega t=\pi$, $V_a$ increases to its positive peak value, and $V_c$ reaches its minimum point:

$$V_{c,min}=V_{dc}-V_p$$

After $\omega t=2\pi$, the circuit operation enters Stage I again. The next switching cycle will be repeated. $V_c$ has to decrease when $V_a$ continues increasing. The discharging current of Cin flows into $V_{dc}$. At $\omega t=2\pi$, $V_a$ increases to its positive peak value, and $V_c$ reaches its minimum point:

$$V_{c,min}=V_{dc}-V_p \tag{2}$$

After $\omega t=2\pi$, the circuit operation enters Stage I again. The next switching cycle will then be repeated.

Conditions for unity input power factor

From the above analysis, it is shown that line current only flows during Stage II. Therefore, the input current in this circuit is discontinuous and is regulated by the charging and discharging of capacitor Cin. A more detailed analysis of the charge variation of Cin reveals the operation condition for the unity input power factor. During the charging stage, the charge variation of Cin is $$\Delta Q_{ch}=C_{in}\ (V_{c,max}-V_{c,min}) \tag{3}$$

By substituting Eqs. (1) and (2) into Eq. (3), the following result is obtained:

$$\Delta Q_{ch}=C_{in}\ (V_g+2V_p-V_{dc}) \tag{4}$$

Since the rectifier diodes conduct only in the charging stage (Stage 2) over the whole switching cycle, the average input current in one switching cycle equals the average charging current of Cin, which is $$i_{in,av}=I_{ch}=f_s\bullet\Delta Q_{ch} \tag{5}$$

or $$i_{in,av}=f_sC_{in}(V_g+2V_p-V_{dc}) \tag{6}$$

For a good power factor, the input current can be expected to follow the input voltage, i.e., $$i_{in,av}\alpha V_g \tag{7}$$

If the relationship between $V_{dc}$ and $V_p$ is designed as follows:

$$V_{dc}=2V_p \tag{8}$$

then the $i_{in,av}$ takes on the value of $$i_{in,av}=f_sCinV_g\alpha V_g \tag{9}$$

This implies that the circuit has a good power factor if Eq. (8) is satisfied. Here, it is assumed that $V_a$ can be any kind of waveform with a constant ac amplitude. As long as the ac peak-to-peak value of $V_a$ equals $V_{dc}$, a good power factor will be guaranteed.

From Eq. (6), it can be observed that $V_p$, the peak value of $V_a$ should be no smaller than half of $V_{dc}$ in order to avoid line current distortion at a zero-crossing of the line voltage. If $V_p$ is smaller than half of $V_{dc}$, the line current will become zero when $V_g\leqq|V_{dc}-2V_p|$.

The above analysis shows that the ac peak-to-peak value of $V_a$ should be equal (or very close) to $V_{dc}$ in order to obtain the good input current shaping. Therefore, the power transformer in FIG. 27 is necessary in terms of providing the required voltage conversion gain to drive the lamp.

Input power estimation

Through proper design, $V_{dc}$ is always higher than $V_{gp}$. Consequently, all the input power is delivered in Cin. Under the assumption of a well-designed input filter, $V_{dc}\geqq V_{gp}$ and constant $V_p$ with $V_p\geqq V_{dc}/2$, the expression for the input power flowing through Cin, $P_{in}$ can be derived where $$V_g=V_{gp}|\sin(\omega_L\tau)| \tag{10}$$

and $$P_{in}=2/T_L\int_0^{TL/2}V_gi_{in,av}dt \tag{11}$$

By substituting Eqs. (6) and (10) into Eq. (11), the following is obtained:

$$P_{in}=\tfrac{1}{2}f_sC_{in}[V_{gp}^2+4/\pi(2V_p-V_{dc})V_{gp}] \tag{12}$$

Under the condition PF=1, we have $V_{dc}=2V_p$. Then Eq. (12) becomes $$P_{in}=\tfrac{1}{2}\int_xC_{in}V_{gp}^2 \tag{13}$$

Equation (13) is useful in the circuit design If the line voltage, the input power, and the switching frequency are given, Cin can be chosen accordingly.

Analysis of inverter operation

The inverter 201 is basically an LC parallel resonant circuit. Since the input capacitor, Cin, is switched into the resonant tank during States (II) and (IV) and is switched off in Stages (I) and (III), the voltage across the lamp, $V_a$ can vary very much in the half line cycle.

Figure 32A:
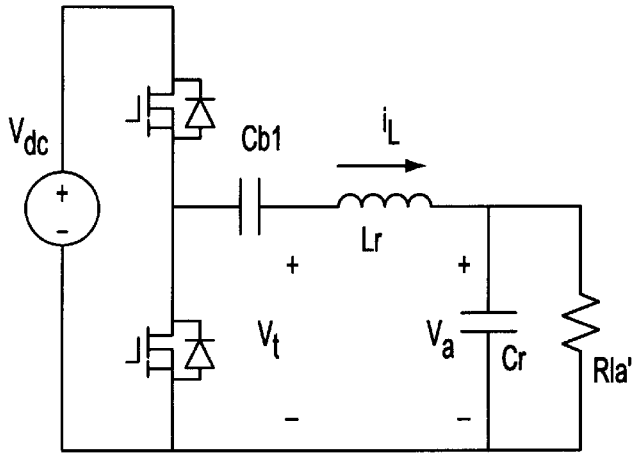
FIGS. 32A–32C show power stages of a resonant inverter.
Figure 32B:
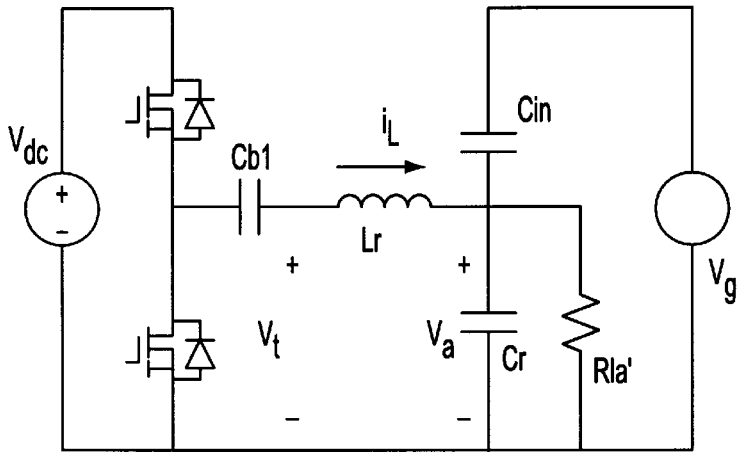
Figure 32C:
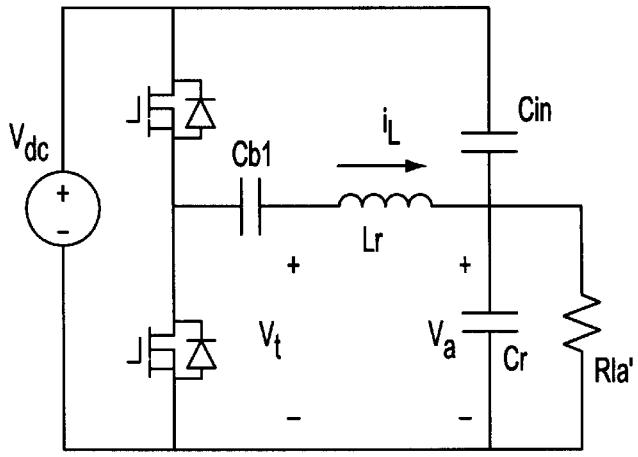
Figure 33:
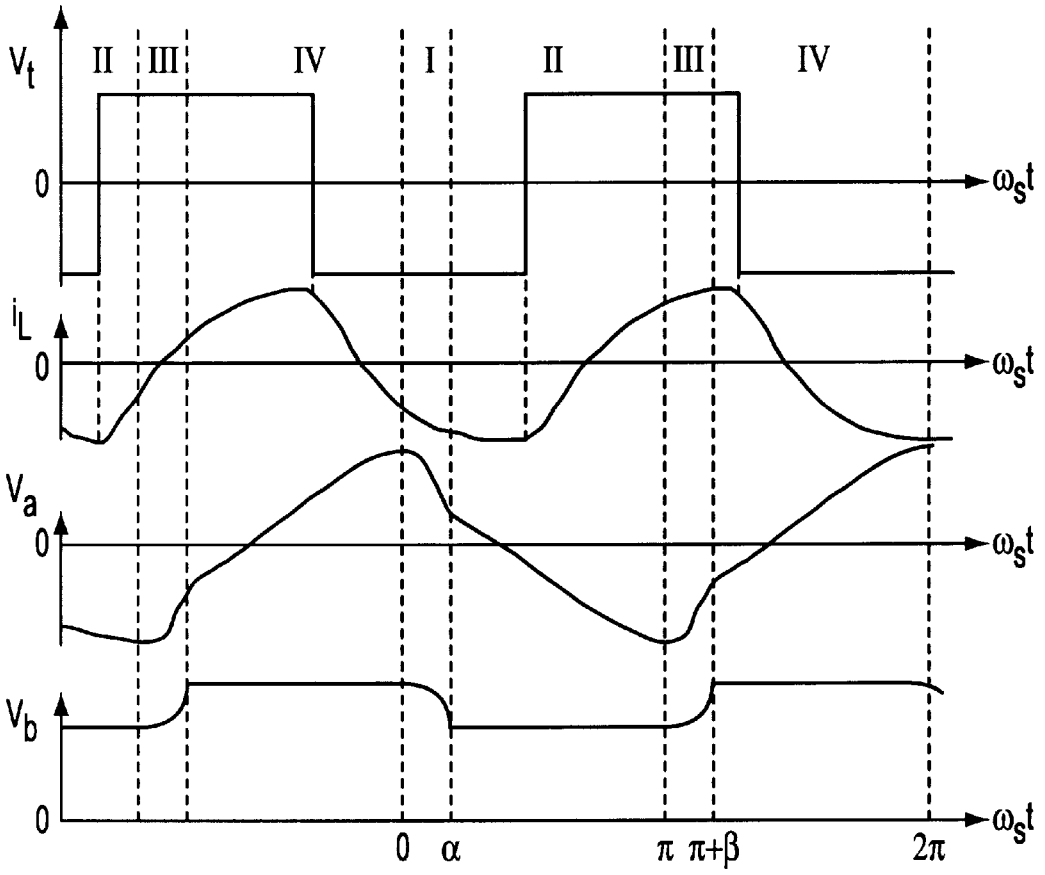
FIG. 33 shows theoretical waveform of the resonant inverter.

The equivalent circuit inverter topologies at different power stages of the PFC circuit 200 and inverter 201 are shown in FIGS. 32A–32C. The wave form is shown in FIG. 33. In each switching cycle, Cin is switched into the resonant tank for the angle interval, $2(\pi-\alpha)$, which is determined by the line voltage. When the line voltage is low, this angle is small; if the line voltage is high, the angle is large. Moreover, as shown in FIG, 32B, $V_g$ is connected to the resonant inverter during Power Stage (II). Therefore, $V_a$ is affected by the line voltage.

Figure 34:
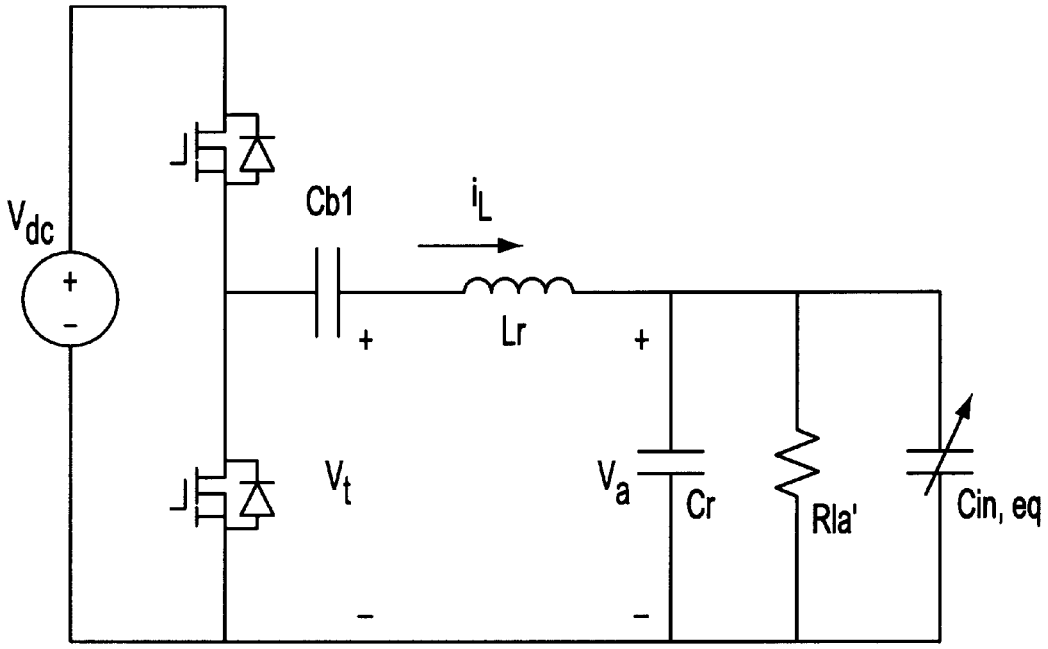
FIG. 34 shows the equivalent circuit of the inverter.
Figure 35A:
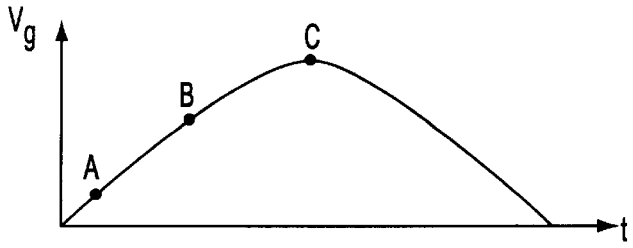
FIGS. 35A and 35B show the voltage conversion gains under different line voltages.
Figure 35B:
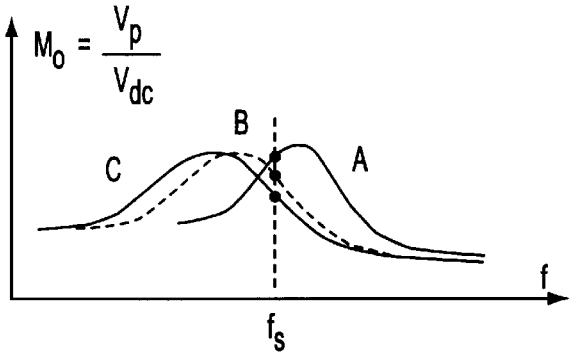

The approximate equivalent circuit of the resonant inverter is shown in FIG. 34. the equivalent capacitance of Cin appears in parallel with Cr, and its value is a function of the line voltage. No strict mathematical expression is available. But generally speaking, $C_{in.eq}$ is large when the line voltage is high and small when the line voltage is low. $C_{in.eq}$ reaches its maximum value, Cin, when the line voltage is the highest. Consequently, the approximate inverter voltage conversion gain curves under different line voltages are obtained as shown in FIGS. 35A and 35B. It is noted that when the line voltage is low, the resonant peak is at a high frequency, so the circuit may run in a capacitive mode (see Curve A shown in FIG. 35B), especially at light loads, resulting in the loss of zero-voltage-switching (ZVS) of the semiconductor switches. Due to the reverse recovery of the body diode of the MOSFET, the tun-on power loss of the switches can be substantially high.

Figure 36:
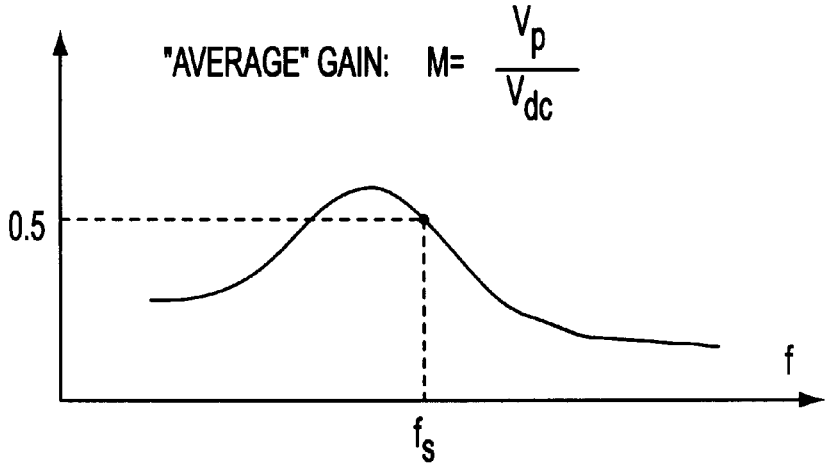
FIG. 36 shows the approximate voltage gain of the inverter.

In practice, if the inverter gain curves in FIG. 35B are grouped closely enough, an approximate voltage gain curve of the inverter (shown in FIG. 36) can be obtained. To achieve the unity input power factor, the voltage gain, $M=V_p/V_{dc}$, should equal 0.5.

Limitations of the "charge pump" electronic ballast circuit

There are several limitations in this circuit: high THD of the input current, high crest factor of the lamp current, and high dc bus voltage at light load operations.

Reason for high THD and high crest factor

From FIG. 35B, $V_p$ being variable over the half line cycle can be predicted. The direct penalty of this variation is the poor crest factor of the lamp current. Since the variation of $V_{dc}$ is negligible, Eq. (8) cannot always satisfied during the half line cycle. From Eq. (6), it can be seen that the input current will not follow the input line voltage. The input power factor is degraded, and the THD of the line current increases.

As shown in FIG. 33, the lamp current waveform consists of two distinct parts. The wave shape of the lamp current is not purely sinusoidal. This is another reason for poor crest factor of the lamp current.

Reason for high dc bus voltage ($V_{dc}$) at light load conditions

The way to understand this problem is to examine Eq. (12) closely. This equation shows that the higher $f_s$, Cin, or $V_p$, the higher the input power flowing through Cin, and the higher the $V_{dc}$, the lower the input power flowing through Cin. At the steady state operation, the input power flowing through Cin equals the output power if $V_{dc}>V_{gp}$ is satisfied. At light loads, the output power reduces, the parameters on the right hand side of Eq. (12) have to change to make both sides of Eq. (12) equal.

Figure 37:
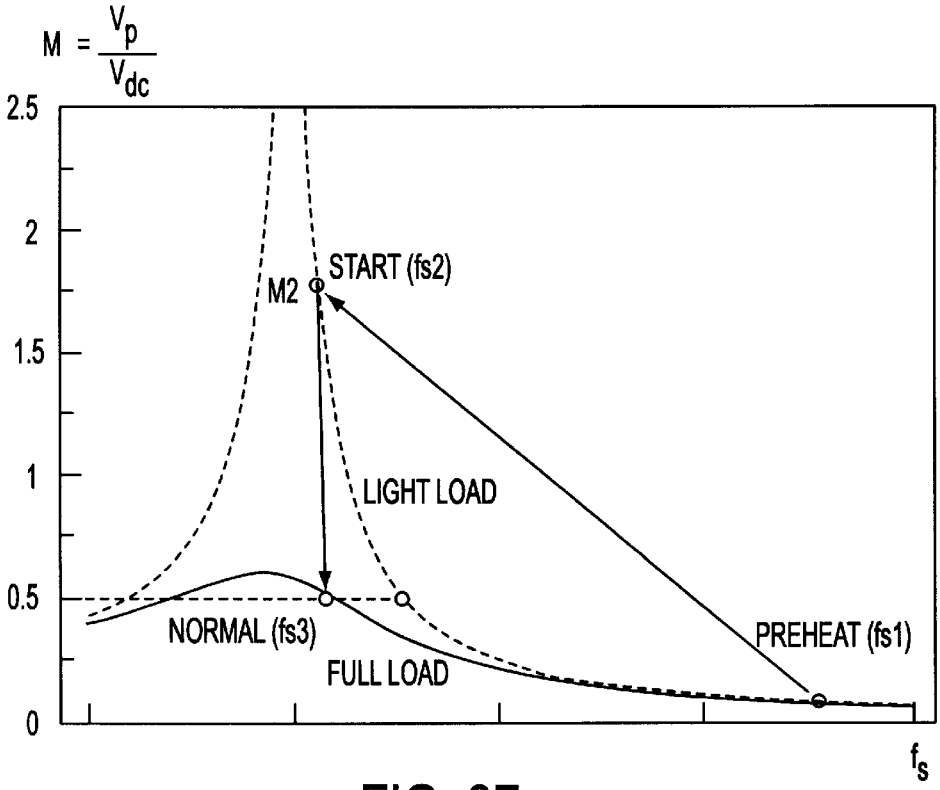
FIG. 37 shows the voltage conversion gain of the inverter under different loads.

Usually, the operation of the electronic ballast for a discharge lamp includes three operation modes: preheat, start-up and normal lighting. The approximate voltage conversion gains of the inverter tank under different load conditions are shown in FIG. 37.

At the preheat mode of the lamp operation, the lamp voltage should be much smaller than the starting voltage. Because the lamp is not turned on, the circuit is operating under the light load conditions. The switching frequency for the preheat mode has to be much higher than that for the normal lighting. In other words, if $V_p$ is kept the same as that of full load at a light load, the frequency (at light loads) has to be higher than that at a full load. The frequency cannot be smaller than the resonant frequency in order to maintain zero-voltage switching. This case usually reflects the preheat mode operation. If the lamp voltage at the preheat mode is not low enough, $V_{dc}$ at a light load has to increase in order to satisfy Eq. (12). This can be expressed as:

$$P_{in}\downarrow \text{ and } f_s\uparrow \rightarrow V_{dc}\uparrow\bullet$$

At the start-up mode operation, the lamp voltage is much higher than that at the normal lighting. Usually, the switching frequency at the start-up mode is very close to that at the normal lighting in order to obtain the sufficiently high ignition voltage. Since a light load corresponds to a high Q, at the same switching frequency, $V_p$ at light loads is much larger than at a full load. This case is usually related to the lamp start-up operation. However, the power at the start-up mode is still much lower than at normal the lighting because the lamp is not ignited. According to Eq. (12), in order to decrease the input power to match the low output power, $V_{dc}$ at start-up mode has to increase dramatically compared to that at normal lighting. This can be expressed as:

$$P_{in}\downarrow \text{ and } f_s\uparrow \rightarrow V_{dc}\uparrow\bullet$$

Tenth Embodiment of the Invention

Reducing the dc bus voltage at light load conditions

As shown above, light load conditions in a "charge pump" electronic ballast always cause high dc bus voltage ($V_{dc}$). The proposed solutions of reducing $V_{dc}$ for the discharge lamp ballast according to a tenth embodiment of the present invention are discussed below.

Since the circuit shown in FIG. 27 can suffer high voltage stress under light load operation conditions, high voltage semiconductor devices have to be used. The cost may then become prohibitive. The solutions of reducing $V_{dc}$ can be found from Eq. (12): if the equivalent Cin or $V_p$ (ac amplitude of $V_a$) is decreased at light loads, $V_{dc}$ can be reduced. The original resonant tank can be regarded as a first stage resonance. To obtain a decreased Cin and/or $V_p$ at light loads, a second-stage resonance is introduced. The basic ideas is to operate the circuit in different resonance domains to obtain different $V_p$ or equivalent Cin under the different load conditions.

Reducing $V_{dc}$ at light loads by decreasing Cin

Figure 38A:
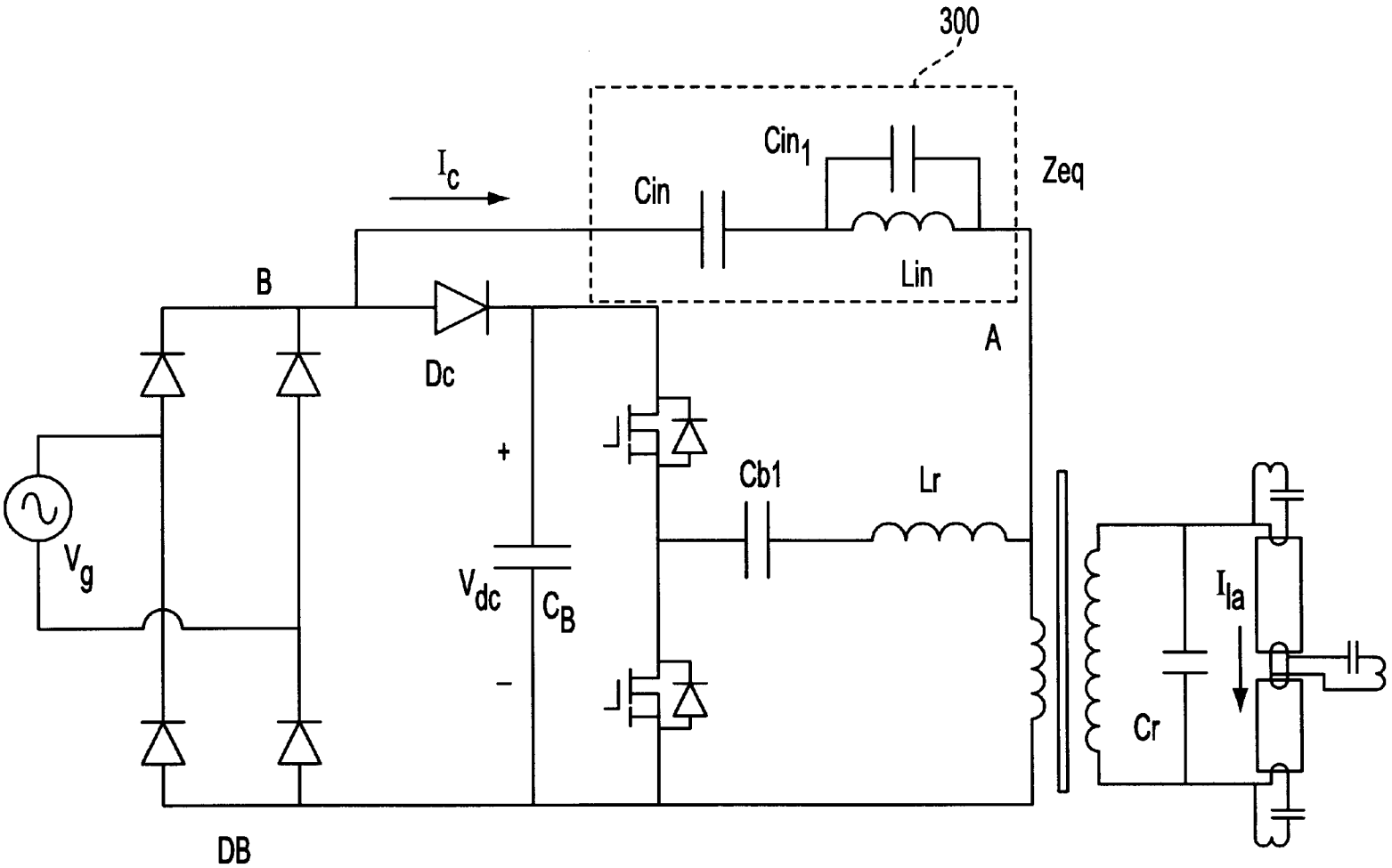
FIGS. 38A and 38B show a first example circuit for changing Cin by using a parallel resonant tank circuit.

There are several ways to modulate the equivalent capacitance of Cin. FIG. 38A shows one example by introducing a second-stage resonance in the Cin branch 300. At $fr_2$, Lin resonates with $Cin_1$, introducing an extremely high impedance. As a result, the equivalent capacitance of the Cin branch is reduced.

Figure 38B:
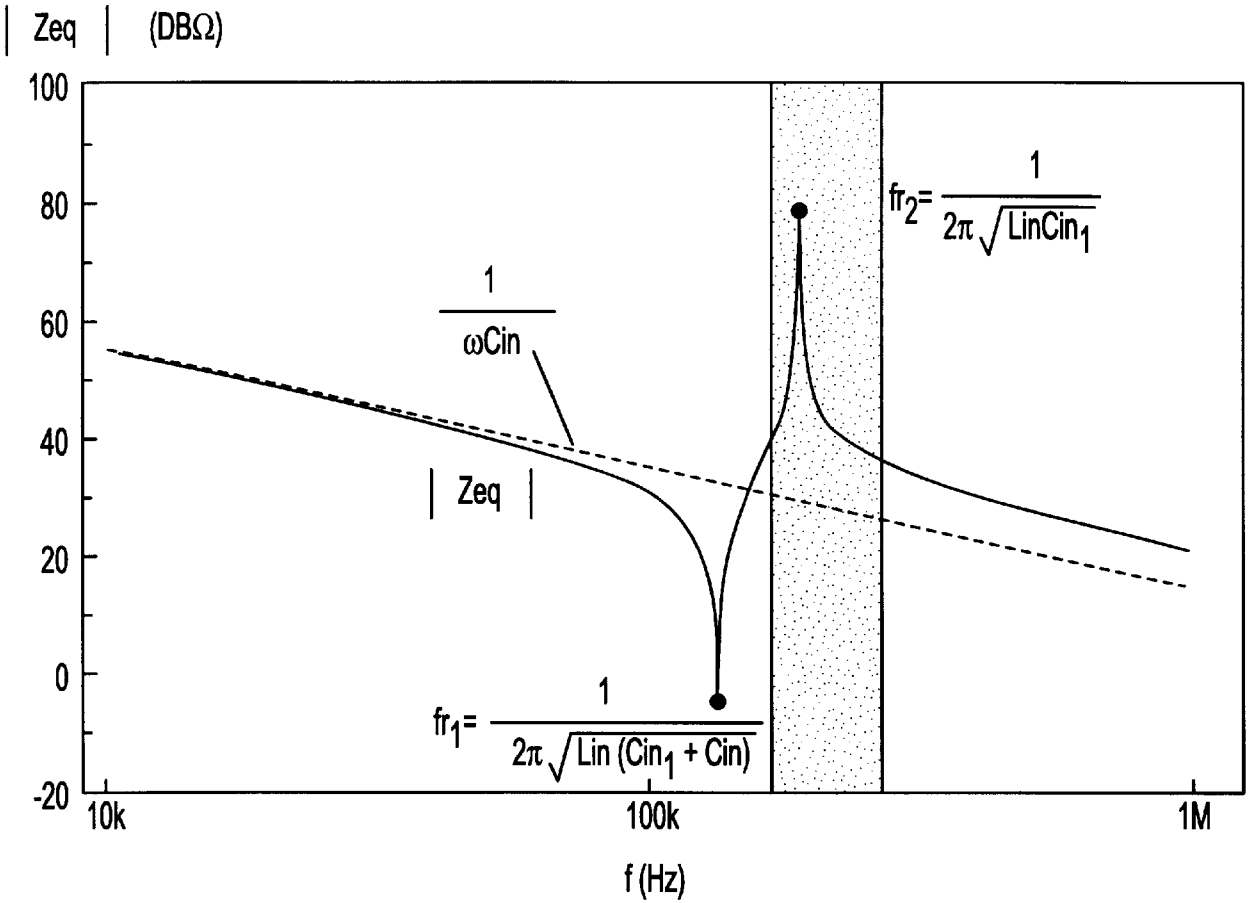
Figure 39A:
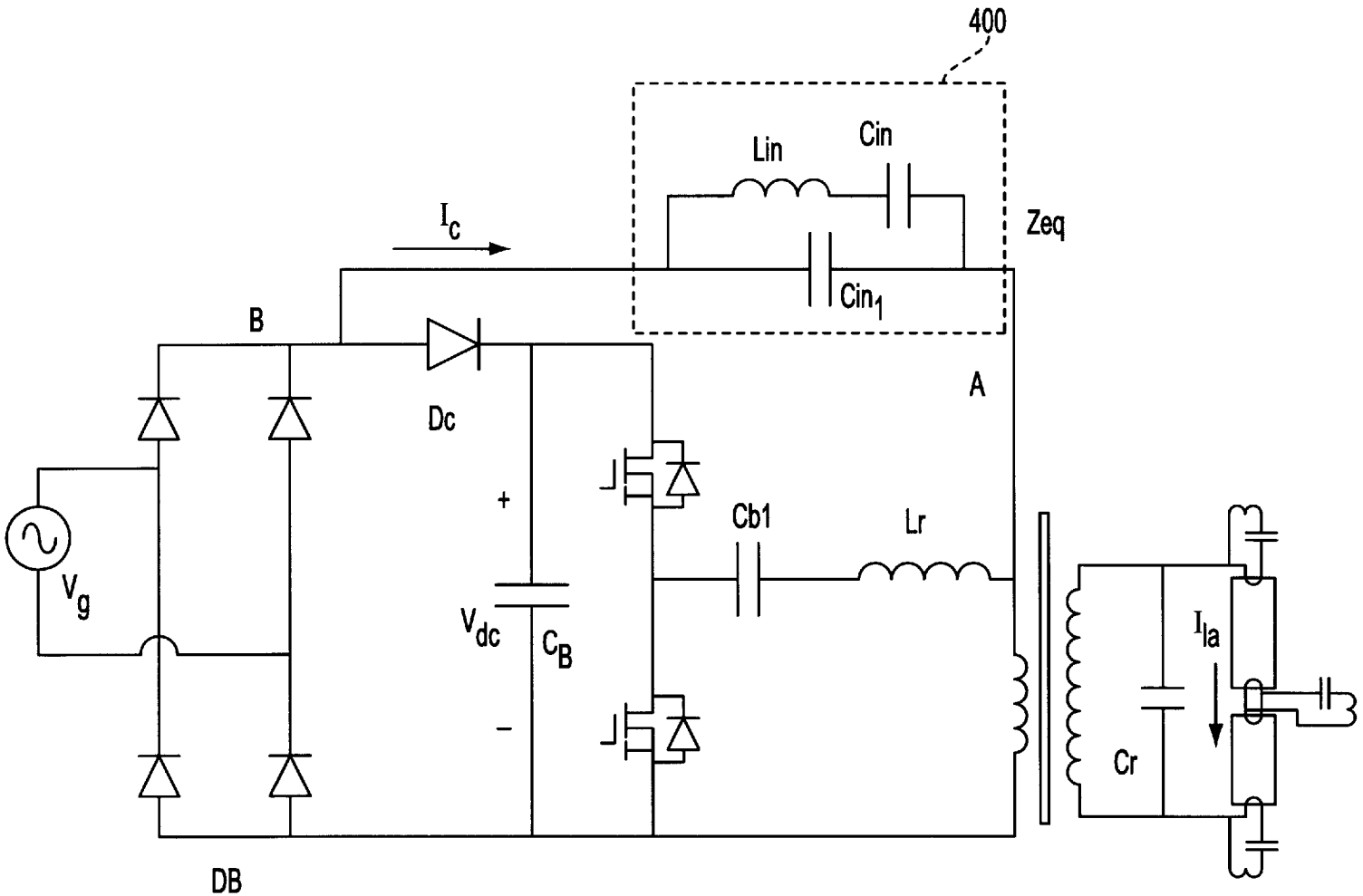
Figure 39B:
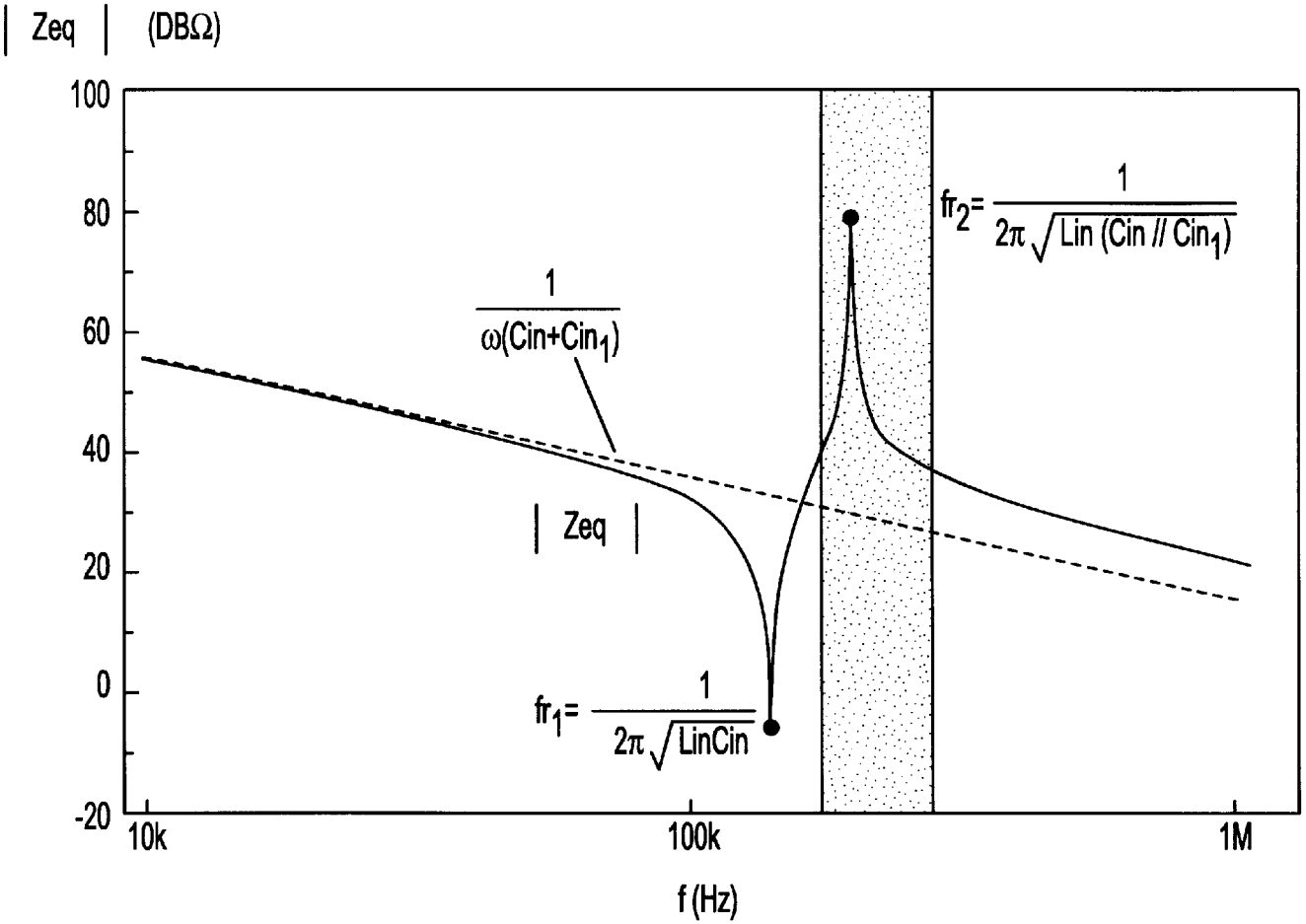

If the light load operating frequency is set around $fr_2$, the input current flowing through Cin (according to Eq. 6) can be limited, and the input power is reduced automatically. Accordingly, $V_{dc}$ is low. The practical light load frequency is set inside the shaded area in FIG. 38B. Since $Z_{eq}$, the equivalent impedance of the Cin branch 300, is infinitely large at $fr_2$, it has little effect on the inverter resonant tank. Therefore, the resonant peak of the inverter tank can be determined from Lr and Cr directly. The high lamp voltage for the light loads (e.g. lamp preheat, start-up, etc.) can be easily obtained. FIGS. 39A and 39B show another example of modulating Cin at light load frequency. The principle is similar to that discussed above for FIGS. 38A and 38B where the Cin branch 400 limits the input current, thereby reducing input power.

Reducing $V_{dc}$ at light loads by decreasing $V_p$

Figure 40A:
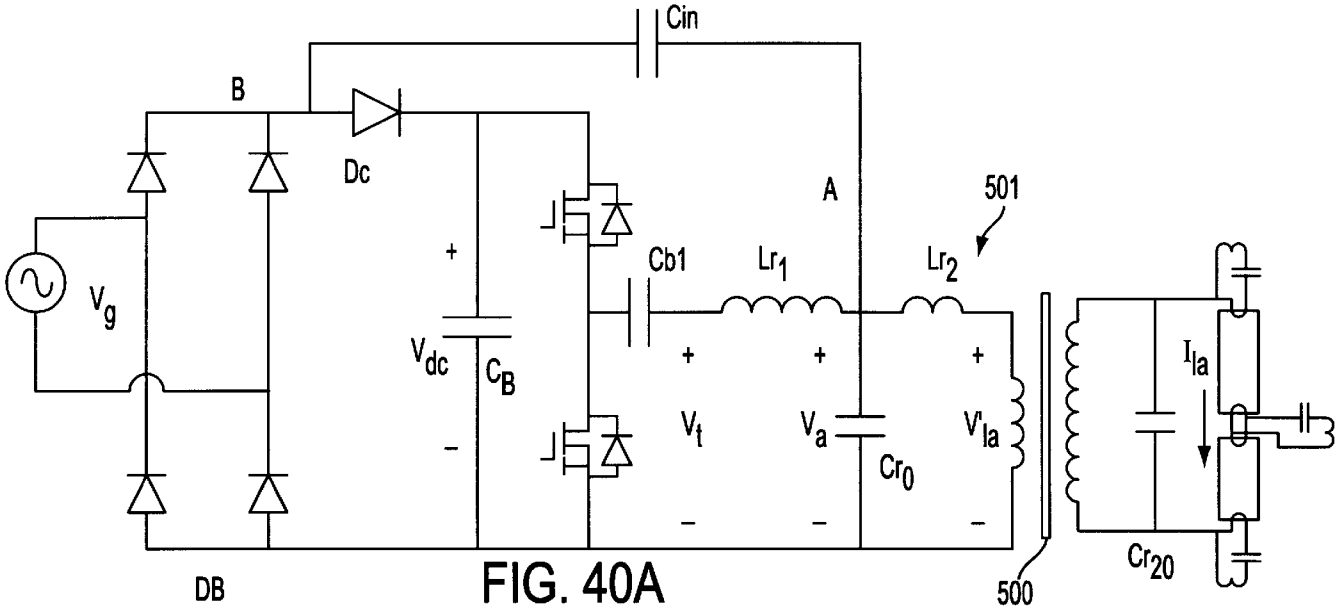
FIGS. 40A and 40B show an example circuit for reducing $V_p$ at light loads.

As predicted by Eq. (12), the input power flowing through Cin can be reduced if $V_p$ is reduced. Consequently, $V_{dc}$ at light loads can be reduced. However, the lamp voltage at light load is usually higher than that at full load. To reconcile these two contradictory requirements, an inductor $Lr_2$ has to be inserted between Terminal A and the transformer primary side of transformer 500 (FIG. 40A).

Figure 40B:
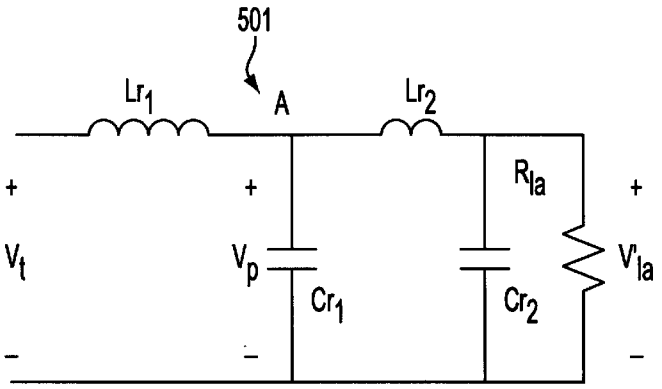
Figure 41A:
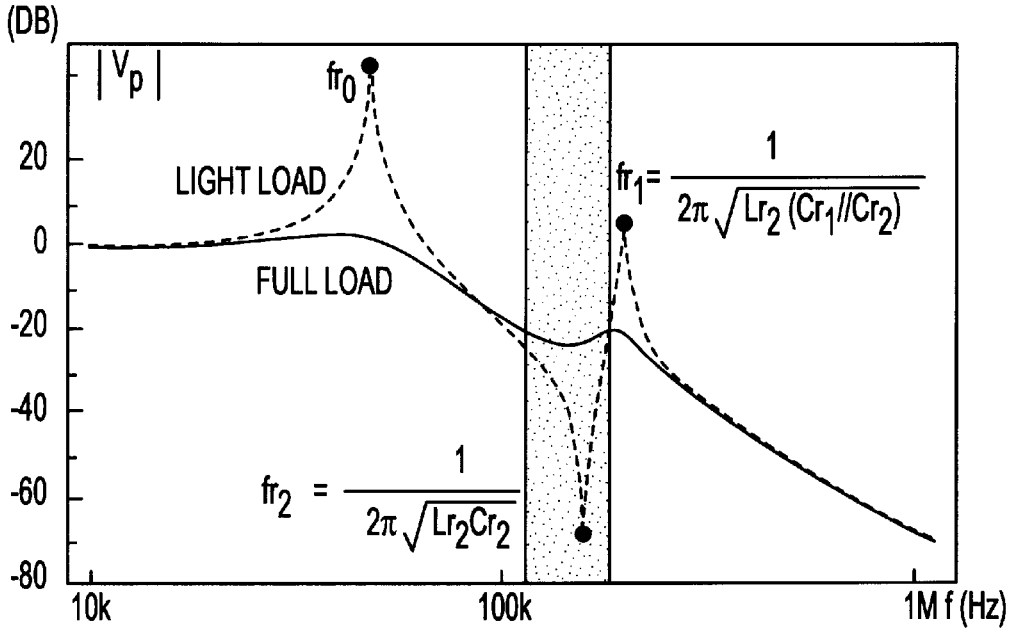
FIGS. 41A and 41B show bode plots of normalized $V_p$ and $V_{1a}$ at light load and full load.

FIG. 40B shows the approximate ac equivalent circuit for the inverter tank 501: $Cr_1$ is the equivalent capacitance across point A; $Cr_2$ and $R_{ia}$ are the reflected $Cr_{20}$ and the lamp resistance respectively. The normalized voltages $V_p$ and $V_{1a}$ (the transformer primary voltage) at light load and full load are plotted in FIGS. 41A and 41B (the reference for the normalization is $V_t$). Under light load conditions, $Lr_2$ resonates with $Cr_2$ at $fr_2$. $V_p$, the ac amplitude of $V_a$, can be close to zero (as shown in FIG. 41A). The input power flowing through Cin is reduced greatly. Therefore, the dc bus voltage at light loads can be low. The primary voltage $V_{ia}$ can still be relatively large due to the resonance between $Lr_2$ and $Cr_2$ (as shown in FIG. 42) compared to $V_p$.

At $fr_1$, where $Lr_2$ resonates with the series combination of $Cr_1$ and $Cr_1$, $V_{1a}$ can be larger than $V_p$ if and only if $Cr_1$ is larger than $Cr_2$. At $fr_1$, the ratio of V1a $V_p$ is $$V_{1a}/V_p=Cr_1/Cr_2$$

Figure 41B:
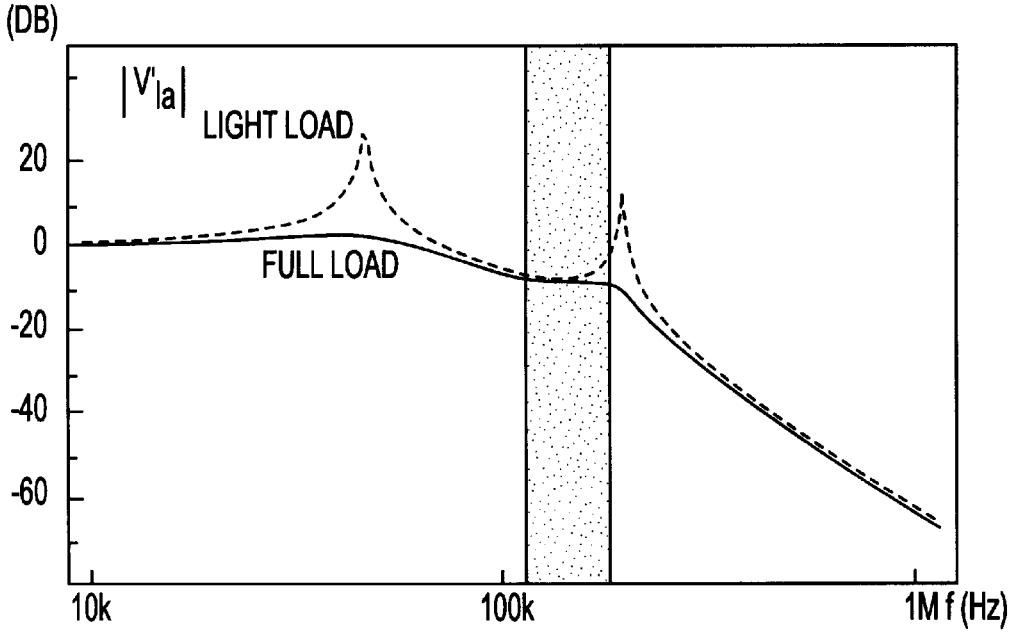
Figure 42:
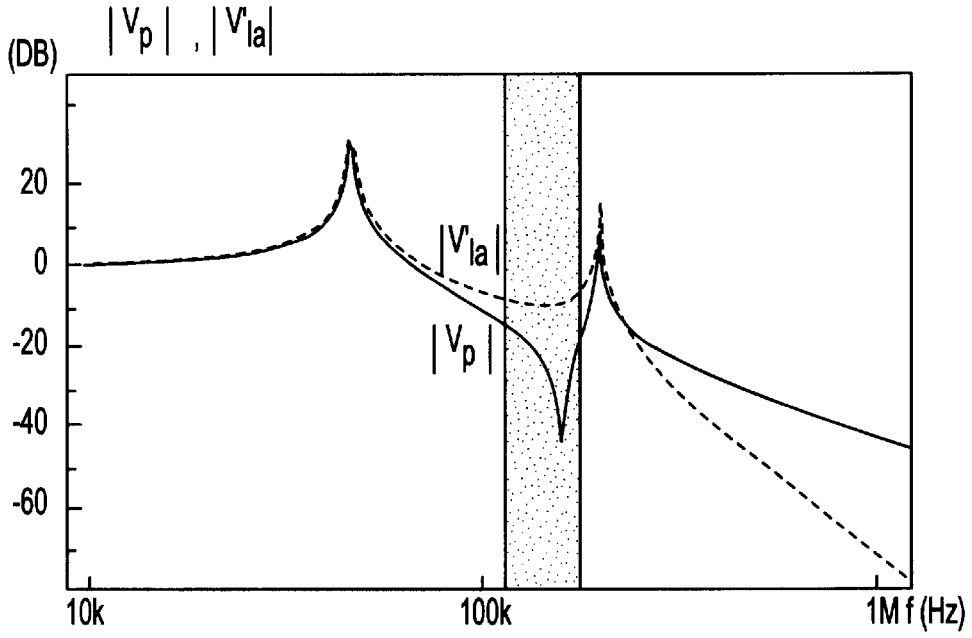
FIG. 42 shows a bode plot of a comparison of $V_p$ and $V_{1a}$ at light load.

In practice, the operating frequency can be set in the shadow areas shown in FIGS. 41A and 41B. Under heavy load, $V_p$ can be large since it is close to $V_{1a}$. So the input power is large. Under light load, $V_p$ can be small because it is much smaller than $V_{1a}$. Then, the input power is small. As a result, $V_{dc}$ at a light load need not increase. The sufficient lamp voltage and small enough $V_{dc}$ at light loads can be obtained at the same time. It is noted that the shadow areas shown in FIGS. 41A and 41B include two resonant points: $fr_1$ and $fr_2$, where $fr_2$ changes with the line voltage.

Combining the methods of decreasing Cin and decreasing $V_p$ is also feasible. Two additional inductors (Lin and $Lr_2$) introducing the second-stage resonance can be coupled into one. However, the design becomes complicated.

Design for Reducing $V_{dc}$ at Light Loads in the Discharge Lamp Ballast

Strategy I: high frequency second-stage resonance (HFSR) technique with instant start-up The basic idea is to provide sufficient preheating for the lamp filaments. At the same time, the dc bus voltage at the preheat mode is limited to a low level by applying the second-stage resonance technique. As shown by experiments, the voltage and the time required for the lamp ignition can be greatly reduced if the filaments are sufficiently preheated. In this case, if we instantly sweep the frequency to the ignition point $fs_2$ (see FIG. 37) at the end of the preheat mode, it is very possible to ignite the lamp in a few switching cycles. Therefore, $V_{dc}$ can be far below its steady state value when the lamp is lit on. Since the lamp characteristics vary according to the temperature, aging, gas pressure etc., the lamp may not be turned on under certain circumstances when $V_{dc}$ reaches the limit. So the restart and protection circuit is necessary. The technique can be further implemented in the following manner.

Reducing $V_{dc}$ at the Preheat Mode by Employing the High Frequency Second-Stage Resonance (HFSR)

The preheating of the filaments is very important to the discharge lamp. Insufficient preheating will require higher voltage to ignite the lamp, and may cause improper start-up of the discharge lamp which shortens the lamp life.

Usually, the lamp voltage at the preheat mode in a ballast circuit shown in FIG. 27 should be large enough to provide the sufficient preheating current. According to the above analysis, however, a low $V_p$ is required in order to maintain a low $V_{dc}$ at the preheat mode.

To reconcile these two contradictory requirements, the second-stage resonance technique introduced above can be applied. The preheating frequency is set close to the second-stage frequency $fr_2$. Since the preheating frequency can be much higher than the normal operating frequency, the size of the additional resonant components required for the second-stage resonance is small. This technique will be referred to as high frequency second-stage resonance (HFSR) in the later discussion. By applying the technique introduced above and illustrated in FIGS. 38A–38B and 39A–39B, the equivalent Cin at the preheat mode is reduced, and the input power flowing through the Cin branch can be small even if $V_p$ is large. As a result, $V_{dc}$ is low. Since the Cin branch at the preheat mode has little effect on the resonant tank, a high lamp voltage can be easily obtained by adjusting Lr or Cr. Due to the modulation of Lin, the equivalent capacitance of the Cin branch at a normal operating frequency is higher than the pure capacitor (as shown in FIGS. 38A and 38B). Consequently, a smaller input capacitor can be used. The efficiency at a full load can be improved. However, Lin also distorts the input current shape. Too large a magnitude for Lin is not desired.

If the technique introduced above and illustrated in FIGS. 40A–40B is applied, a low $V_{dc}$ and relatively high lamp voltage can be obtained at the same time. Due to the high $fr_2$, the value of $Lr_2$ is usually small. $Lr_2$ can be integrated into the leakage inductance of the isolation transformer. The magnetic component number in the circuit does not increase. The additional cost is negligible.

Restart and Protection Scheme

Figure 43:
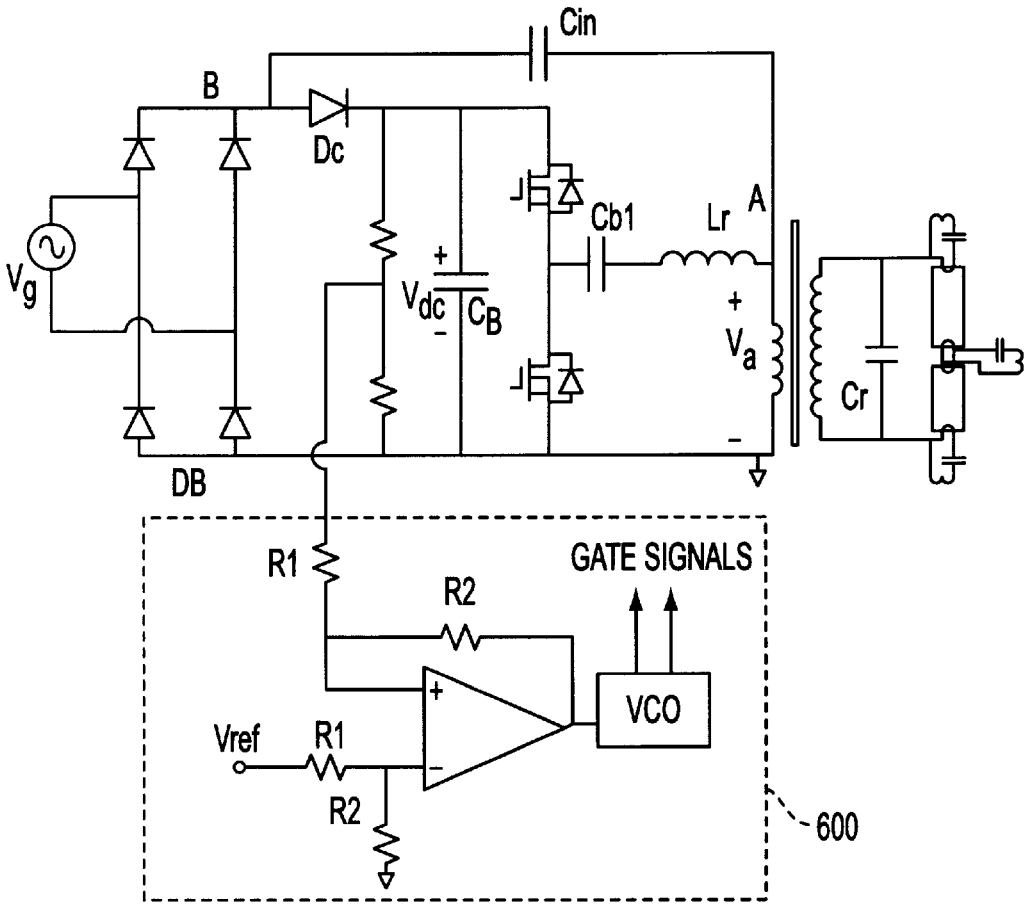
FIG. 43 shows an example of a protection circuit.
Figure 44A:
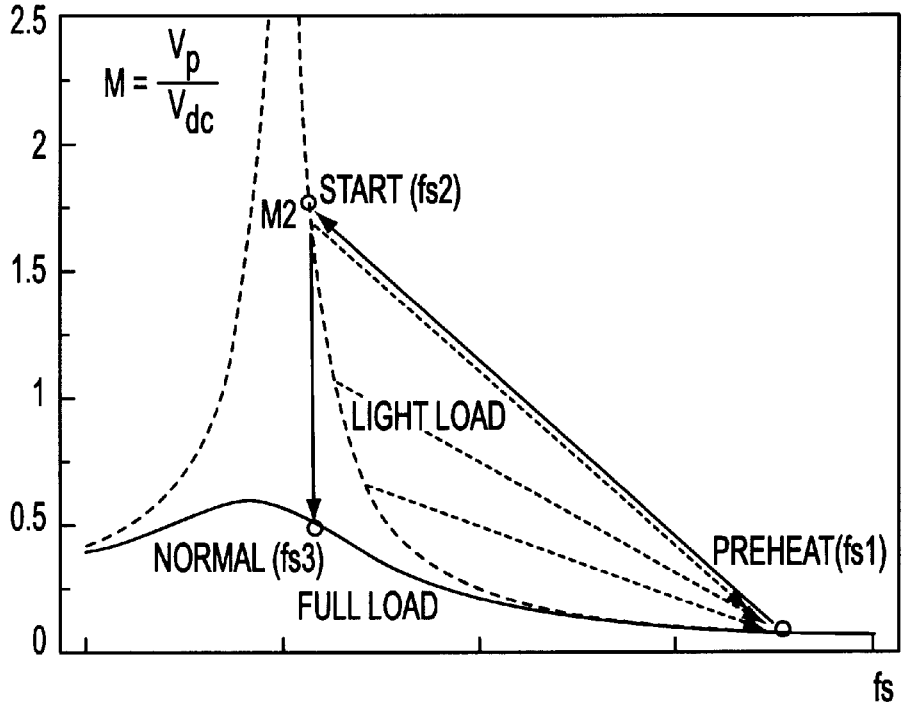
FIGS. 44A and 44B show schematic and principle waveforms for a restart and protection circuit.
Figure 44B:
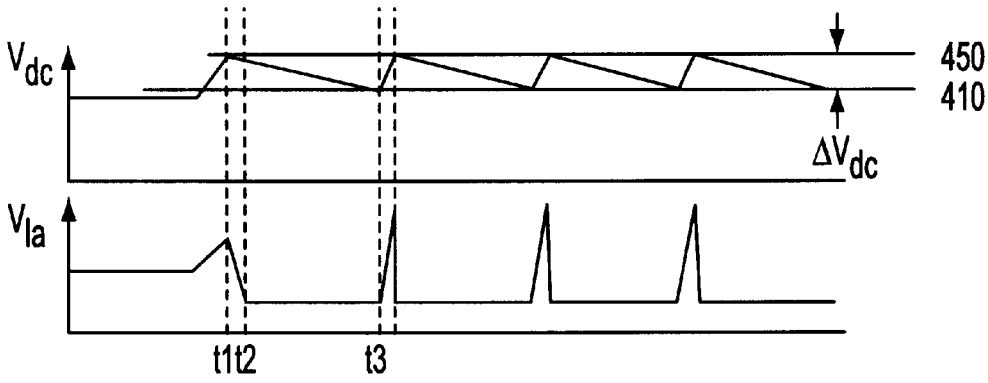

As mentioned before, under sufficient preheating, an instant start can ignite the lamp before $V_{dc}$ rises high. However, under some circumstances, such as low temperature, end of lamp life, etc., a higher lamp voltage and longer time are required to ignite the lamp. It is possible that the lamp is not ignited when $V_{dc}$ reaches the limit. So the restart scheme is necessary. Besides, when the lamp fails (e.g., evacuated or operated with emitter-less), the circuit will operate at extremely light load conditions. Since the ignition-frequency and the normal operating frequency are much lower than $fr_2$, the HFSR technique does not protect the semiconductor devices from suffering high voltage stress under these circumstances. So the protection circuit is needed. The protection circuit 600, the restart scheme, and the principle waveforms are shown in FIGS. 43, 44A and 44B.

The basic idea of the protection and restart scheme is to sense the dc bus voltage. Once the circuit 600 detects the $V_{dc}$ level to be higher than the maximum allowable level, say 450 V, the timing resistor of the control is reduced. Therefore, the frequency is pushed to the preheating frequency $fs_1$. $V_{dc}$ will drop down gradually. Once $V_{dc}$ drops below a certain value, say, 410 V, the lamp can be restarted by sweeping the switching frequency from $fs_1$ to $fs_2$ very quickly, just like in the normal starting procedure. The hysteresis, $\Delta V_{dc}$, is determined by the R2/R1 in FIG. 43. If the lamps cannot be ignited within a certain number of times of the start-up attempts, the circuit can be shut down.

Since the voltage determining the ignition of the lamp is the peak value instead of the rms value, the spikes on the lamp voltage (shown in FIG. 44B) will help in starting the lamps. This is similar to the lamp waveform in the low frequency ballast which uses the saturation transformer to help ignite the lamp.

Strategy II. "Low" Frequency Second-Stage Resonance (LFSR) Technique

With the HFSR techniques, the second-stage resonance frequency $fr_2$ is much higher than the first-stage resonance frequency, $fr_0$, the voltage gain around $fr_2$ is not high enough to ignite the lamp and to maintain the lamp lighting. So the start-up frequency has to be much lower than $fr_2$. Therefore, the HFSR technique cannot lower the steady state dc bus voltage at the start-up mode, an alternative is to consider moving the second-stage resonance peak close to the first-stage resonant peak, $fr_0$. This technique is referred to as "low" frequency second-stage resonance (LFSR) in the following discussion.

Figure 45A:
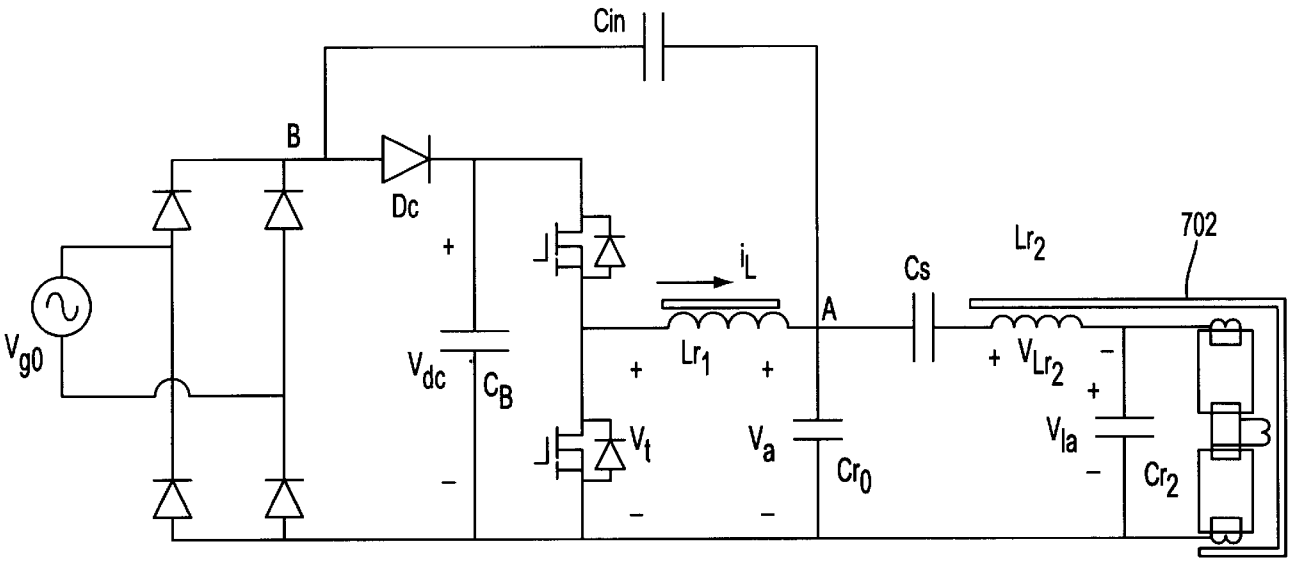
FIGS. 45A and 45B show an example circuit for implementing the LFSR technique.
Figure 45B:
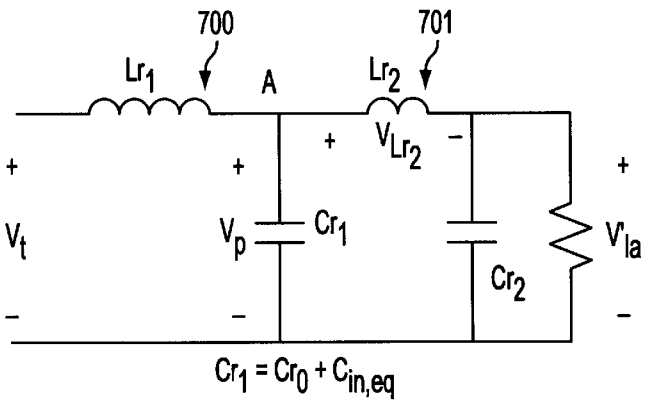

FIGS. 45A and 45B show the circuit diagrams. The approximate ac equivalent circuit consists of two LC resonant stages via resonant tanks 700, 701. The blocking capacitor, $C_s$, moves the lamp side to reduce its conduction loss and to reduce the maximum voltage across the input capacitor, Cin. $Lr_2$ and $Cr_2$ form a parallel resonant tank 701. Through proper design, $Lr_2$ and $Cr_2$ can provide the desired lamp voltage. Meanwhile, $V_p$, the ac amplitude of $V_a$, can still remain roughly half of $V_{dc}$ to obtain a good input power factor. Therefore, a transformer is no longer needed, and thereby, eliminated if the isolation is not required. In addition, the filament windings if the lamp can be coupled to $Lr_2$ 702. The reason for doing so will be explained later.

Since the LFSR technique requires a large additional inductor (Lin or $Lr_2$), the technique designed to reduce Cin becomes impractical because a large magnitude for Lin usually causes the distortion of the line current. Therefore, the technique of reducing $V_p$ is the only candidate for the LFSR technique.

Figure 46A:
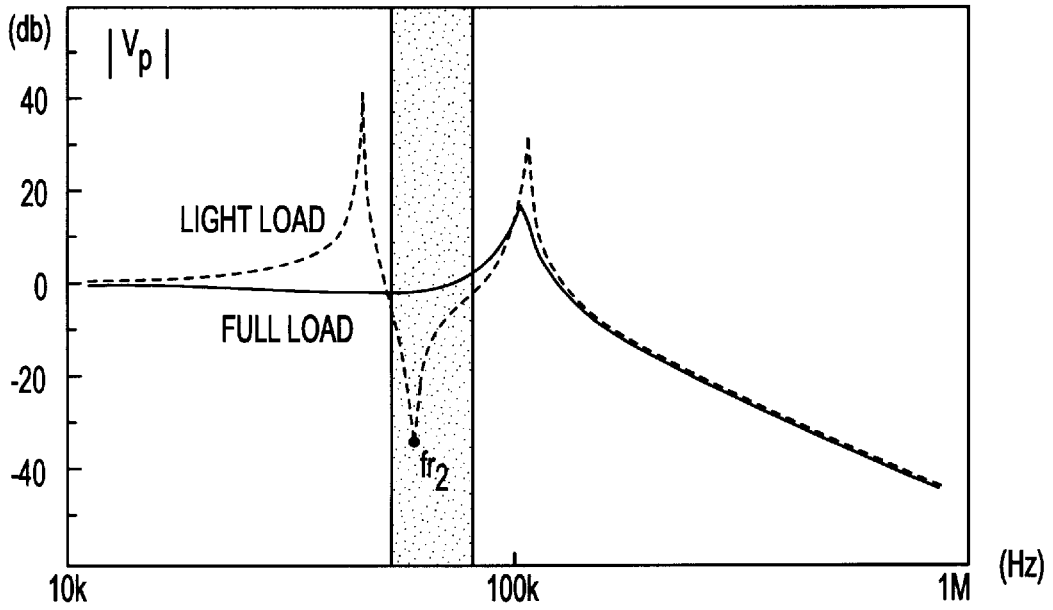
FIGS. 46A and 46B show bode plots of normalized $V_p$ and $V_{1a}$.
Figure 46B:
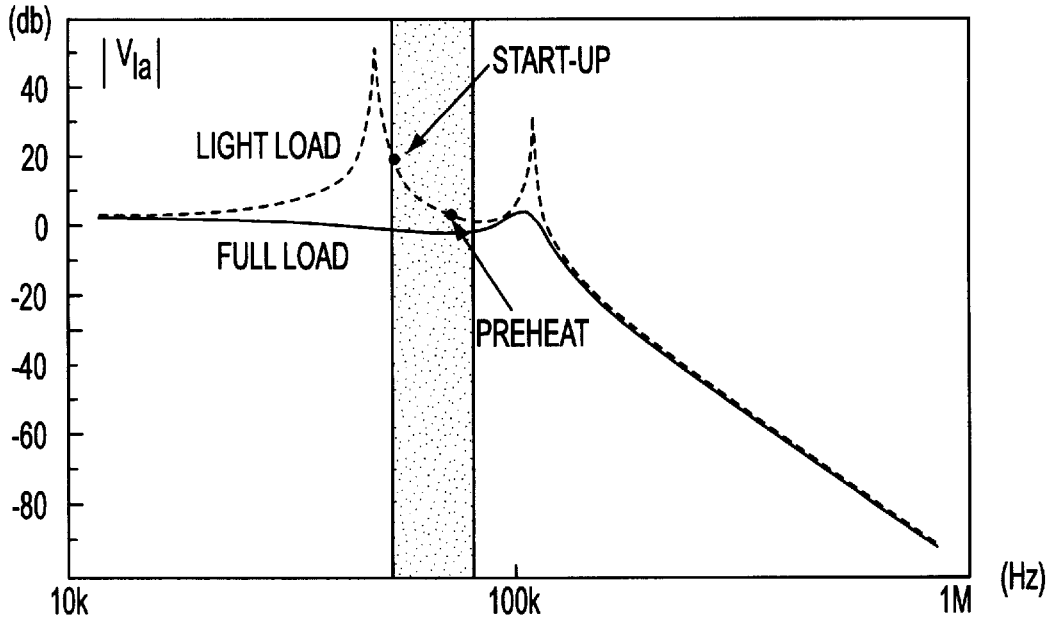
Figure 48A:
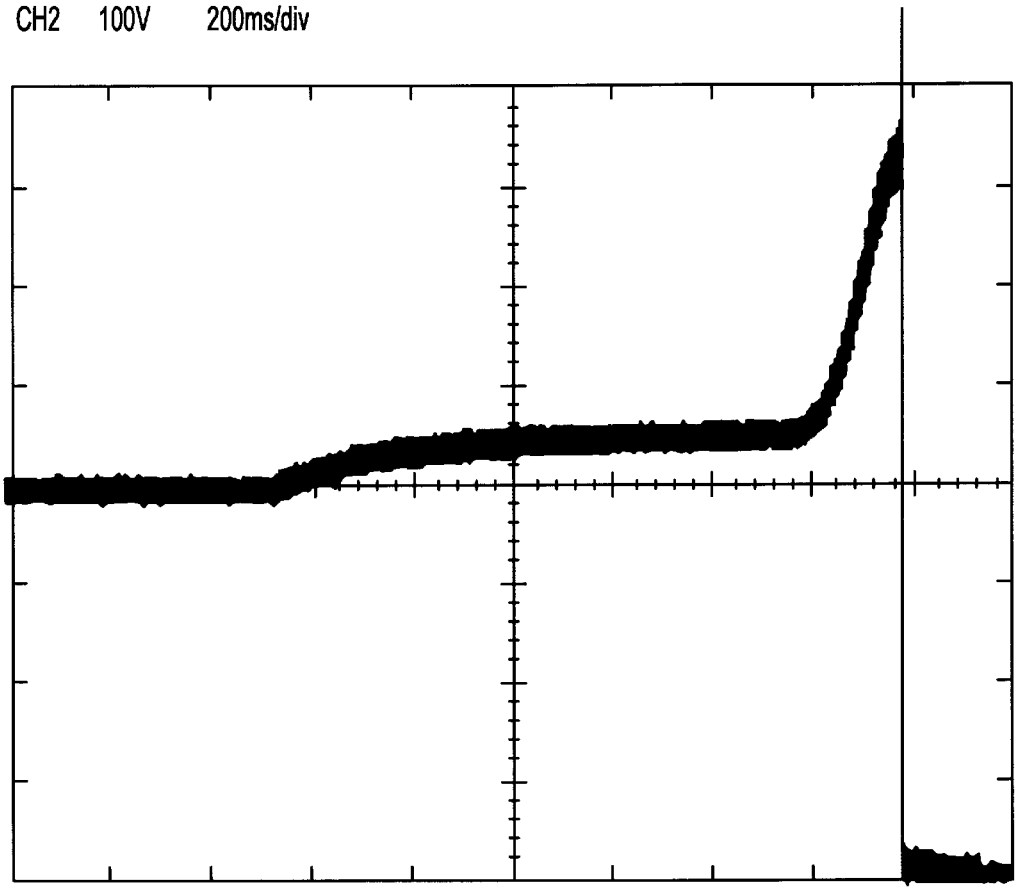
FIG. 48A shows a graph illustrating the experimental results conducted with the circuit illustrated in FIG. 27.
Figure 48B:
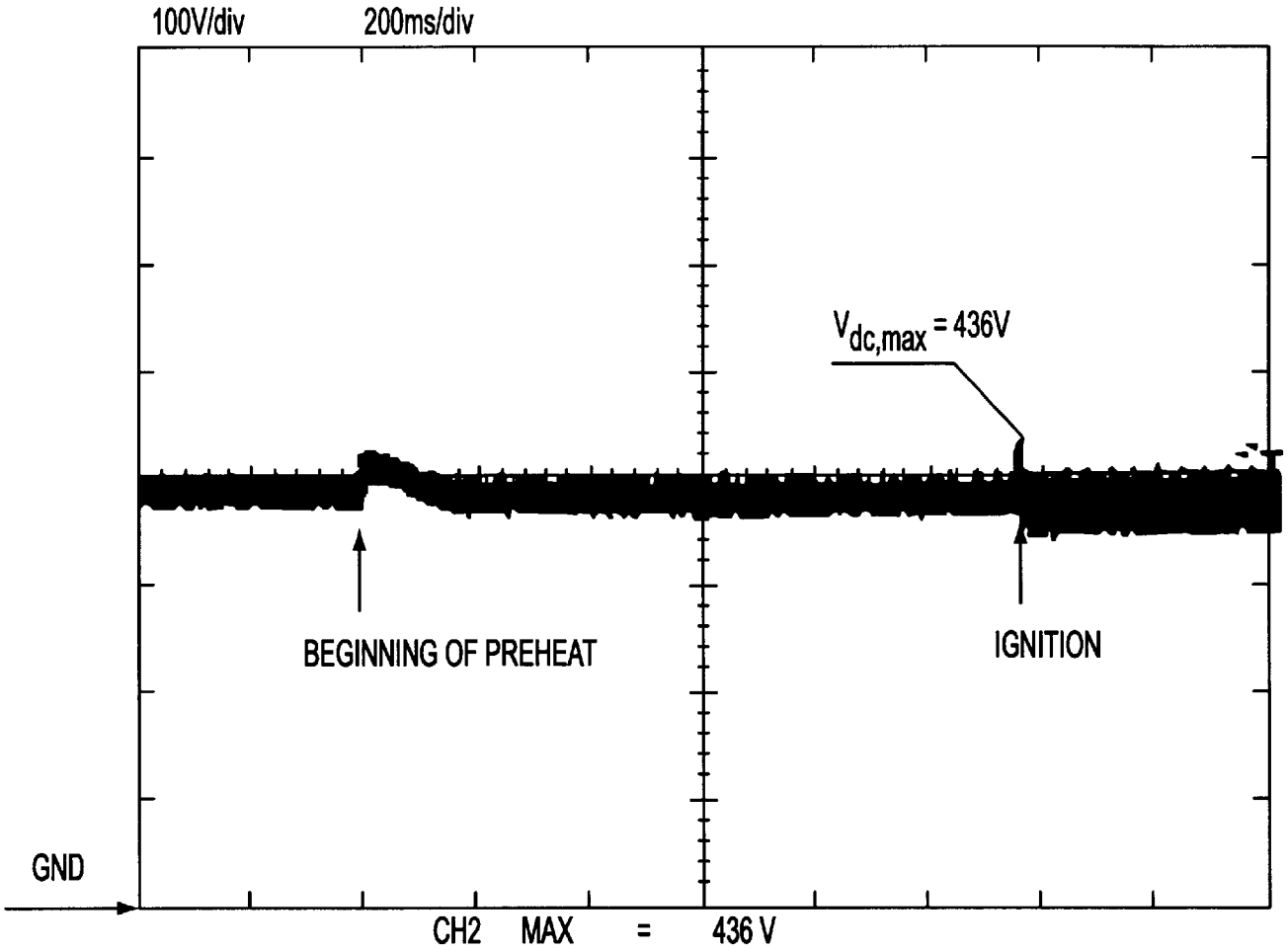
FIG. 48B shows a graph illustrating the experimental results of Strategy I by reducing Cin.

FIGS. 46A and 48B show plots of normalized voltages under light load and fall load. It is preferable to operate the circuit at the frequency inside the shaded areas in FIGS. 46A and 46B. It should be noted that $V_p$ at light load is always lower than that at full load inside the shaded area. Through proper design, low $V_{dc}$ at light loads can be achieved. In addition, $V_{1a}$ at light load is always higher than that at full load; the high lamp voltage required for a low output power operation is also obtained.

Figure 47:
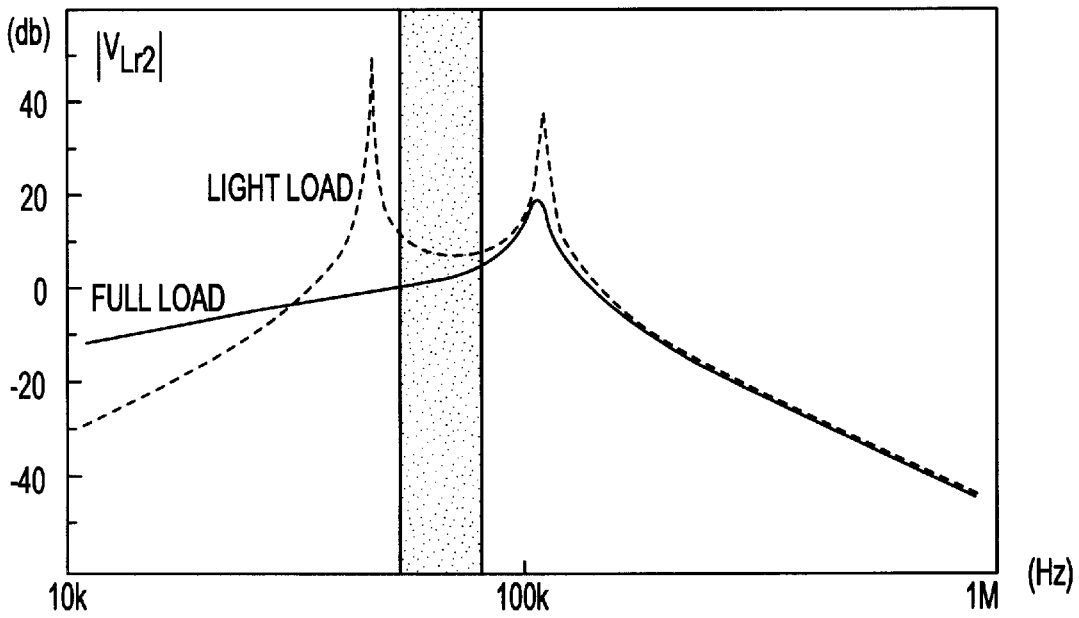
FIG. 47 shows a bode plot of a normalized $V_{L2}$.

The filament windings of the lamp in this circuit are coupled to $Lr_2$ (FIG. 45A). The purpose is to reduce the filament power loss at full load. As shown in FIG. 47, inside the shaded area, $V_{L12}$ at light load is larger than that at full load. Therefore, the filament current at full load can be reduced.

Although the LFSR technique increases the size of $Lr_2$, it can greatly reduce the size of $Lr_1$. The reason is that $V_p$ at the startup mode is much smaller than that with high frequency second-stage resonance technique. The volt-seconds applied on $Lr_1$ at the startup mode are reduced dramatically. Therefore, the maximum inductor current decreases significantly. The size of $Lr_2$ can be much smaller.

The major advantage of this strategy is that high voltage can be continuously impressed on the lamp during the lamp start-up mode without facing the possibility of the running away of $V_{dc}$. In case of the lamp failure, the light load characteristics automatically prevent $V_{dc}$ from rising high. The reliability of the electronic ballast improves. In contrast, the HFSR technique has to rely on the protection circuit when the lamp fails. Moreover, the proper ignition of the lamp very much depends on the control circuit parameters and the lamp characteristics. In practice, since these component parameters are discrete, the ignition time varies from lamp to lamp. It may become an annoying experience if it takes dozens of restart attempts (usually it takes several hundred milliseconds for one restart attempt) to turn on a lamp. Unsynchronized ignitions of the different lamps in a large room can also become a mental nuisance.

Experiments were carried out to verify the proposed strategies of reducing the dc bus voltage at light loads. Two FHF32 lamps (manufactured by Matsushita) were used. This type of lamp requires 0.4 A rms preheating current (for 1 second preheat time) and 400 V rms per lamp ignition voltage (107 V rms per lamp for 45 W output power). The input line voltage is 277 V rms or 392 $V_{peak}$. The goal was to limit the maximum $V_{dc}$ at startup instant to be less than 450 V.

The experimental result of the original circuit (FIG. 27) is shown in FIG. 48A. With 450-V DC bus voltage at the preheat mode, the preheating current was still insufficient. So, when the circuit entered the startup mode, $V_{dc}$ ramped up all the way to 900 V. Since the MOSFET's (BUK436-800A) are 800V devices, they blew up, due to the overvoltage. The components were chosen as follows: Cin=30 nF, Lr=470 uH, Cr=10 nF, and the transformer primary/secondary turn ratio=1:1.8.

Experimental results of Strategy I: HFSR with instant startup

Both second-stage resonance techniques were carried out. Under room temperature, both methods achieve the desired low $V_{dc}$ at start-up instant.

Reducing Cin at the Preheat Mode

FIG. 48B shows the experimental result of the circuit shown in FIG. 38A. The components were chosen as follows: Cin=20.6 nF, Lin=100 uH, $Cin_1$=10 nF, Lr=520 uH, Cr=1 nF, the transformer turns ratio=1:1.8. Due to the modulation of Lin, the equivalent Cin is larger than its real value at the normal operating frequency (see FIG. 38A). So Cin is smaller than that calculated by Eq. (14). The preheating current of more than 600 mA was achieved at a frequency of about 120 kHz. The steady-state $V_{dc}$ at the preheat mode was about 385 V.

The bump of $V_{dc}$ shown in FIG. 48B at the beginning of the preheat mode can be reduced by "soft-start": the frequency is set to a frequency higher than $fr_2$, e.g., 200 kHz, in the beginning of preheating, and then gradually swept to $fr_2$, e.g., 120 kHz. As shown in FIG. 48, the maximum $V_{dc}$ at the preheat and start-up modes is only about 436 V.

Reducing $V_p$ at the Preheat Mode

Figure 49:
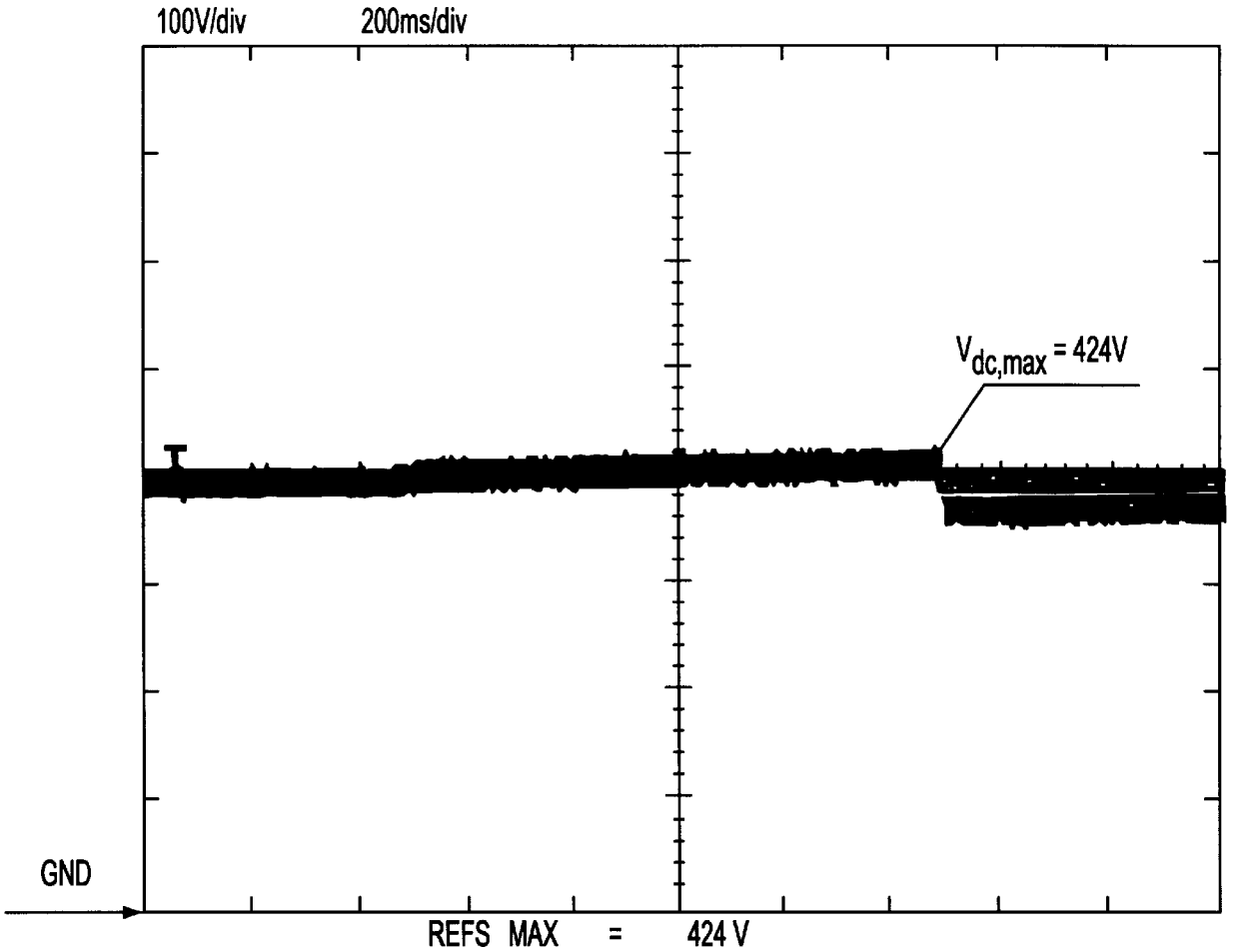
FIG. 49 shows a graph illustrating the experimental results of Strategy I obtained by reducing $V_p$.

The circuit shown in FIG. 40A was implemented to reduce $V_p$ at the preheat mode. FIG. 49 shows the experimental result. In this experiment, the components were: $Lr_1$=500 uH, $Cr_0$3.3 nF, Cin=28 nF, $Lr_2$=100 uH, Cb=47 uF (450 V), $Cr_2$=1.5 nF, the transformer turns ratio=1:1.82. The preheating current of about 480 mA was achieved at the frequency of about 150 kHz. The steady state Vdc at the preheat mode was about 405 V. Under instant start-up, the maximum $V_{dc}$ at ignition instant was about 424 V.

Experimental Results of Strategy II: LRSR technique

Figure 50:
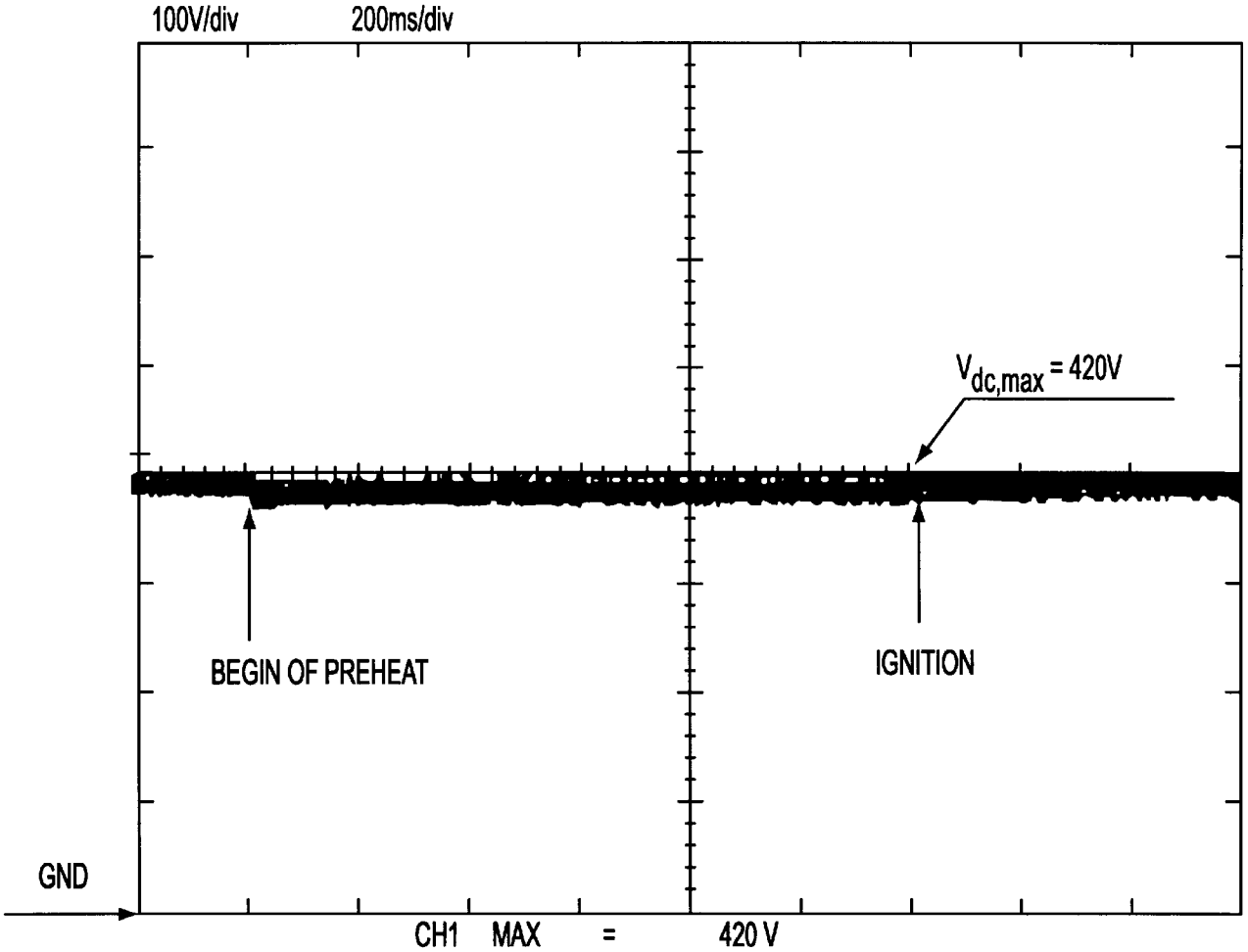
FIG. 50 shows a graph illustrating the experimental result of Strategy II.

The circuit shown in FIG. 45A was carried out. FIG. 50 shows the experimental result. The components were chosen as: $Lr_1$=520 uH, $Cr_0$=10 nF, $Lr_2$=710 uH, Cr=12 nF and Cin=36 nF. The preheating frequency was 55 kHz, the ignition frequency was 47 kHz. Steady-state $V_{dc}$ was 385 V at preheat mode and 450 V at the startup mode. The preheating filament current was about 480 mA. From FIG. 50, it is shown that the maximum $V_{dc}$ at startup instant is only about 420 V.

Strategy I, which applies the HFSR technique to reducing $V_{dc}$ at the preheat mode and adopts the instant start-up to limit the maximum $V_{dc}$, proves to be effective in the lab. The extra cost due to the additional components is negligible. Since this strategy cannot reduce the steady state $V_{dc}$ at startup, a rather complicated protection and restart scheme has to be adopted. In contrast, Strategy II, the "low" frequency secondary resonance technique, can limit steady state $V_{dc}$ under any load conditions. The reliability improves. Control is simple. If the isolation is not required, the power transformer can be eliminated The magnetic component number (in FIG. 45A) does not increase. The cost increase can be justified.

Eleventh Embodiment of the Invention

Because of the existence of Cin, $V_a$ is affected by the line voltage. 120-Hz ripple is imposed on the envelope of $V_a$. Thus, the crest factor of the lamp current is high. In addition, the condition for the unity power factor, $2V_p=V_{dc}$, cannot be satisfied all the time in a complete line cycle. As a result, the input current is not purely sinusoidal, and the THD of the input current increases.

By applying the LFSR technique discussed above, the waveform of the lamp current can be near sinusoidal because of the second filter stage: $Lr_2$ and $Cr_2$. However, there is still the 120-Hz ripple on the envelope of $V_a$. The input current waveform is still distorted. Since this 120-Hz ripple is amplified by the second LC stage, the crest factor of the lamp current can be very poor.

Figure 51A:
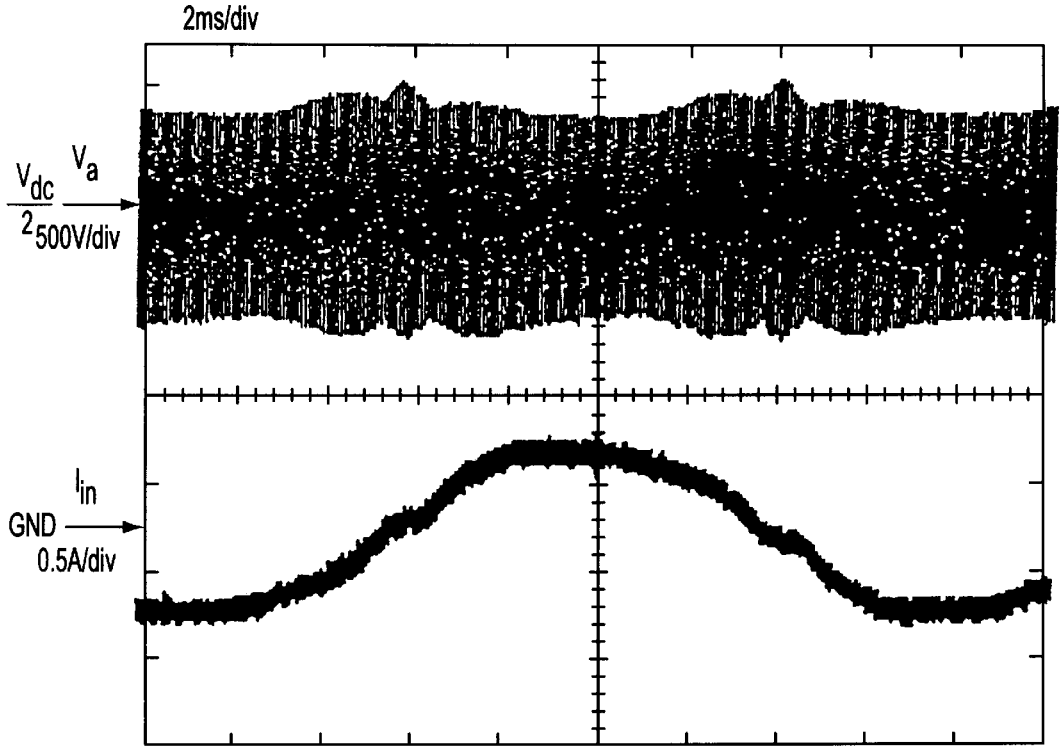
FIGS. 51A and 51B show graphs illustrating experimental waveforms of the LFSR technique.
Figure 51B:
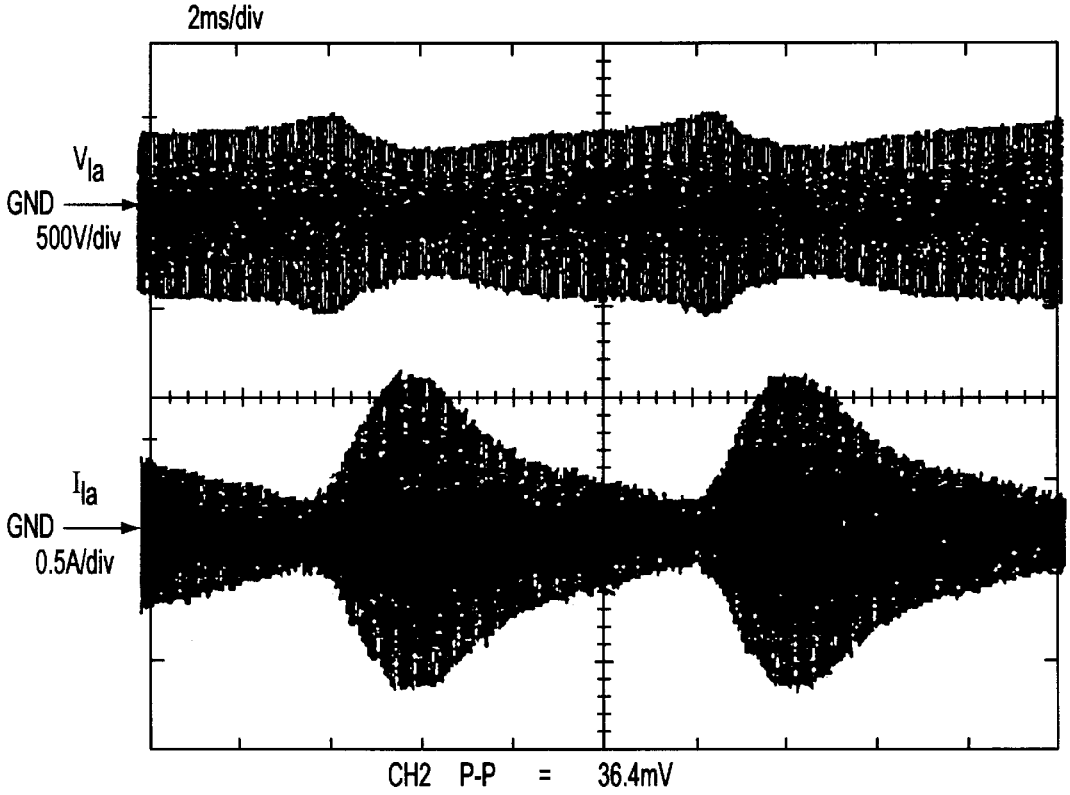

FIGS. 51A and 51B show the experimental waveforms of the input current, lamp voltage and lamp current. The power factor was measured to be 0.98, the THD was 10.4% and the crest factor of the lamp current was about 2.4. The components were: Cin=36 nF, $Cr_0$=10 nF, uH, $Cr_2$=12 nF and $Lr_2$=710 uH. The preheating frequency was 55 kHz. The steady state $V_{dc}$ is 387 V. The ignition frequency was designed to be 47 kHz, and the corresponding steady state $V_{dc}$ was 450 V. The normal operating frequency was 40 kHz, and the lamp output power was about 80 W.

Figure 52:
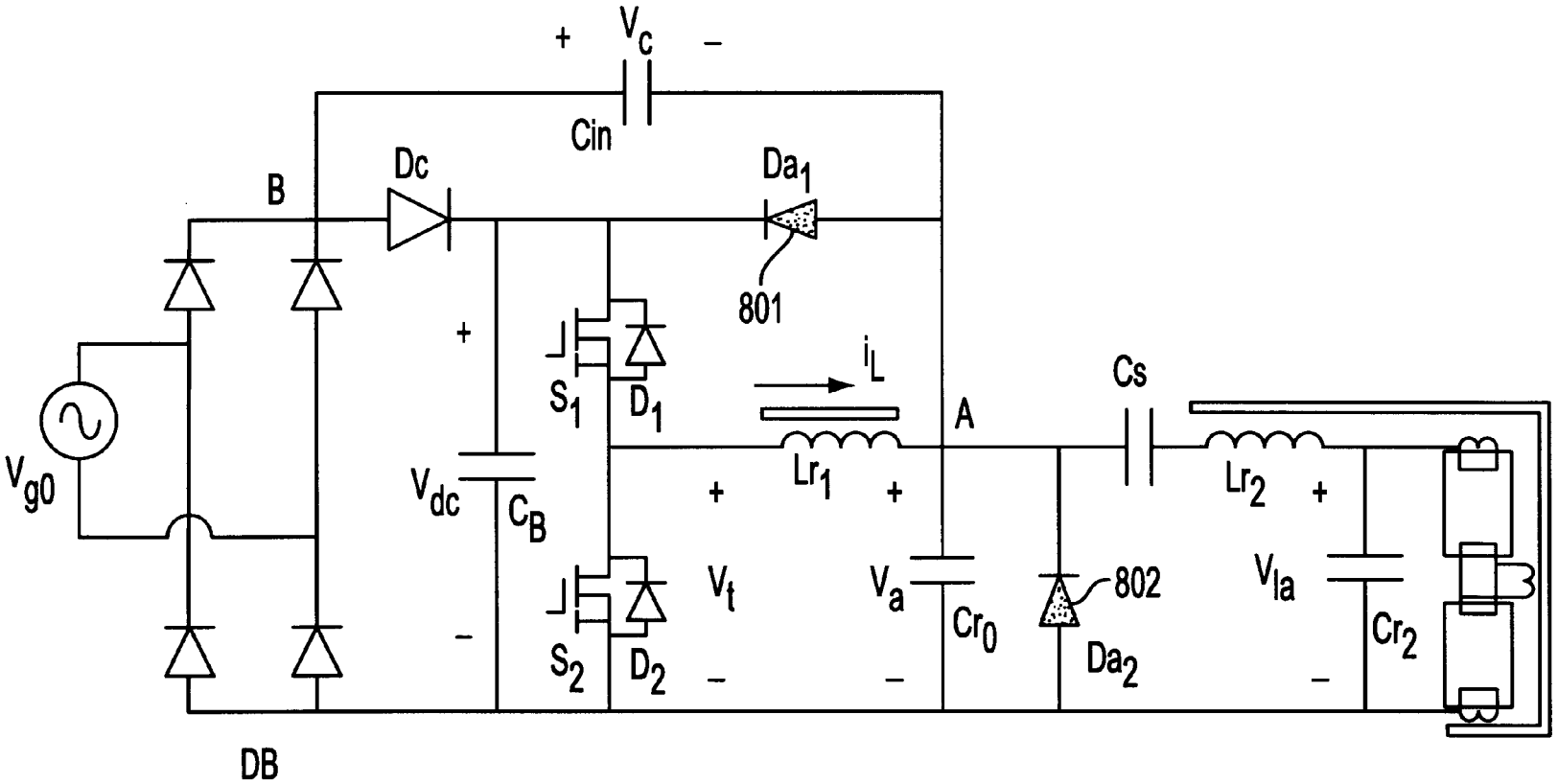
FIG. 52 shows a modified circuit for implementing the LFSR technique.

Since the reason for the high THD of the input current is the 120-Hz ripple on the envelope of $V_a$, the input current waveform can be improved if the envelope of $V_a$ is smoothed out. If the circuit shown in FIG. 45A is designed so that the envelope of $V_a$ is always larger than the dc bus, i.e., $2V_p>V_{dc}$, simple diode clamping technique can be applied. The proposed circuit is shown in FIG. 52. Compared to the circuit shown in FIG. 45A, two extra diodes, $Da_1$ 801 and $Da_2$ 802, are added to clamp the envelope of $V_a$.

Figure 53A:
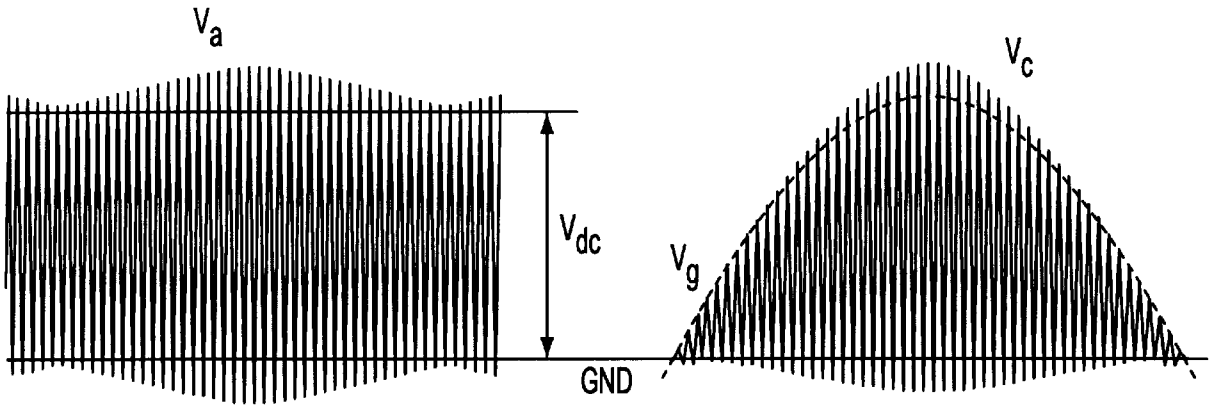
FIGS. 53A and 53B illustrate waveforms of $V_a$ and $V_c$.
Figure 53B:
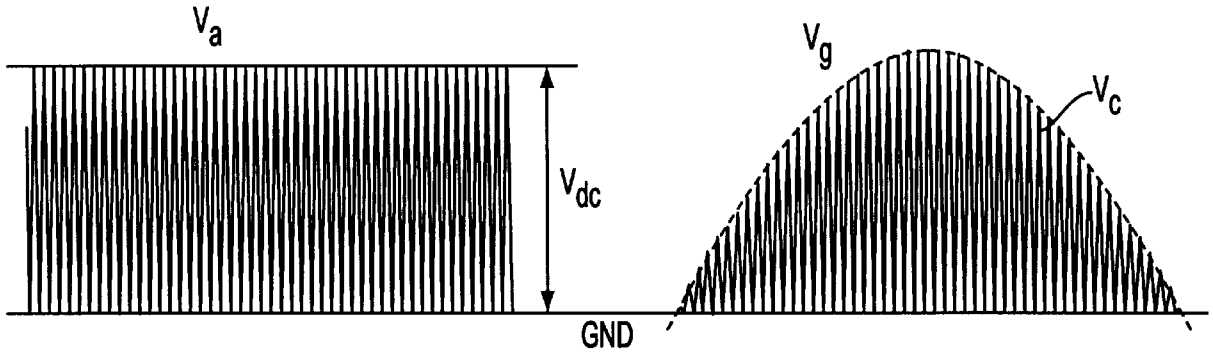

The key waveforms of the circuit according to the eleventh embodiment of the present invention are described in FIGS. 53A and 53B. Without the diodes $Da_1$ and $Da_2$, the circuit is designed so that the peak-to-peak value of $V_a$, $2V_p$ (or $V_{a,pp}$), is never smaller than $V_{dc}$. The waveforms $V_a$ and $V_c$ are depicted in FIG. 53A. Under this condition, the input current will not follow the input voltage according to Eq. (6). After adding diodes $Da_1$ and $Da_2$, $V_{a,min}$ =0 and $V_{a,max}=V_{dc}$ result (see FIG. 53B). Correspondingly, we can have $V_{c,max}=V_g$ and $V_{c,max}$=0. Then, the input average current becomes $$i_{in,av}=f_gC_{in}\ (V_{c,max}-V_{c,min})=f_sC_{in}V_g\ V_g \tag{16}$$

Therefore, a good input power factor is automatically obtained without any additional control.

Figure 54:
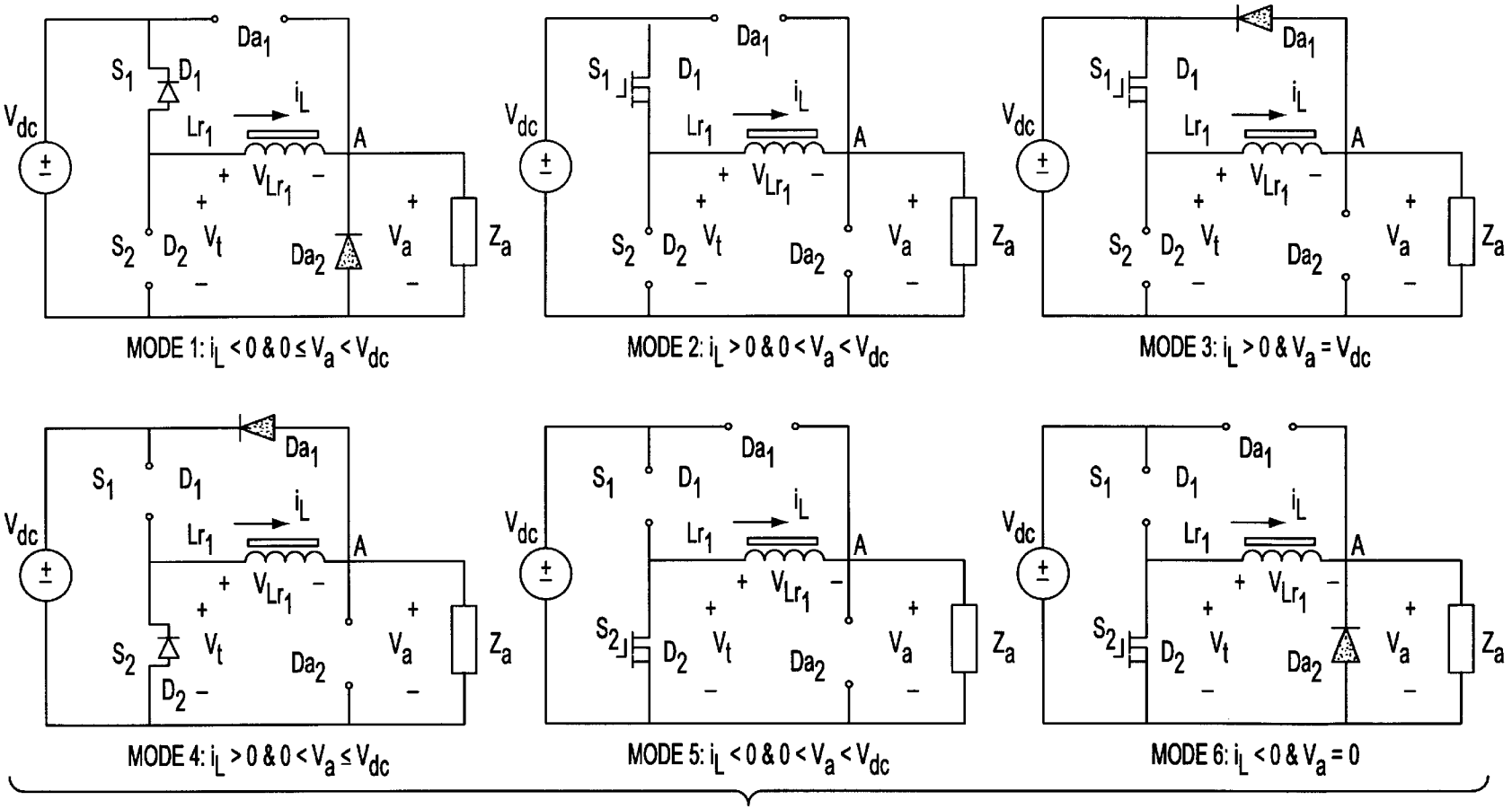
FIG. 54 shows equivalent circuits illustrating the six operation modes in the circuit of FIG. 52.

The steady state operation in one switching cycle includes six types of operation modes in one switching cycle, as shown in FIG. 54. $Z_A$ stands for the impedance seen from node A. The six operation modes are explained as follows.

Mode 1

$S_2$ is off. The negative conductor current flows through $D_1$. $S_1$ can be turned on with ZVS. In this mode, $V_a$ is less than $V_{dc}$. $V_{Lr1}$ is always positive. Consequently, the magnitude of the inductor current $i_L$ decreases. This mode ends when $i_L$ decreases to zero.

Mode 2

$S_1$ conducts. Since $V_a$ is between 0 and $V_{dc}$, both $Da_1$ and $Da_2$ are off. The positive inductor current $i_{Lr1}$ keeps increasing due to the polarity of the inductor voltage. The operation mode ends when $V_a$ $V_{dc}$, or when $S_1$ turns off.

Mode 3 (Clamping Mode)

$Da_1$ and $S_1$ conduct, $V_a$ is clamped to $V_{dc}$. $V_{Lr1}$ is zero; therefore $i_{1r1}$ remains constant. This mode ends when $V_a$ becomes less than $V_{dc}$, or when $S_1$ turns off.

Mode 4

$S_1$ is off, forcing the positive inductor current to flow through $D_2$. Consequently, a ZVS turn-on of $S_2$ is obtained In this operation mode, $V_a$ is always positive. Consequently, the inductor voltage $V_{Lr1}$ is always negative. The inductor current decreases. This mode ends when the inductor current becomes zero.

Mode 5

$S_2$ is on. Neither $Da_1$ nor $Da_2$ conducts. $V_a$ is between $V_{dc}$ and zero. The voltage applied on $Lr_1$ is negative. Therefore, the inductor current keeps increasing in the opposite direction as shown in FIG. 4.4. This mode ends when $V_a$ decreases to zero, or when $S_2$ turns off.

Mode 6 (Clamping Mode)

$V_a$ is clamped to zero. The inductor current freewheels through $Da_2$ and $S_2$. This mode ends when $V_a$ becomes larger than zero, or when S2 turns off. There are many kinds of operation sequences in one switching cycle. The most common one is: Mode 1→2→3→4→5→6.

Through proper design, $Da_1$ and $Da_2$ conduct exactly once in each switching cycle throughout the entire line cycle. The peak to peak value of $V_a$ (2 $V_p$) is then clamped to $V_{dc}$ during the whole line cycle. The proposed circuit will have a near unity power factor, a reduced THD and an improved crest factor. Moreover, ZVS is always ensured even if the original resonant tank (without $Da_1$ and $Da_2$) is operated in the capacitive mode.

Figure 55:
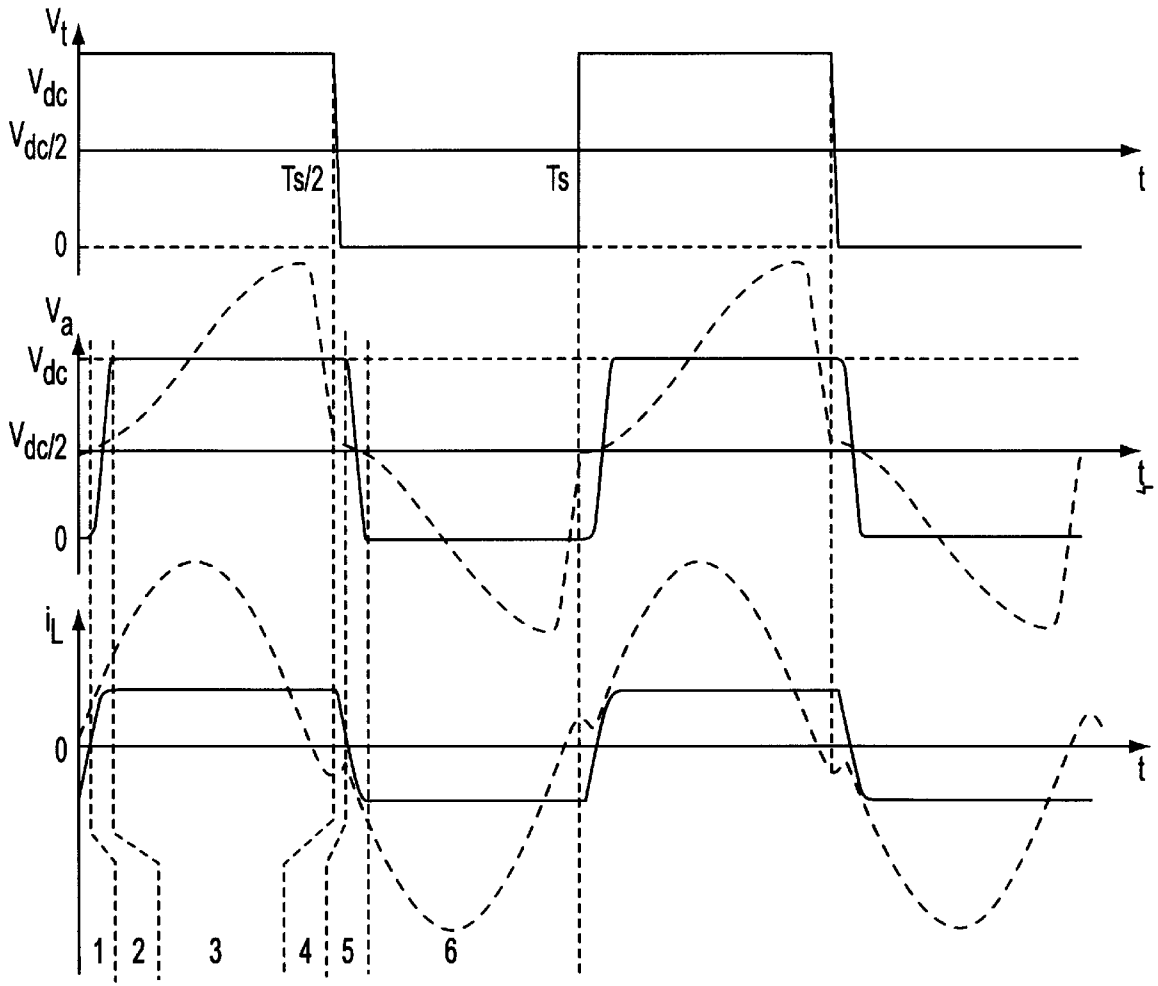
FIG. 55 shows a simulation waveform of the circuit shown in FIG. 52.

Ensured ZVS operation:

Because of the polarity of the voltage applied on $Lr_1$, the magnitude of the inductor current $i_L$ always increases in Modes 2 and 5, and remains constant during Modes 3 and 6. The inductor current is thus always positive at the turn-off of $S_1$ (the end of Mode 2 or 3) and negative at the turn-off of $S_2$ (the end of Mode 5 or 6). Therefore, ZVS turn on of $S_2$ (in Mode 4) and ZVS turn-on of $S_1$ (in Mode 1) are always ensured regardless of whether the original resonant tank (without $Da_1$ and $Da_2$) operates in the capacitive mode or in the inductive mode. This is an improvement upon the original circuit in FIG. 27A. As shown in FIG. 55, the original resonant tank (without $Da_1$ and Da2) is operated in the capacitive mode ($i_L$ leads $V_1$). The dotted trace stands for the waveforms in the circuit without $Da_1$ and $Da_2$; the inductor current $i_L$ leads the tank voltage $V_r$, resulting in the loss of ZVS. With the diodes $Da_1$ and $Da_2$, the inductor current always lags the tank voltage. ZVS is therefore maintained.

Improved power factor and reduced THD of input current:

Since the positive and negative peaks of $V_a$ are clamped to $V_{dc}$ and zero respectively, the peak-to-peak value of $V_a$ always equals $V_{dc}$. From the previous discussion, the good input power factor is always guaranteed. The THD of the input current is very small. This is one major merit of the proposed circuit shown in FIG. 52.

Improved crest factor

Another major merit of this proposed circuit is the improvement of the crest factor of the lamp current. Since the 120-Hz ripple of $V_{dc}$ is negligible, the ac amplitude of $V_a$ can be considered constant over half line cycle. After being filtered out by $Lr_2$ and $Cr_2$, the lamp voltage can be a very good sinusoidal waveform with the roughly constant amplitude. The crest factor of the lamp current is thus reduced.

Figure 56A:
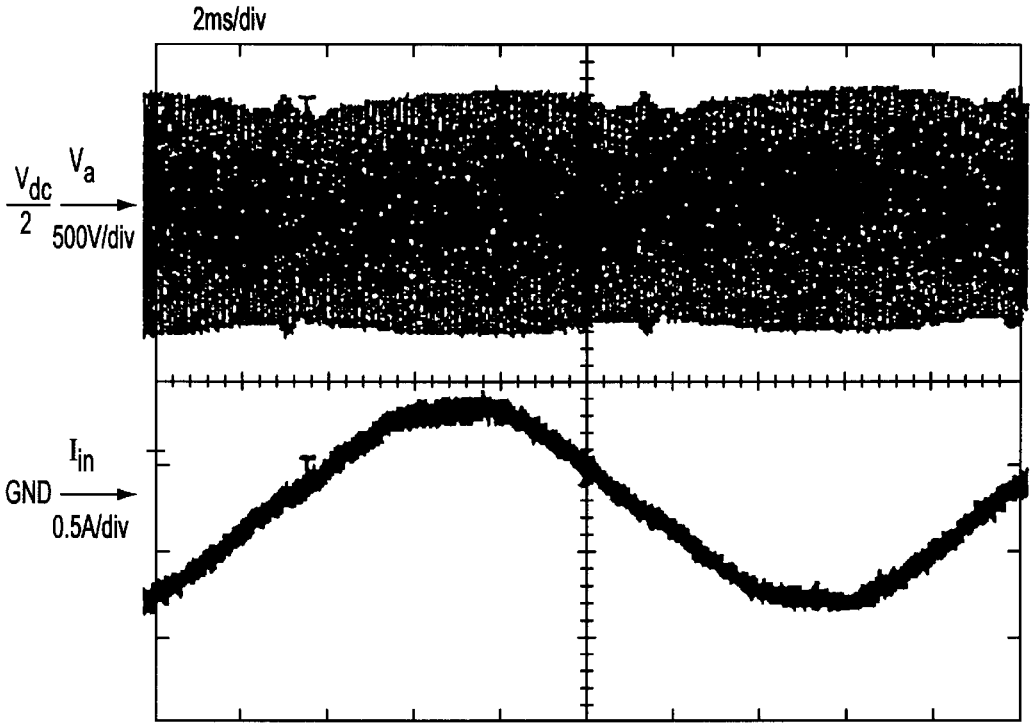
FIGS. 56A and 56B show graphs illustrating the experimental results of the circuit shown in FIG. 52.
Figure 56B:
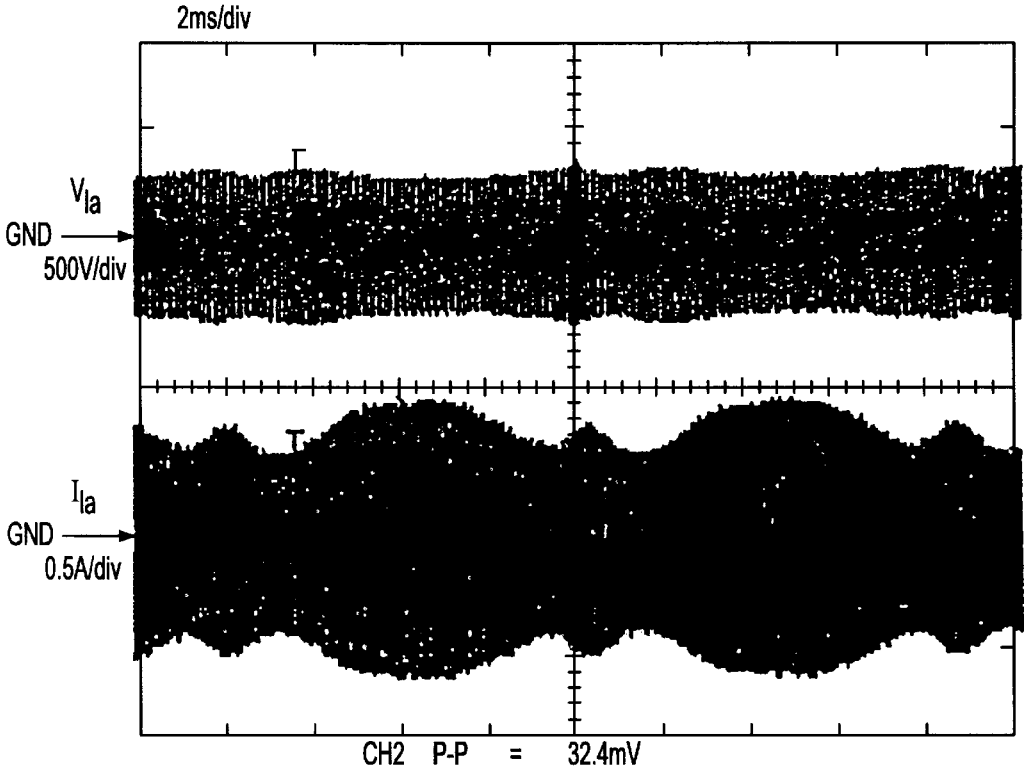
Figure 56A:
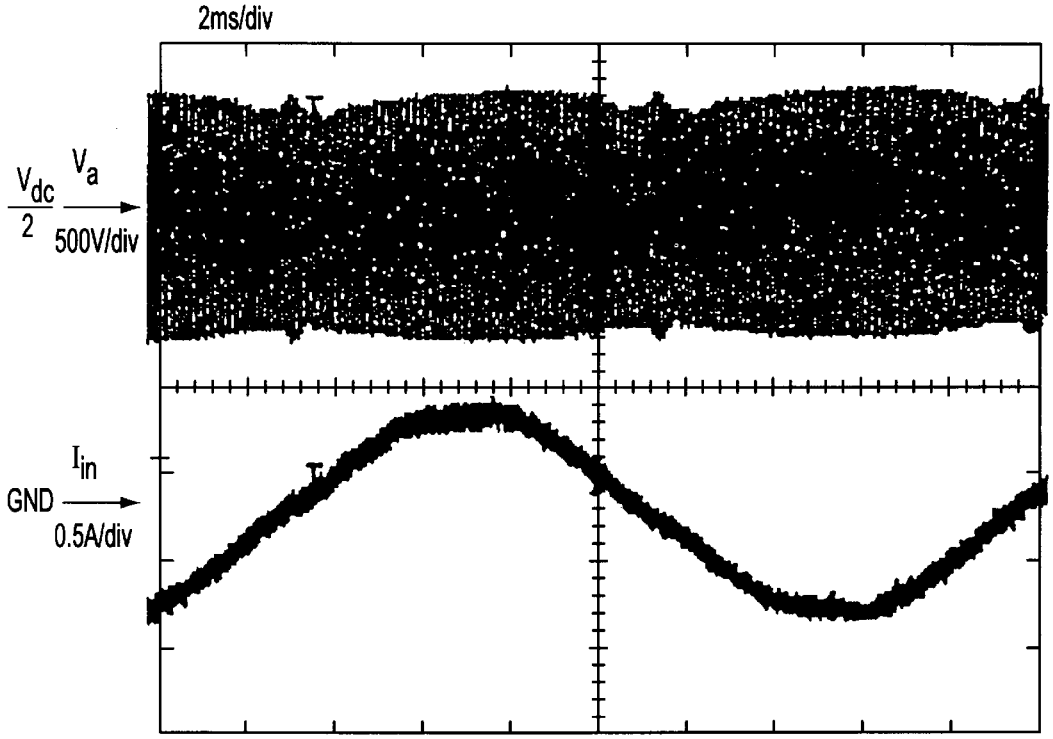
Figure 56B:
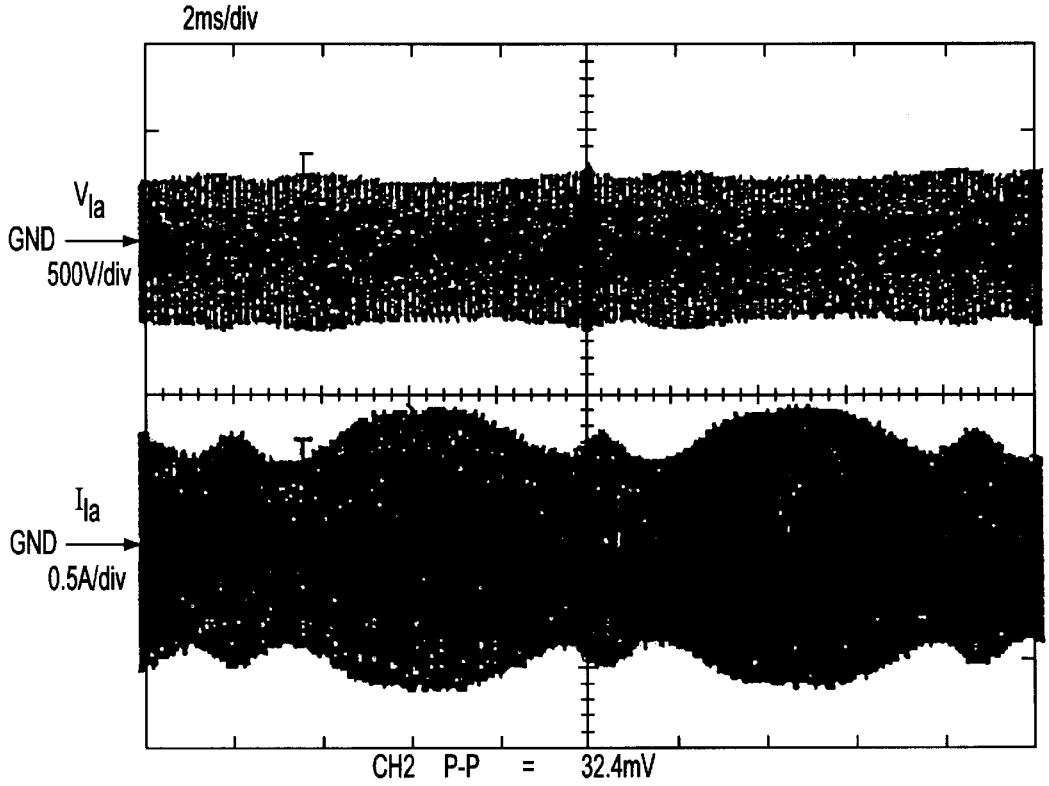

FIGS. 56A and 56B show the experimental waveforms of the input current, $V_a$, lamp voltage and lamp current. The components were chosen as follows: $Lr_1$=400 uH, $Cr_1$=1.2 nF, Cin=30 nF, $Lr_2$=820 uH and $Cr_2$=10 nF. The input line voltage was 277 Vrms, $V_{dc}$ was 397V at the normal operating frequency of 48 kHz. Output power was measured to be 94 W. It can be seen from FIG. 56A that the envelope of $V_a$ is flat over the line cycle and the input current is very close to a sine wave. From FIG. 56B, we can see that the lamp voltage envelope is also flat over line cycle. Consequently, the lamp current amplitude variation is much smaller than that shown in FIG. 51B. The power factor was measured to be 0.995, and THD was 4.3%. The crest factor of the lamp current was greatly reduced. CF=1.62 was measured.

Figure 57:
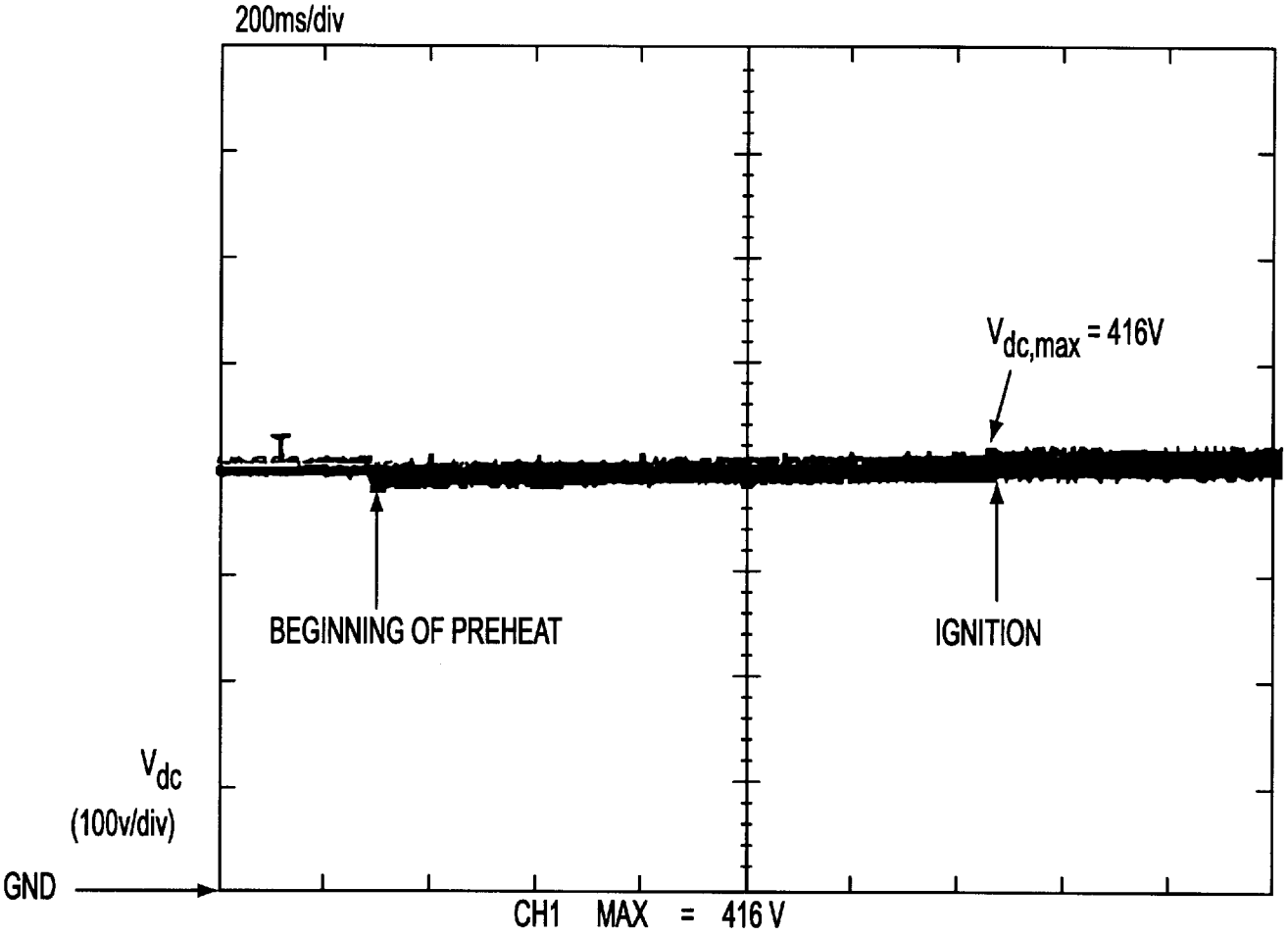
FIG. 57 shows a graph illustrating $V_{dc}$ in the circuit shown in FIG. 52.

FIG. 57 shows the experimental waveform of $V_{dc}$. The steady state $V_{dc}$ for the preheat mode was 392 V at the frequency of 55 kHz, and 420 V at the ignition frequency of 48 kHz. The maximum $V_{dc}$ at the ignition instant was measured to be about 416 V.

By applying the LRSR technique, the proposed circuit reduces the steady state dc bus voltage at light loads including the startup operation mode. With the employment of two clamping diodes, this ballast has a near unity power factor, and a small THD without any additional control. Moreover, the crest factor of the lamp current is reduced to about 1.6. Due to the freewheeling stage introduced by the clamping diodes, the circulating energy in this circuit increases. The efficiency may suffer slightly.

The "charge pump" electronic ballast has become an attractive ballast topology for the discharge lamps because it eliminates the need of the bulky boost inductor. However, the devices in this circuit suffers the high voltage stress under light load conditions; the THD of the input current and the crest factor of the lamp current are high because of the existence of the charging capacitor. To solve these problems, novel techniques of reducing the dc bus voltage at light loads as discussed above can be used; the diode clamping technique has been employed to reduce the THD of the input current and the crest factor of the lamp current.

The general principle of reducing the dc bus voltage at light loads is to employ the second-stage resonance to reduce $V_p$ or equivalent Cin. The HFSR technique can provide sufficient preheating at low $V_{dc}$. Combined with the instant startup and the proper restart scheme, this technique can greatly reduce the maximum $V_{dc}$ at the ignition instant. Experiments show that the HFSR technique can limit the maximum $V_{dc}$ to less than 450 volts with 277 Vrms input line voltage. When the high voltage continuously impresses on the lamp without igniting it, $V_{dc}$ invariably ramps up. The protection and restart circuit has to be activated. Due to the discrete characteristics of the lamps and the ballasts, the lamps in one room may not be turned on at the same time by adopting this kind of technique. It has become a big concern for the ballast product.

The LFSR technique can reduce the steady state $V_{dc}$ at light loads including the start-up mode. Consequently, the high ignition voltage can be continuously impressed on the lamp without increasing $V_{dc}$. The experiments showed that the steady-state dc bus voltage at the start-up mode can be below 450 V (with 277 Vrms input). Although an additional inductor is needed, the size of the original resonant inductor ($Lr_1$) is reduced greatly. The transformer can be eliminated if the isolation is not required.

Due to the influence of the charging capacitor Cin, there exists 120-Hz ripple on the envelope of $V_a$ (the high frequency ac voltage source). By adding two clamping diodes, the envelope of $V_a$ is smoothed out. The experimental results show that the near unity input power factor (>0.99), the low THD of input current (<10%), and the low crest factor of the lamp current (<1.7) can be achieved with the open-loop control.

Tables 1–3 list the performance and components comparison among the original circuit (shown in FIG. 27), the circuit using HFSR techniques (shown in FIGS. 38A, 39A and 40A–40B) and the circuit using the LFSR and the diode clamp techniques (shown in FIG. 52). As can be seen from Tables 1–3, by employing the LFSR and the diode clamping techniques, the circuit performance is improved dramatically; the voltage stresses of all the semiconductor components and capacitors are reduced by half; and the number of the magnetic components remains the same while the size is reduced if the isolation is not required. Therefore, the cost of the proposed circuit shown in FIG. 52 is reduced dramatically. In conclusion, from the points of both of the performance and the cost, the improved circuit (shown in FIG. 4.2) is a promising topology for the discharge lamp ballast.

TABLE 1

Performance Comparison

| | original circuit (FIG. 27) | HFSR w/instant start (FIGS. 38, 39A, 40A) | LFSR w/diode clamp (FIG. 52) |
|---|---|---|---|
| power factor | 0.925 | 0.93 | 0.993 |
| THD | 9.5% | 10.5% | 4–8% |
| crest factor | 1.9–2.1 | 1.9–2.1 | 1.5–1.7 |
| max. $V_{dc}$ at startup instant | >900 V | <450 V | <450 V |
| steady-state $V_{dc}$ at start-up mode | >900 V | >900 V | <450 V |

TABLE 2 non-magnetic component comparison

| | original circuit (FIG. 27) | HFSR w/instant start (FIGS. 38, 39A, 40A) | LFSR w/diode clamp (FIG. 52) |
|---|---|---|---|
| bridge diodes | 1000 V | 500 V | 500 V |
| fast diodes | 2 of 1000 V | 2 of 500 V | 4 of 500 V |
| MOSFETs | 2 of 1000 V | 2 of 500 V | 2 of 500 V |
| bulkcap | 1000 V | 450 V | 450 V |
| high frequency cap | 3 of 1000 V | 3 of 500 V, 1 of 1000 V | 3 of 500 V 1 of 1000 V |

TABLE 3

Comparison of the magnetic components' volume (unit: $cm^3$)

| | original circuit (FIG. 27) | HFSR w/instant start (FIGS. 38, 39A, 40A) | LFSR w/diode clamp (FIG. 52) |
|---|---|---|---|
| $Lr_1$ | 35.3 | 35.3 | 21 |
| $Lr_2$ or Lin | 0 | 1.9 | 21 |
| transformer | 26.8 | 26.8 | 0 |
| total | 62.1 | 64 | 42 |

To summarize, the present invention includes a feedback power source for receiving a portion of a high frequency output of an inverter and high frequency feedback device which feeds back the output from the feedback power source to the input side of the inverter. In response to the load reduction, the feedback device lowers a feedback quantity in a manner as to lower the voltage of the feedback power source to keep the voltage across a smoothing capacitor below a predetermined voltage level. With this arrangement, it is possible to restrain an undue voltage increase across the smoothing capacitor by lowering the voltage of the feedback power source in response to the load reduction, yet assuring a high input power factor by achieving the voltage feedback of feeding back the portion of the high frequency output from the inverter. Thus, there is no need to employ components of a high dielectric strength for smoothing capacitor and for the elements of the inverter, which leading to a reduction in component cost.

In the arrangement where a diode is inserted between the rectifier and the smoothing capacitor in a such manner as to flow the current for charging the capacitor, a switching element is connected in parallel with the capacitor across the diode and is controlled to turn on over a longer period as the load is reduced. Thus, the feedback amount can be adjusted simply by changing the on-period of the switching element, depending upon the load level. Consequently, an easy control is made to increase the feedback amount for improving the input power factor during a period in which the input current from the AC voltage source is large and is made to decrease the feedback amount for restraining the undue voltage increase of smoothing capacitor during another period in which the input current is relatively small.

Modifications and variations of the above-described embodiments of the invention are possible, as appreciated by those skilled in the art in light of the above teachings. It is therefore to be understood that, within the scope of the appended claims and their equivalents, the invention may be practiced otherwise than as specifically described.

What is claimed is:

1. A power supply that receives an AC voltage from an AC voltage source and supplies power to a load, comprising:

a) means for rectifying said AC voltage;

b) a capacitor, connected to said rectifying means that smooths an output thereof;

c) an inverter, powered by said capacitor, that provides a high frequency voltage to the load; and d) feedback means, connected between a node within said inverter and an input side of said inverter, for feeding back an amount of a signal that varies in response to variations in the load, said feedback means and said inverter collectively including an equivalent impedance that limits a voltage developed across said capacitor by reducing a magnitude of a voltage at said node until the occurrence of a predetermined event.

2. The power supply of claim 1, wherein said capacitor provides a substantially DC voltage which varies in response to a loading of a power output, said substantially DC voltage achieving a maximum voltage level; and said feedback means comprises:

a first impedance coupled to said AC power input; and a second impedance selectively coupled between said first impedance and said power output that reduces said maximum voltage level to a lowered voltage level for a predetermined time period, after which said power output rises to said maximum voltage level.

3. The power supply of claim 2, wherein:

the first impedance is a capacitance; and the second impedance is an inductance in series with the power output.

4. The power supply of claim 2 wherein:

said first impedance and said second impedance comprise a frequency-variant impedance having a predetermined resonance characteristic near an operating frequency of said power supply, that functions to reduce said maximum voltage level to said lowered voltage level until the occurrence of said predetermined event.

5. The power supply of claim 4, wherein said frequency-variant impedance reduces said maximum voltage level over what said maximum voltage level would be in an absence of said frequency-variant impedance.

6. The power supply of claim 1, wherein:

said power supply further comprises a feedback power source that receives a portion of said high frequency voltage from said inverter;

the load is a discharge lamp;

the inverter includes means for dimming the discharge lamp in accordance with a dimming degree; and the feedback means comprises means for varying the voltage of the feedback power source in response to variations in the dimming degree so as to lower the voltage across the capacitor.

7. The power supply of claim 1, wherein:

a) the load is a discharge lamp having filaments; and b) the power supply further comprises a high frequency feedback transformer having:

1) a first winding inserted in a supply path between the inverter and the discharge lamp;

2) a second winding inserted between non-energized ends of the filaments which are opposite to ends of filaments which are connected to tie inverter; and 3) a third winding connected to provide an induced voltage in additive relation to the high frequency voltage;

wherein the first and second windings are connected with opposite polarities through the filaments.

* * * * *

UNITED STATES PATENT AND TRADEMARK OFFICE

CERTIFICATE OF CORRECTION

PATENT NO. : 6,057,652

DATED : May 2, 2000

INVENTOR(S) : W. CHEN et al.

It is certified that error appears in the above-identified patent and that said Letters Patent is hereby corrected as shown below:

On the Title page, under "Related U.S. Application Data", include —[60] U.S. Provisional Application No. 60/004,263, September 25, 1995—.

Signed and Sealed this

Tenth Day of April, 2001

*Attest:*

Nicholas P. Godici

NICHOLAS P. GODICI

*Attesting Officer*

*Acting Director of the United States Patent and Trademark Office*